US012605020B2

(12) United States Patent
Lee et al.

(10) Patent No.: US 12,605,020 B2
(45) Date of Patent: Apr. 21, 2026

(54) CLEANER

(71) Applicant: LG ELECTRONICS INC., Seoul (KR)

(72) Inventors: Sangchul Lee, Seoul (KR); Changhwa Sun, Seoul (KR); Seungyeop Lee, Seoul (KR); Jungmin Ko, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 686 days.

(21) Appl. No.: 17/924,022

(22) PCT Filed: May 21, 2021

(86) PCT No.: PCT/KR2021/006371
§ 371 (c)(1),
(2) Date: Nov. 8, 2022

(87) PCT Pub. No.: WO2021/246694
PCT Pub. Date: Dec. 9, 2021

(65) Prior Publication Data

US 2023/0180979 A1 Jun. 15, 2023

(30) Foreign Application Priority Data

Jun. 1, 2020 (KR) ..... 10-2020-0066005
Dec. 16, 2020 (KR) ..... 10-2020-0176559

(51) Int. Cl.
*A47L 7/00* (2006.01)
*A47L 7/02* (2006.01)
*A47L 9/14* (2006.01)

(52) U.S. Cl.
CPC ..... *A47L 7/0066* (2013.01); *A47L 7/02* (2013.01); *A47L 9/14* (2013.01); *A47L 2201/04* (2013.01)

(58) Field of Classification Search
CPC . A47L 7/0066; A47L 7/02; A47L 9/14; A47L 2201/04
See application file for complete search history.

(56) References Cited

U.S. PATENT DOCUMENTS 10,064,528 B1 * 9/2018 Ebrahimi Afrouzi ..... A47L 9/1409
2021/0186285 A1 * 6/2021 Yang ..... A47L 9/20

FOREIGN PATENT DOCUMENTS

CN 105530847 A * 4/2016 ..... A47L 9/1633
CN 105530847 4/2018
(Continued)

OTHER PUBLICATIONS

CN 105530847 A—English Machine Translation (Year: 2016).*
(Continued)

*Primary Examiner* — Marc Carlson
(74) *Attorney, Agent, or Firm* — KED & ASSOCIATES, LLP

(57) ABSTRACT

A cleaner is disclosed. A dust storage container according to an embodiment of the present invention includes a winding member. The winding member rotates in the dust storage container to wind debris having a shape which is thin, long, and compressible, such as fur of an animal or fiber introduced into the dust storage container. Accordingly, a space occupied by the debris in the form of fur or fiber in the dust storage container is reduced. Therefore, the dust storage container can receive a large amount of debris so as to increase an operable time of the cleaner. Consequently, the convenience of a user can be improved.

13 Claims, 39 Drawing Sheets

(56) References Cited

FOREIGN PATENT DOCUMENTS

| | | | | | |
|---|---|---|---|---|---|
| CN | 108185912 | | | 6/2018 | |
| CN | 108185912 | A | * | 6/2018 | ..... A47L 9/1608 |
| JP | 2004305230 | A | * | 11/2004 | |
| JP | 4589989 | | | 12/2010 | |
| JP | 4589989 | B2 | * | 12/2010 | |
| KR | 10-2005-0090719 | | | 9/2005 | |
| KR | 20050090719 | A | * | 9/2005 | |
| KR | 10-0871485 | | | 12/2008 | |
| KR | 100871485 | B1 | * | 12/2008 | |
| KR | 10-1328794 | | | 11/2013 | |
| KR | 10-1473781 | | | 12/2014 | |
| KR | 101473781 | B1 | * | 12/2014 | |
| KR | 10-2017-0111688 | | | 10/2017 | |
| KR | 20180052586 | A | * | 5/2018 | |
| KR | 10-1878142 | | | 8/2018 | |
| WO | WO 2019/120178 | | | 6/2019 | |
| WO | WO-2019120178 | A1 | * | 6/2019 | ..... A47L 9/16 |
| WO | WO 2019/175813 | | | 9/2019 | |
| WO | WO-2019175813 | A1 | * | 9/2019 | ..... A45D 24/46 |
| WO | WO-2021246693 | A1 | * | 12/2021 | ..... A47L 9/106 |

OTHER PUBLICATIONS

International Search Report dated Sep. 16, 2021 issued in Application No. PCT/KR2021/006371.
Taiwanese Office Action issued in Application No. 110119582 dated Dec. 27, 2021.

* cited by examiner (a)

(b)

CLEANER

CROSS-REFERENCE TO RELATED PATENT APPLICATIONS

This application is a U.S. National Stage Application under 35 U.S.C. § 371 of PCT Application No. PCT/KR2021/006371, filed May 21, 2021, which claims priority to Korean Patent Application Nos. 10-2020-0066005, filed Jun. 1, 2020 and 10-2020-0176559, filed Dec. 16, 2020, whose entire disclosures are hereby incorporated by reference.

TECHNICAL FIELD

The present disclosure relates to a cleaner, and more specifically, to a cleaner having a structure that can effectively accommodate a bulky and compressible material such as fur or fibers.

BACKGROUND ART

A cleaner refers to an apparatus that can be manually operated by a user or by itself to perform a cleaning operation. The cleaning operation using the cleaner is generally used because a cleaning effect and user convenience can be improved, compared to a case of using conventional cleaning tools such as a broom, a mop, or the like.

A cleaner may be used both indoors or outdoors. However, due to issues such as power supply, hygiene, and the like, cleaners are generally used indoors rather than outdoors.

Cleaners may be divided into a manual cleaner that a user grips and directly manipulates, and a robot cleaner that performs cleaning by self-driving.

For a manual cleaner, a user directly moves the cleaner to perform a cleaning operation. Therefore, the manual cleaner has characteristics of light weight and mobility.

An automatic robot cleaner also has the characteristics of the light weight and mobility for the purpose of minimizing power which is required for self-driving.

A light weight depends not only on a material of which a cleaner is manufactured, but also on its size and volume. In this case, when the cleaner is excessively reduced in size in consideration of the light weight, it is difficult to be equipped with a dust bin having a sufficient capacity to store dust or litter (dirt or debris) which is collected during a cleaning operation.

Therefore, a general cleaner is manufactured in such a way of maximizing an amount of dust or litter (dirt or debris) to be accommodated and pursuing a light weight. That is, there is a limit to an increase in size and volume of the cleaner.

On the other hand, as the number of members constituting a household such as a single person household is decreasing, the number of households with pets (companion animals) is increasing. However, pets have more fur (or hair) than humans and the fur falls out easily. The fur of the pets is generally larger in volume, lighter in weight, and longer in length than ordinary dust or small-sized litter (or debris).

When a cleaning operation is performed in an environment with pets, the litter collected by a cleaner contains fur of the pets. Body hair that fell out from bodies of a user and housemates may also be contained in the litter collected by the cleaner.

At this time, due to the characteristics of the fur or hair, a dust bin having a limited size, provided in a cleaner, is filled with the fur or hair quickly.

Accordingly, in the case of a manual cleaner, an operation of emptying a dust bin must be accompanied while a cleaning operation is being performed. In addition, in the case of an automatic robot cleaner, a cleaning operation may be terminated because a dust bin is full even though the cleaning operation has not been sufficiently performed.

In this case, since the continuity of the cleaning operation is broken and the cleaning operation is incompletely terminated, reliability of the cleaning operation and the user's satisfaction may be lowered.

Moreover, the fur has a predetermined elasticity. Therefore, there is a fear that the fur or hair collected in the dust bin collides with the dust bin and spreads in all directions, unlike other types of litter (dirt or debris).

Accordingly, techniques for cleaners for effectively collecting user's body hair or pet fur have been introduced.

Japanese Patent Document No. 4589989 discloses a cyclone separation apparatus. Specifically, the patent document discloses a cyclone separation apparatus having a structure, which is provided with a compression member rotatable in a collection container and a rotation suppression component for suppressing rotation of an object to be collected, so as to downwardly press and compress the object inside the collection container.

However, this type of cyclone separation apparatus has a limitation on the premise that it is applied to litter (or dirt) in the form of dust that is easily accumulated. That is, the prior art literature does not suggest a method for preventing entanglement of litter in the form of fur or body hair that can be easily entangled on a compression member or the like.

Furthermore, the prior art literature does not suggest a method for easily discharging the fur or body hair inside a collection space.

Korean Patent Registration No. 10-0871485 discloses a method of operating a dust compression type dust collector. Specifically, the patent document discloses a dust compression type dust collector having a structure capable of compressing collected dust by using a pressing plate rotatably provided inside a dust bin, and a method of operating the same.

However, this type of dust compression type dust collector has a limitation in that it is difficult to consider the characteristics of litter collected in the dust bin. That is, the prior art literature does not prepare for a case in which the litter collected in the dust bin returns to its original form after pressing is terminated when the litter is in the form of fur or body hair having a predetermined elasticity.

U.S. Pat. No. 10,064,528 discloses a debris compression system for a robot vacuum cleaner. Specifically, the patent document discloses a debris compression system having a structure capable of compressing collected debris, that is, litter (or dirt) to one side, by using a plate installed in a debris container to perform translational reciprocating motion.

By the way, this type of debris compression system may be applied only when the shape of the debris container has a constant cross-sectional area along its extending direction. That is, the prior art literature is difficult to be applied when the shape of the debris container has various cross-sectional areas along the extending direction.

Moreover, in the prior art literature, one side of an inner space of the debris container is occupied by compressed debris. That is, while the vacuum cleaner is operated, the inner space of the debris container in which the compressed debris is located becomes a dead volume. Thus, an amount of debris to be collected by the cleaner may be reduced.

Korean Patent Publication No. 10-2017-0111688 discloses a suction nozzle device and a cleaner having the same. Specifically, the patent document discloses a suction nozzle device having a structure capable of cutting long and thin litter such as pets' fur or thread by using a cutting member for removing foreign substances wound around a drum brush, and a cleaner having the same.

However, this type of suction nozzle device and the cleaner having the same only disclose a method of cutting the litter accommodated in a dust bin, and fail to suggest a method for overcoming a space limitation of the dust bin.

DISCLOSURE OF INVENTION

Technical Problem

The present disclosure is directed to a cleaner having a structure capable of solving the aforementioned problems and other drawbacks.

First, one aspect of the present disclosure is to provide a cleaner having a structure capable of effectively accommodating litter (dirt or debris) in the form of fur or fibers.

Another aspect of the present disclosure is to provide a cleaner having a structure capable of reducing a size of a space occupied by accommodated litter in the form of fur or fibers.

Still another aspect of the present disclosure is to provide a cleaner having a structure capable of increasing an available time for performing a cleaning operation.

Still another aspect of the present disclosure is to provide a cleaner having a structure capable of securing design diversity while achieving the above aspects.

Still another aspect of the present disclosure is to provide a cleaner having a structure in which operation reliability is not deteriorated by accommodated litter in the form of fur or fibers.

Still another aspect of the present disclosure is to provide a cleaner having a structure capable of suppressing accommodated litter in the form of fur or fibers from interfering with communication between an accommodation space and an outside.

Solution to Problem

In order to achieve those aspects and other advantages, the present disclosure provides a cleaner having a structure as follows.

First, the cleaner may be provided with a dust storage container for accommodating various forms of dust or litter. The dust storage container may have a collection space for accommodating collected litter. A winding member may be disposed in the collection space.

The winding member may extend in one direction in the collection space. In one implementation, the winding member may extend in a vertical (up and down) direction of the collection space. In this case, the direction in which the winding member extends may form a predetermined inclination with a direction in which a suction portion as an inlet through which the collected litter is introduced into the collection space and an exhaust portion through which air sucked together with the litter is exhausted are arranged.

Litter in the form of fur or fibers introduced into the collection space may be wound around the winding member. That is, the litter in the form of fur or fibers introduced through the suction portion may flow toward the exhaust portion and reach the winding member. The litter in the form of fur or fibers having a predetermined elasticity may be deformed and wound around the winding member.

In one implementation, the winding member may be rotatably disposed in the collection space. As the cleaner is operated, the litter in the form of fur or fibers introduced into the collection space may be wound around the rotating winding member.

The litter in the form of fur or fibers wound around the winding member may stay in the collection space in the form of skein. The skein may occupy a small space, compared to a case where the litter in the form of fur or fibers is not wound.

In one implementation, the winding member may be provided in plurality. The plurality of winding members may be spaced apart from each other at various positions in the collection space. The litter in the form of fur or fibers may be wound around each of the plurality of winding members.

In the implementation, the winding members adjacent to each other may be located to be spaced apart from each other. The skein formed by the litter in the form of fur or fibers wound around one of the adjacent winding members may not interfere with another skein formed by the litter in the form of fur or fibers wound around another winding member.

In one implementation, the winding member may be located between a suction portion and an exhaust portion. The winding member may preferably be located closer to the exhaust portion than to the suction portion. At this time, the winding member may be disposed so that an area overlapping a filter provided in the exhaust portion is minimized.

In one implementation, the winding member may be rotated in various directions. The winding member may be continuously rotated in any one of a clockwise direction and a counterclockwise direction. Alternatively, the winding member may be rotated by a predetermined angle in one of the clockwise direction and the counterclockwise direction and then rotated in another direction of the clockwise direction and the counterclockwise direction.

That is, the winding member may be alternately rotated in the clockwise and counterclockwise directions.

Advantageous Effects of Invention

According to an implementation of the present disclosure, the following effects can be achieved.

First, a collection space for accommodating collected litter may be defined in a dust storage container provided in a cleaner. A winding member extending in one direction may be disposed in the collection space.

Litter in the form of fur or fibers may be changed in shape due to a suction speed and introduced into the collection space through a suction portion through which the collection space communicates with an outside. At this time, since the winding member serving as a bobbin is disposed in the collection space, the introduced litter in the form of fur or fibers may be wound around the winding member according to characteristics of type and shape of the litter.

The litter in the form of fur or fibers continuously introduced into the collection space may be continuously wound around the winding member according to entangling properties.

In one implementation, the winding member may be rotated inside the collection space. Accordingly, the litter in the form of fur or fibers can be more effectively wound around the winding member. The plurality of winding members may be rotated in different directions, so that the litter such as the fur or fibers introduced in various directions through the suction portion can be effectively wound.

As the litter such as the fur or fibers accommodated in the collection space may be wound around the winding member into the form of skein, the litter such as the fur or fibers may not spread out in the collection space. This may result in decreasing a space, which is occupied by the litter such as the fur or fibers having a volume larger than a mass, in the collection space.

Accordingly, an available space inside the collection space can increase. As a result, an amount of litter in the form of fur or fibers that can be accommodated in the collection space can increase. Furthermore, an amount of other types of garbage (trash, litter) that can be accommodated in the collection space can also increase.

As the space occupied by the litter such as the fur or fibers in the collection space decreases, the amount of litter in the form of fir or fibers and the amount of various types of garbage or litter that can be accommodated in the collection space may increase.

This may result in increasing a time for which a cleaning operation can be performed without emptying the dust storage container. Therefore, not only the continuity of the cleaning operation can be ensured, but also the cleaning operation cannot be stopped due to the fact that the dust storage container is full during cleaning.

The litter in the form of fur or fibers introduced into the collection space may be wound around various components provided on the winding member. Accordingly, the winding member may be manufactured in various forms depending on the shape and manufacturing situation of the dust storage container. This may result in securing design diversity of the cleaner.

In addition, the winding member can be rotated in various directions. The winding member may be continuously rotated along one direction, or may be rotated in one direction and another direction in an alternating manner.

Accordingly, the winding member may be operated in various ways depending on an environment in which the cleaner is used and a type of litter to be collected, thereby enhancing efficiency of the cleaning operation.

In one implementation, the winding member may be located between a suction portion through which various types of litter or garbage are introduced into the collection space and an exhaust portion through which air introduced together with the litter or garbage is discharged. In this case, the winding member may be located closer to the exhaust portion than to the suction portion.

Accordingly, an area in which a skein of the litter in the form of fur or fibers wound around the winding member obscures or blocks the suction portion can be minimized. As a result, even when the diameter of the skein is increased as the litter such as the fur or fibers is continuously wound around the winding member, the suction capacity of the cleaner cannot be lowered.

Further, in the implementation, the winding member may be disposed so that an area overlapping the exhaust portion can be minimized. Accordingly, an area of the winding member overlapping a filter provided in the exhaust portion can be minimized. As a result, a flow path through which air introduced into the collection space along with the litter such as the fur or fibers is discharged to the outside again can be secured, thereby preventing an exhaust capacity of the cleaner from being deteriorated.

According to various implementations, the litter such as the fur or fibers can be compressed by being wound around the winding member. Accordingly, the space occupied by the litter such as the fur or fibers in the collection space can decrease. This may result in increasing an amount of litter to be introduced into a remaining space in the collection space.

Figure 4:
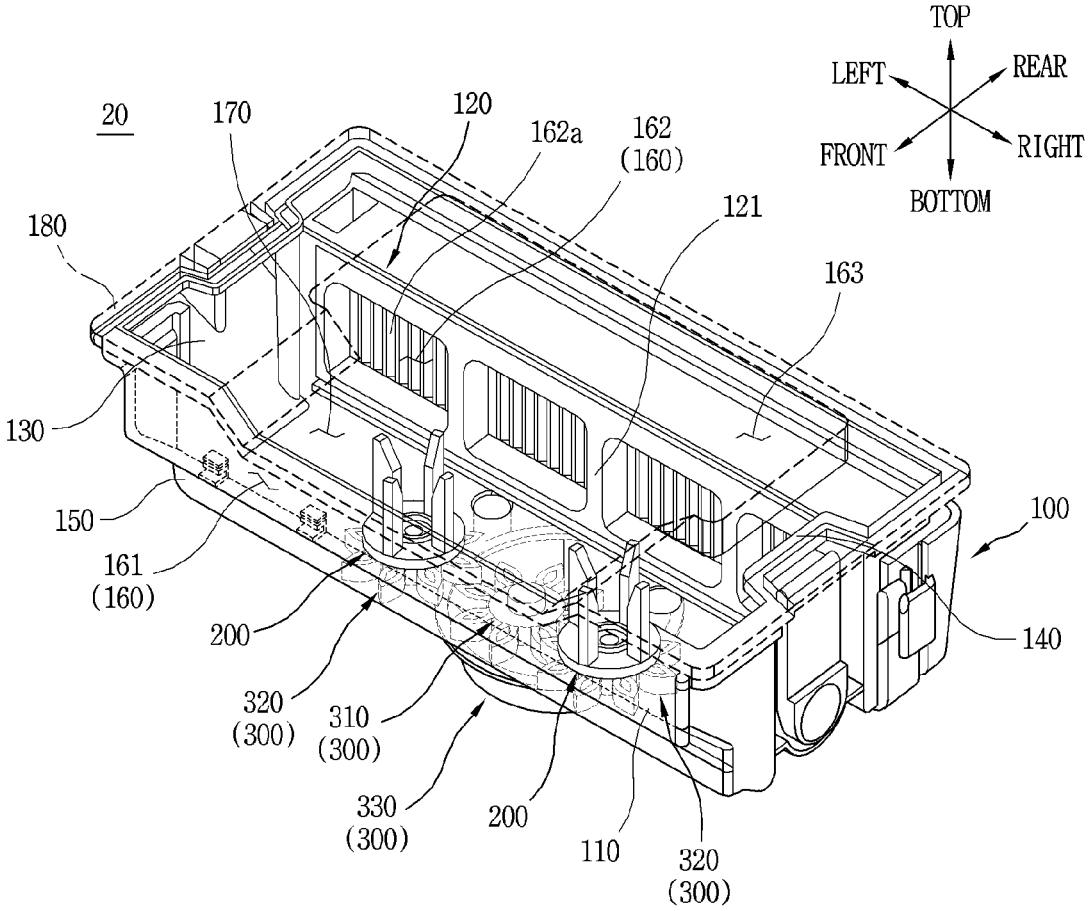
FIG. 4 is a perspective view illustrating a dust storage container provided in the cleaner of FIG. 1.
Figure 10:
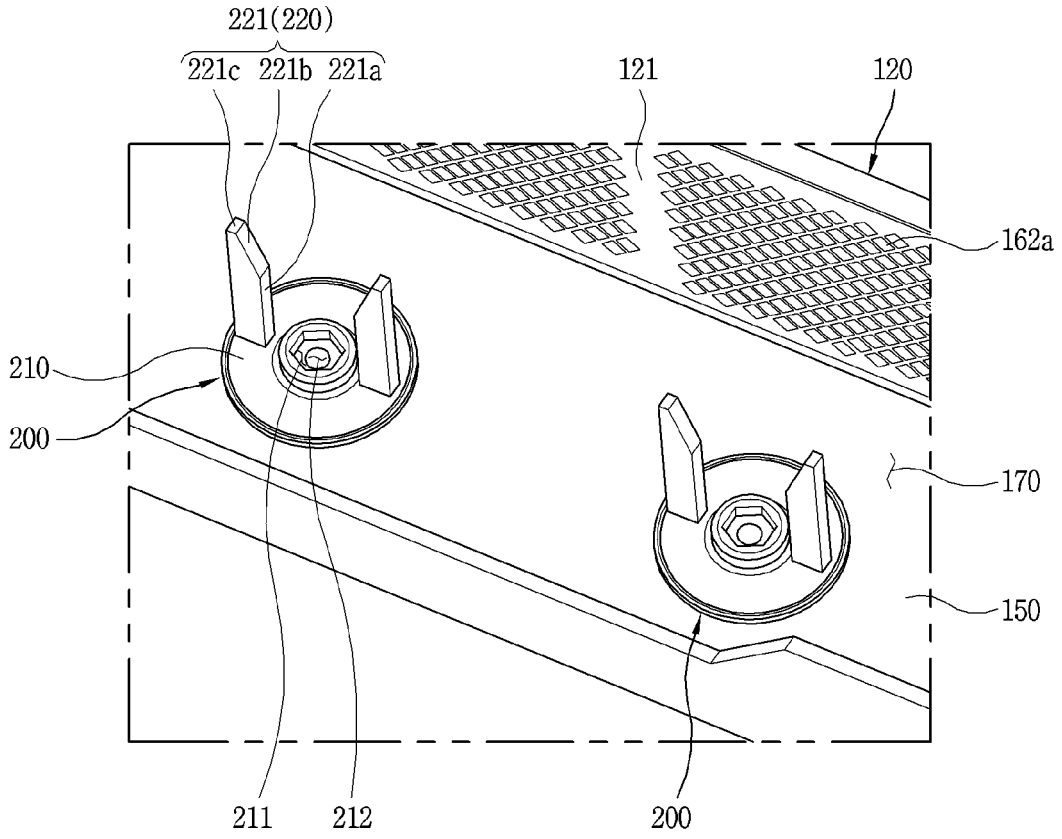
FIG. 10 is a partially enlarged perspective view illustrating a winding member provided in the dust storage container of FIG. 4.
Figure 11:
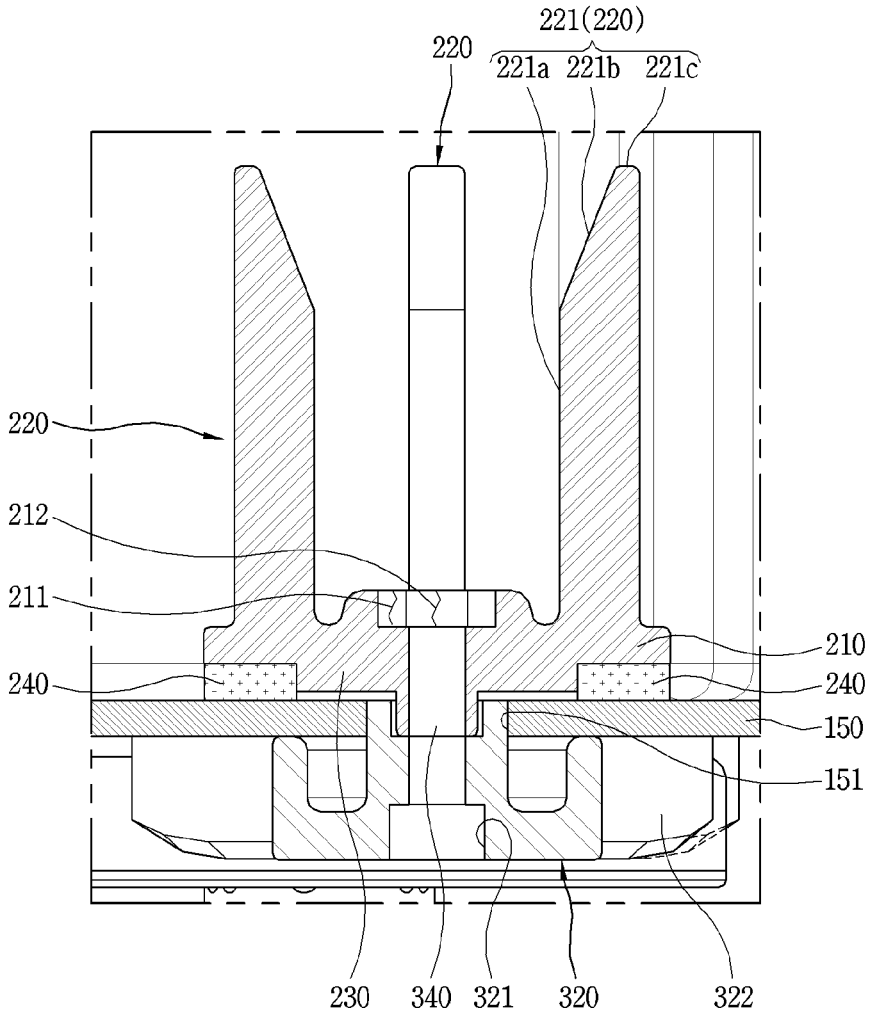
FIG. 11 is a cross-sectional view illustrating a state in which the winding member of FIG. 10 is coupled to the dust storage container of FIG. 4.
Figure 12:
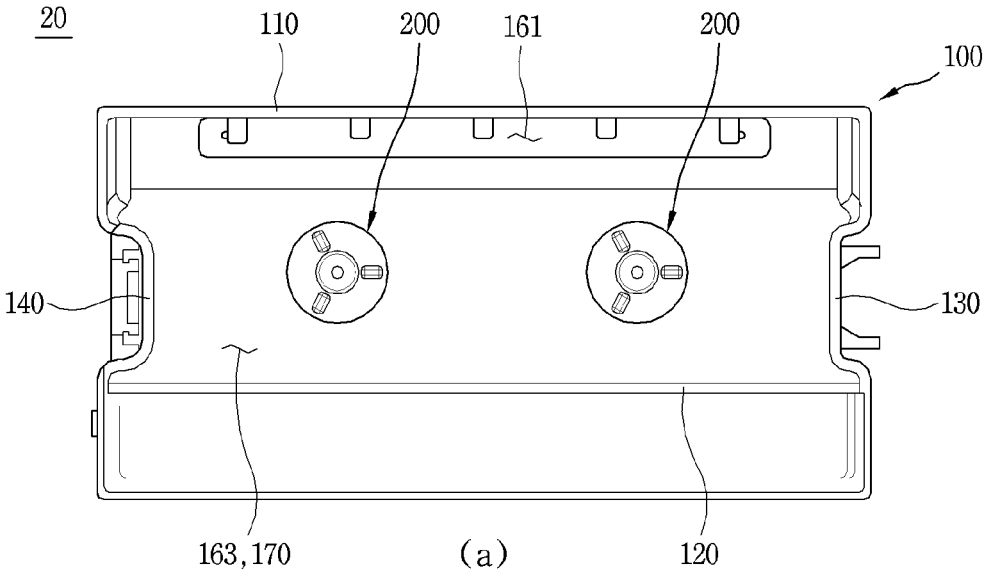
Figure 12:
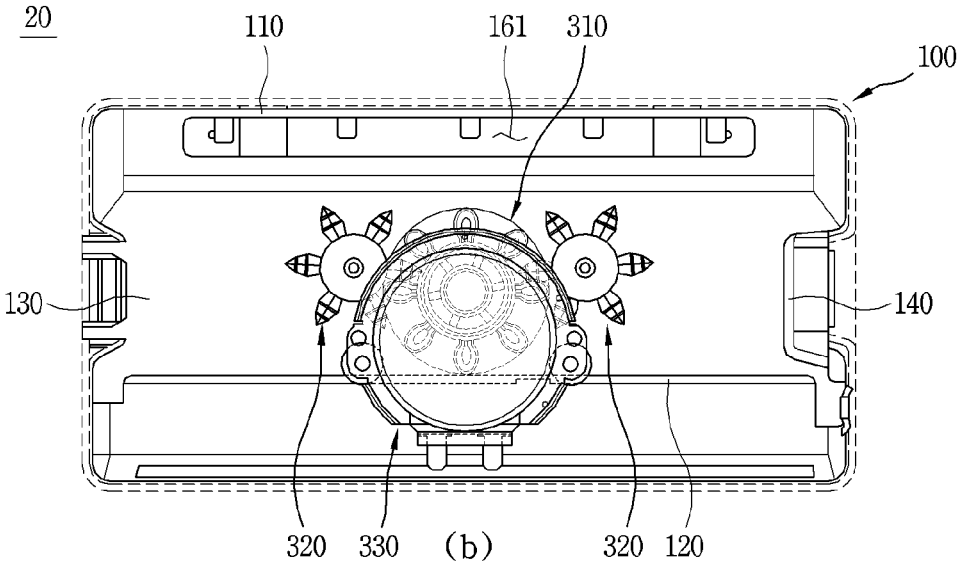

(a) and (b) of FIG. 12 are a planar view and a rear view, respectively, illustrating one example in which the winding member of FIG. 10 is provided in the dust storage container of FIG. 4.

Figure 13:
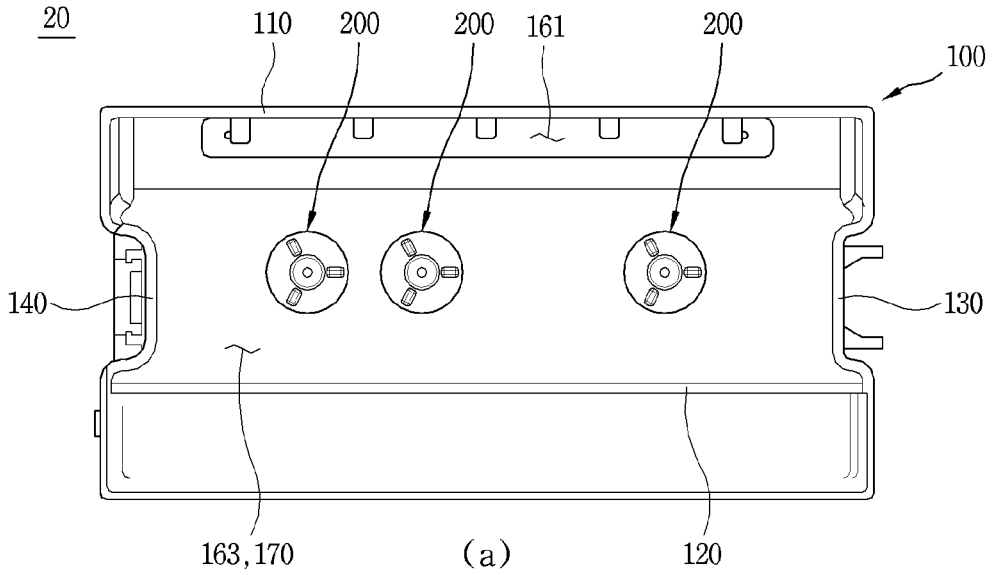
Figure 13:
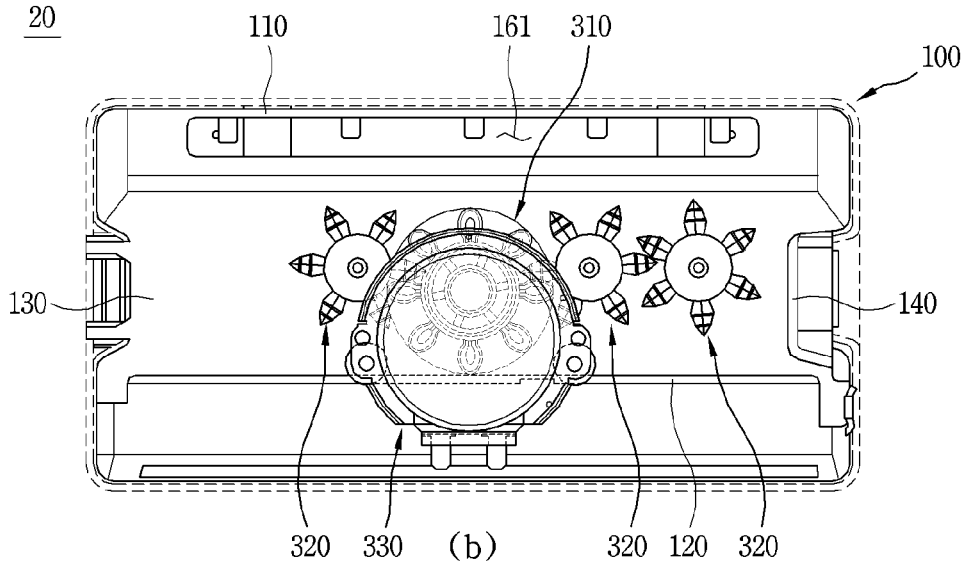

(a) and (b) of FIG. 13 are a planar view and a rear view, respectively, illustrating another example in which the winding member of FIG. 10 is provided in the dust storage container of FIG. 4.

Figure 14:
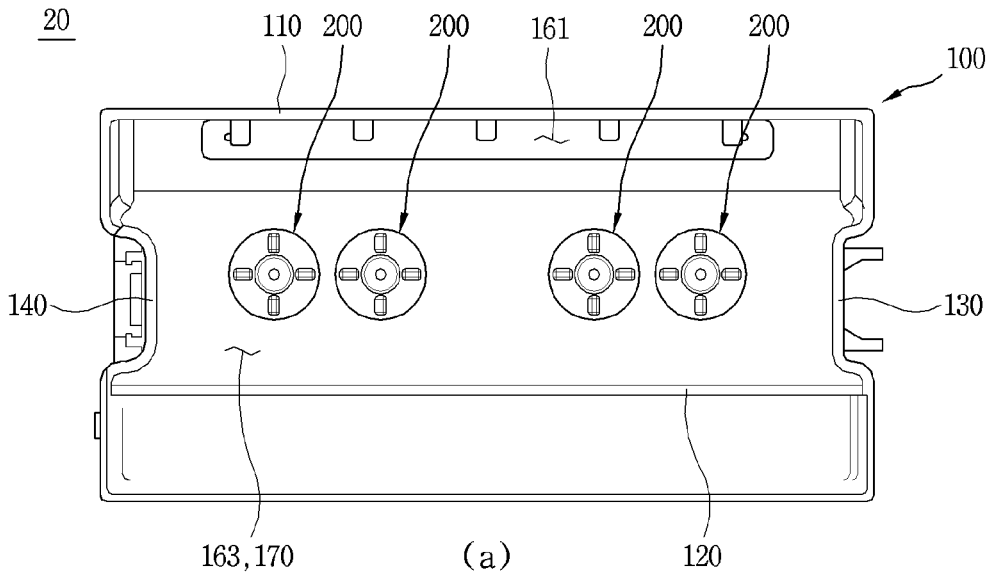
Figure 14:
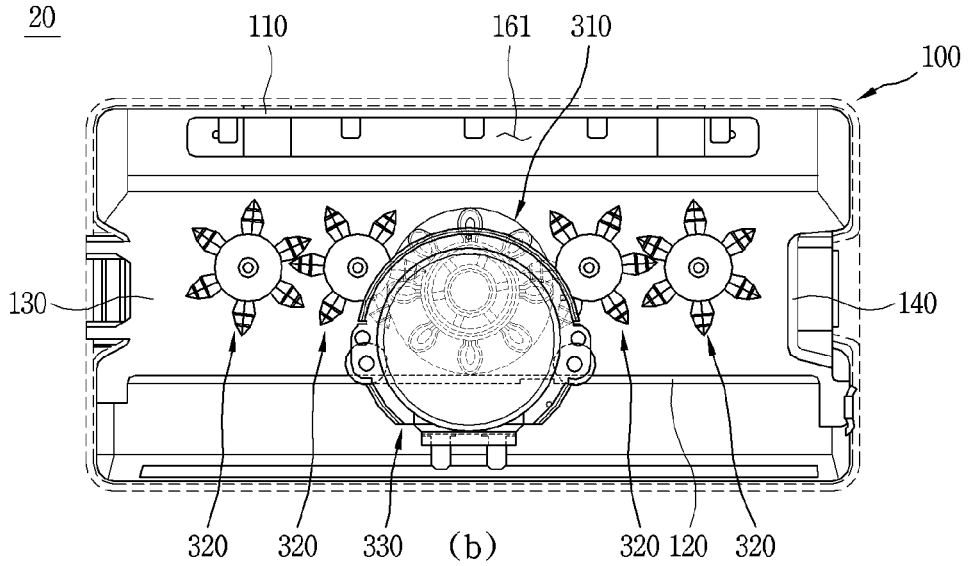

(a) and (b) of FIG. 14 are a planar view and a rear view, respectively, illustrating still another example in which the winding member of FIG. 10 is provided in the dust storage container of FIG. 4.

Figure 15:
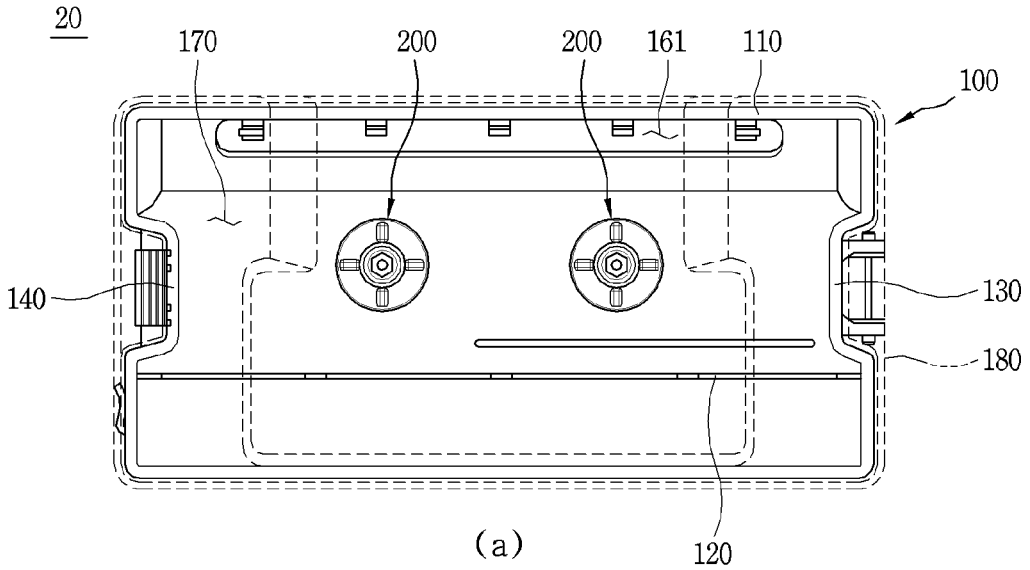
Figure 15:
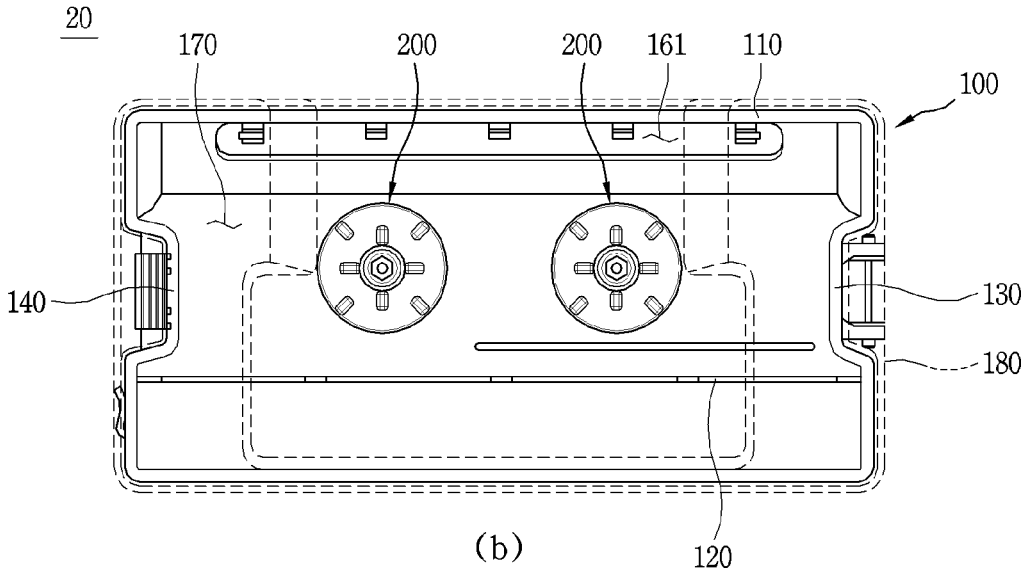

(a) and (b) of FIG. 15 are planar views illustrating various implementations of the winding member of FIG. 10.

Figure 16:
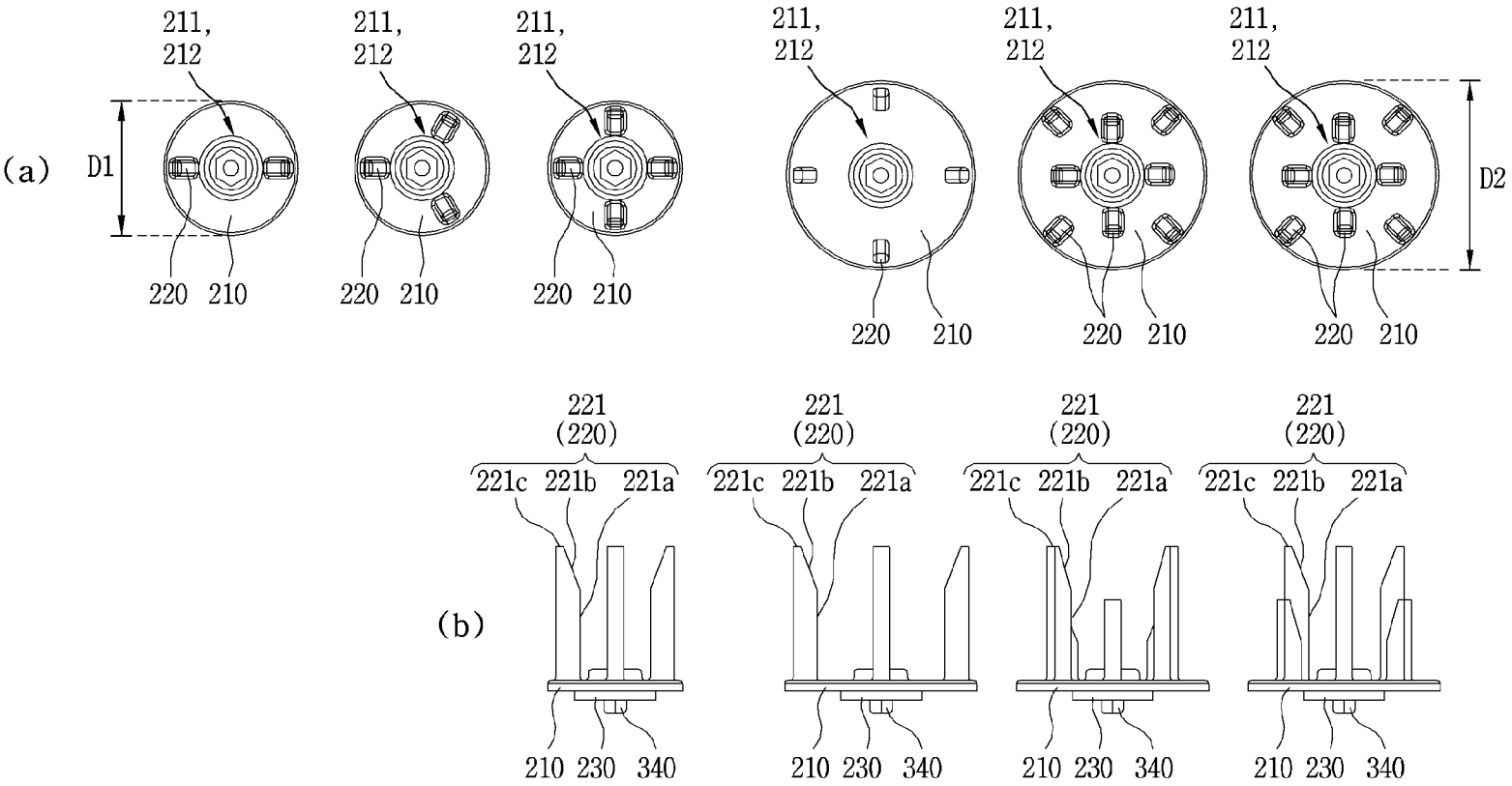

(a) and (b) of FIG. 16 are a planar view and a front view, respectively, illustrating various implementations of the winding member of FIG. 10.

Figure 17:
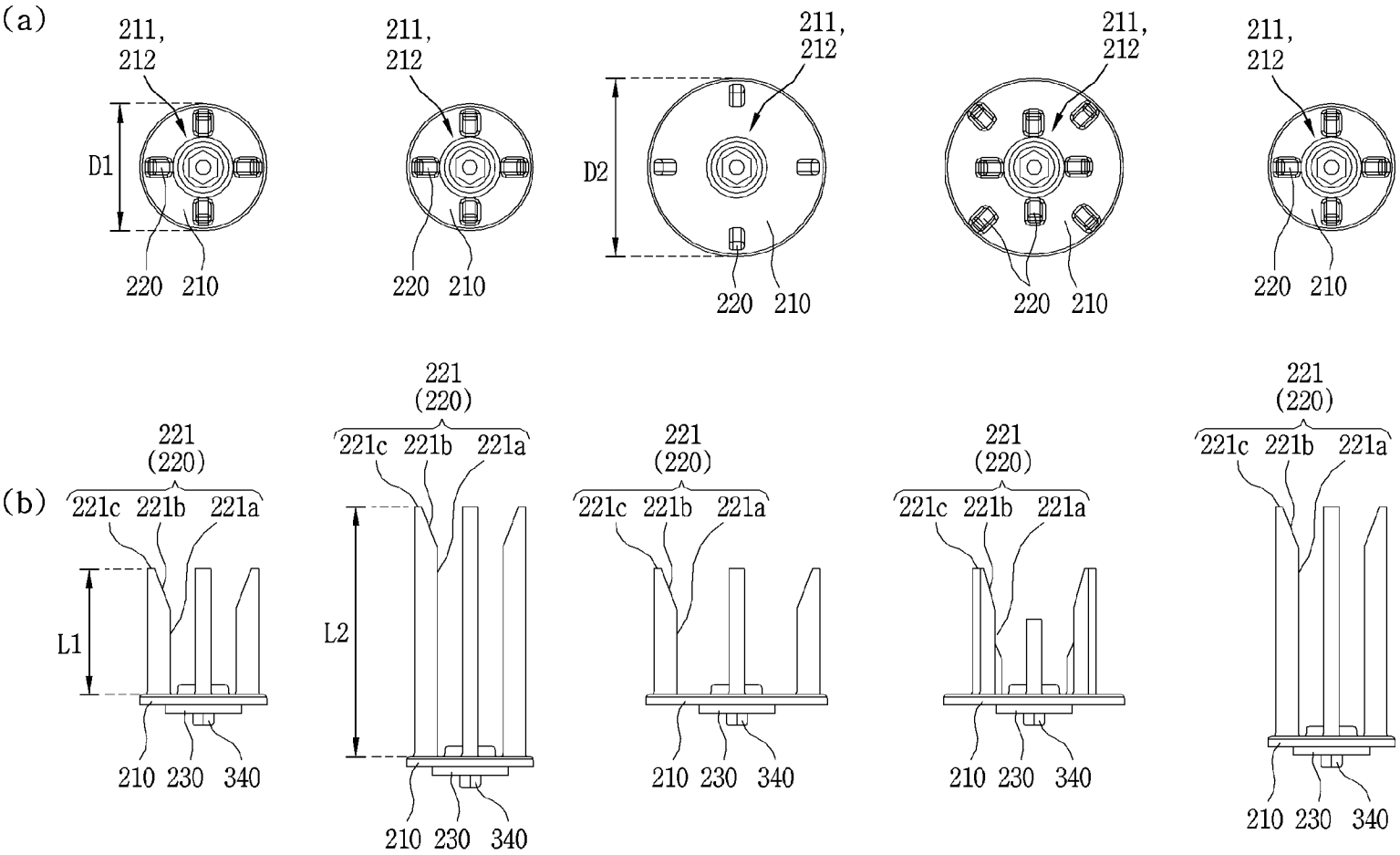

(a) and (b) of FIG. 17 are a planar view and a front view, respectively, illustrating various implementations of the winding member of FIG. 10.

Figure 18:
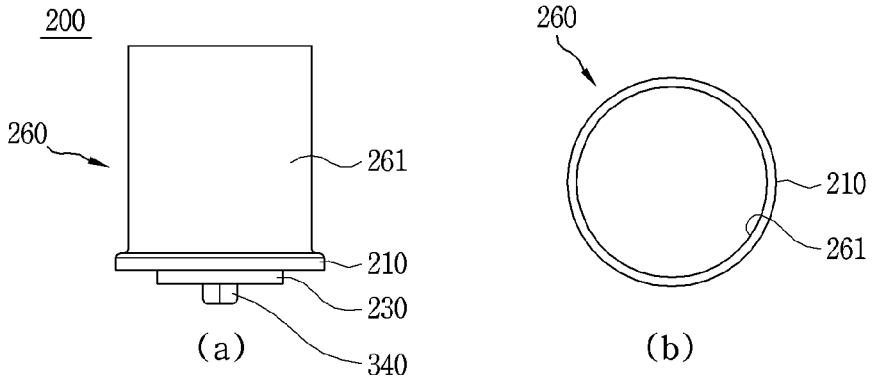

(a) and (b) of FIG. 18 are a front view and a planar view, respectively, illustrating a winding column portion provided in the winding member of FIG. 10.

Figure 19:
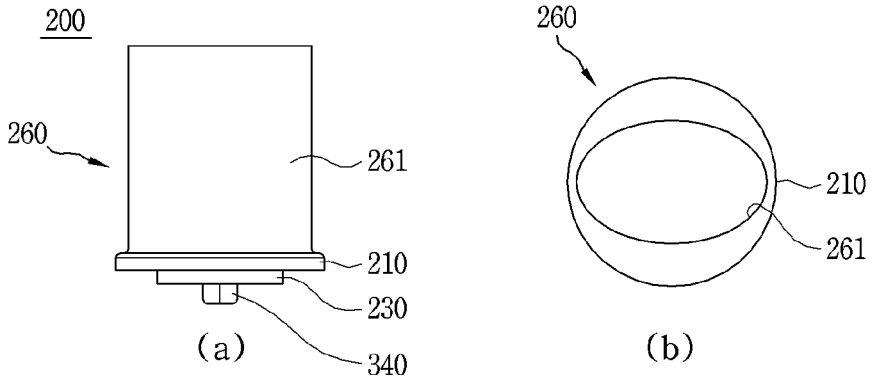

(a) and (b) of FIG. 19 are a front view and a planar view, respectively, illustrating one variation of the winding column portion of FIG. 18.

Figure 20:
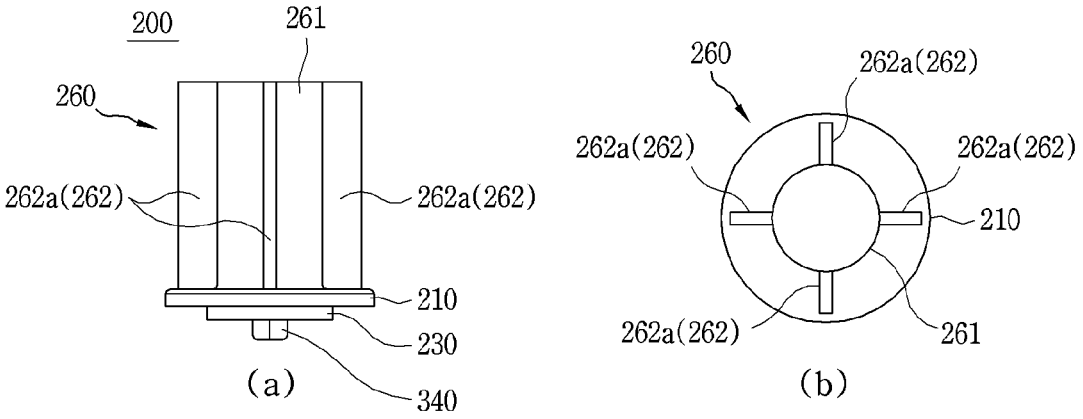

(a) and (b) of FIG. 20 are a front view and a planar view, respectively, illustrating another variation of the winding column portion of FIG. 18.

Figure 21:
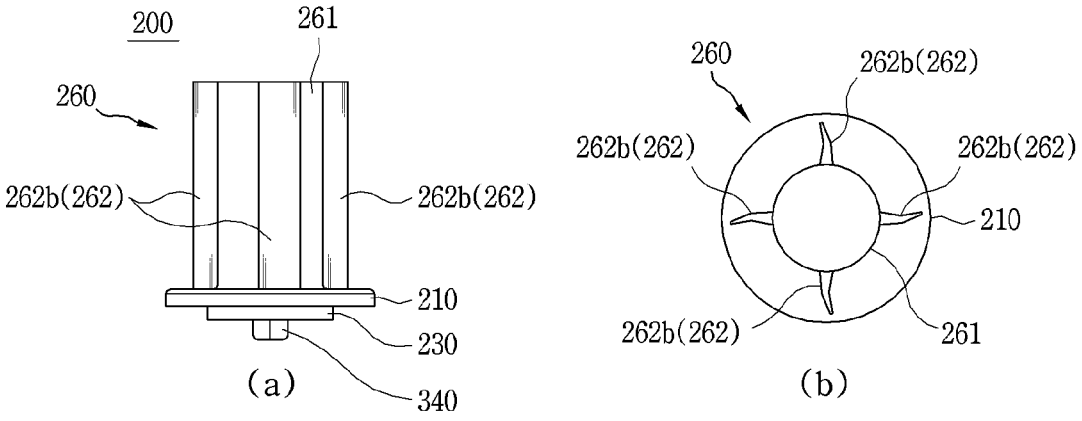

(a) and (b) of FIG. 21 are a front view and a planar view, respectively, illustrating still another variation of the take-up column portion of FIG. 18.

Figure 22:
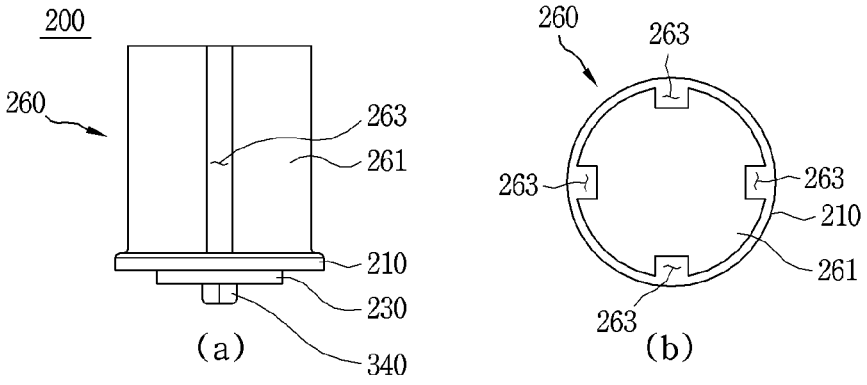

(a) and (b) of FIG. 22 are a front view and a planar view, respectively, illustrating still another variation of the winding column portion of FIG. 18.

Figure 23:
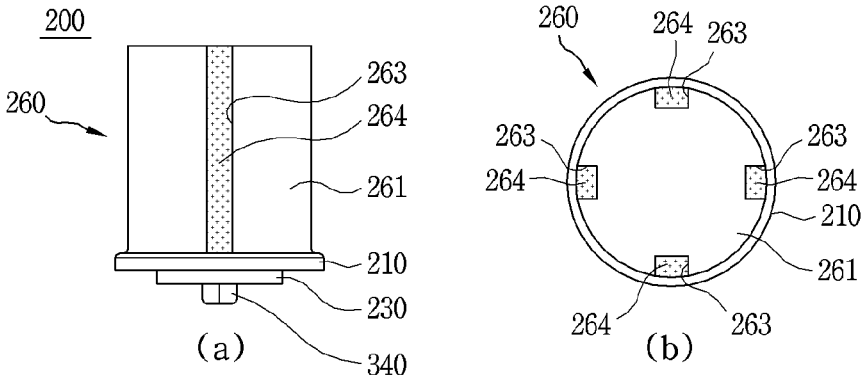

(a) and (b) of FIG. 23 are a front view and a planar view, respectively, illustrating still another variation of the winding column portion of FIG. 18.

Figure 24:
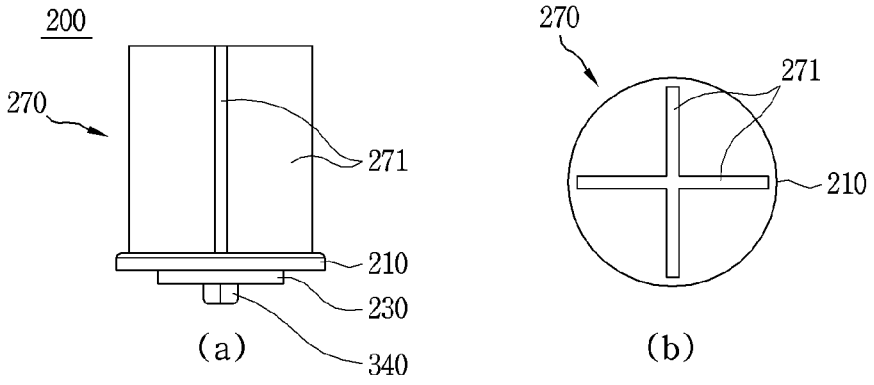

(a) and (b) of FIG. 24 are a front view and a planar view, respectively, illustrating a winding blade provided in the winding member of FIG. 10.

Figure 25:
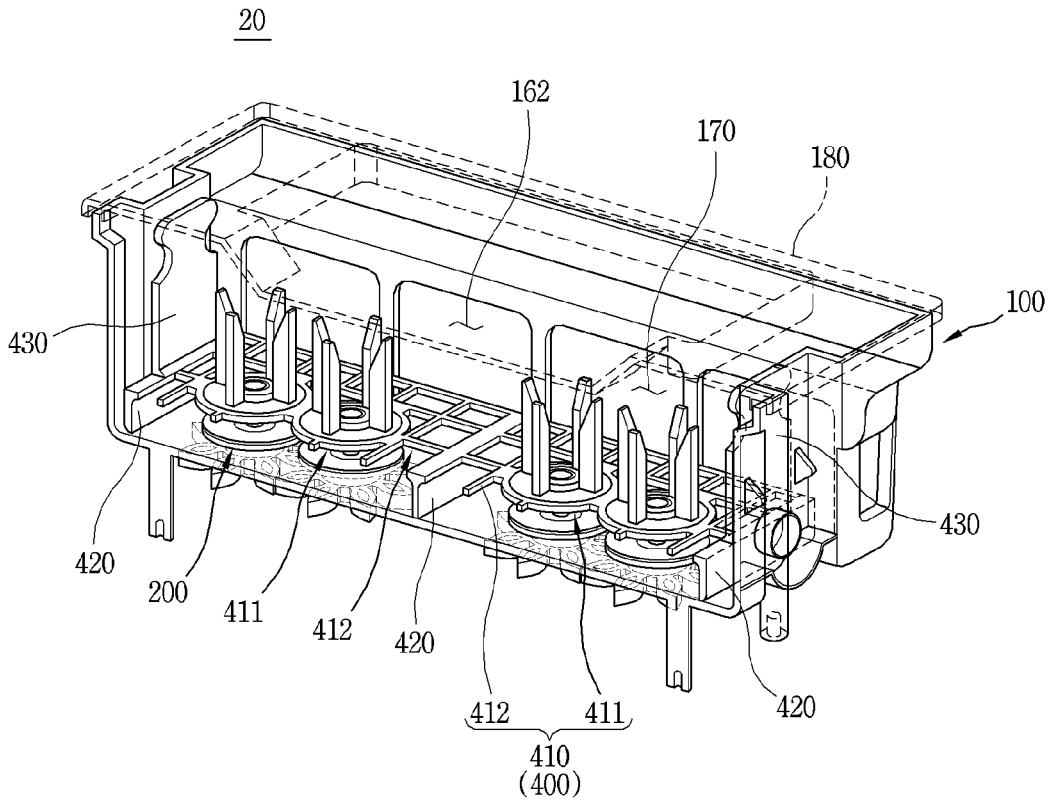

FIG. 25 is a perspective view illustrating a dust storage container including a detachable frame in accordance with one implementation of the present disclosure.

Figure 26:
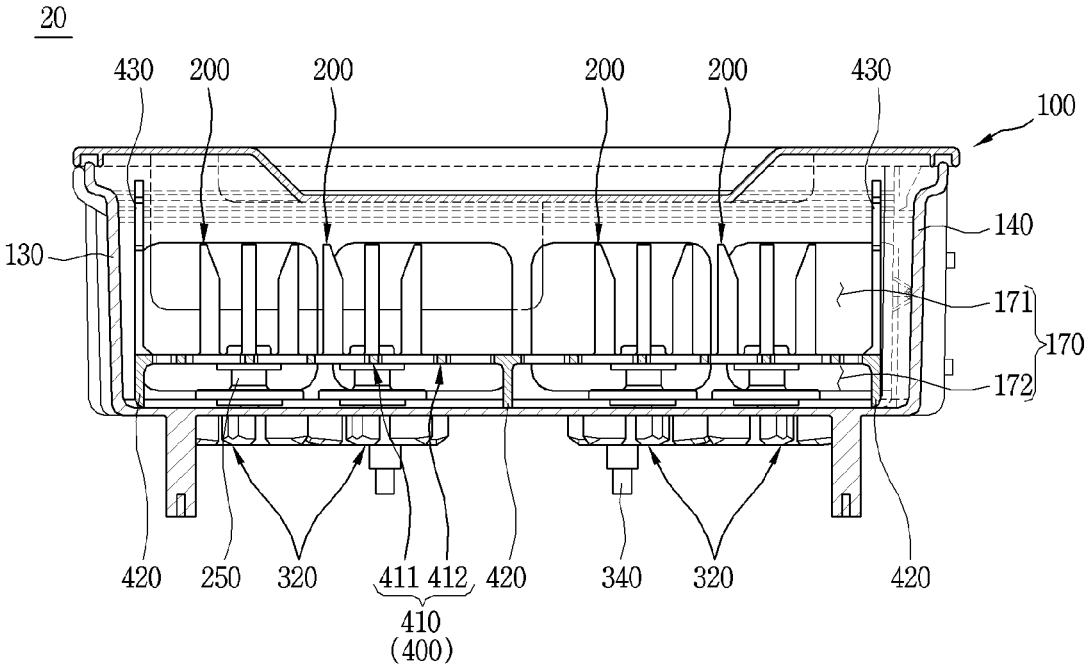

FIG. 26 is a front cross-sectional view of the dust storage container of FIG. 25.

Figure 27:
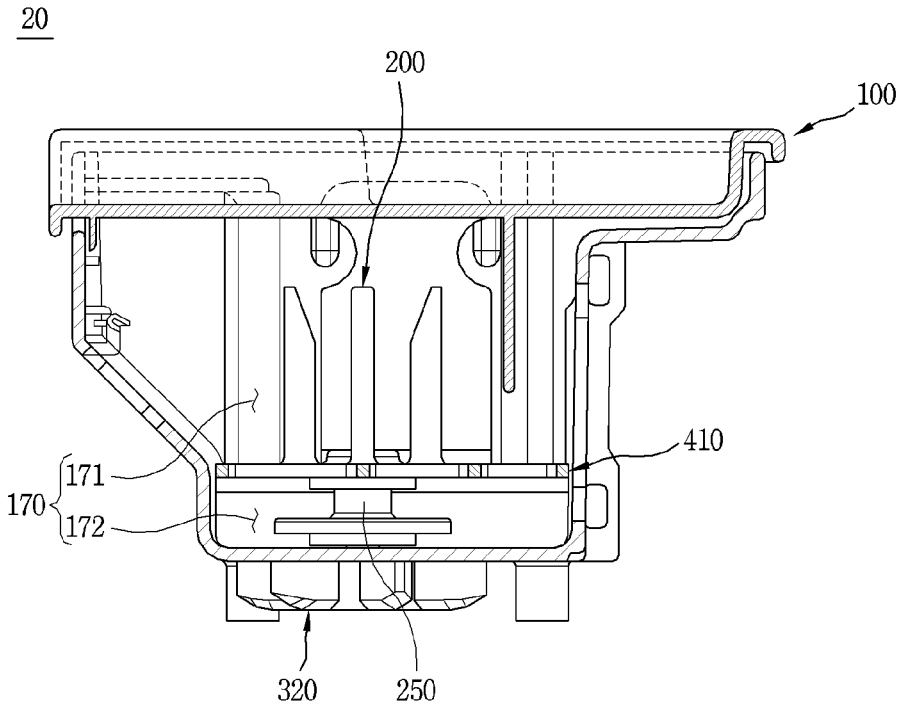

FIG. 27 is a lateral cross-sectional view of the dust storage container of FIG. 25.

Figure 28:
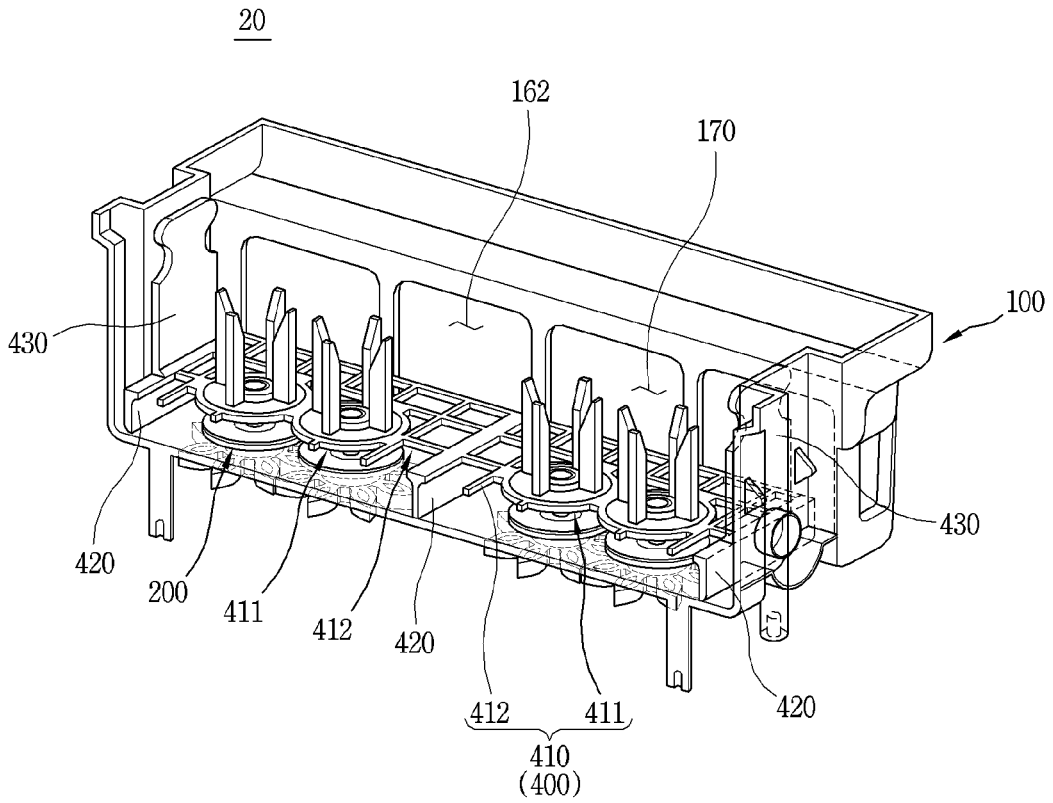

FIG. 28 is a perspective view illustrating a state in which a cover is detached from the dust storage container of FIG. 25.

Figure 29:
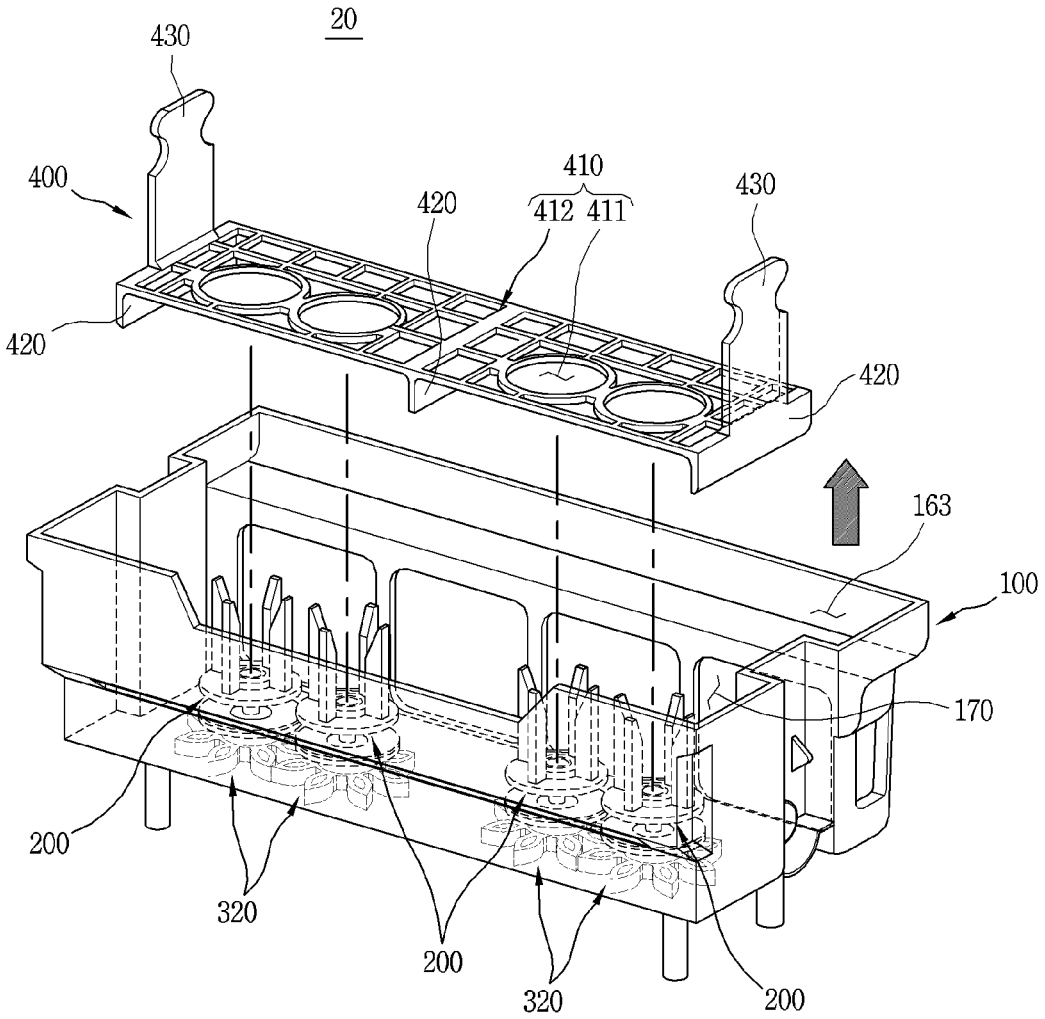

FIG. 29 is a perspective view illustrating a state in which a detachable frame according to one implementation of the present disclosure is detached from the dust storage container of FIG. 25.

Figure 30:
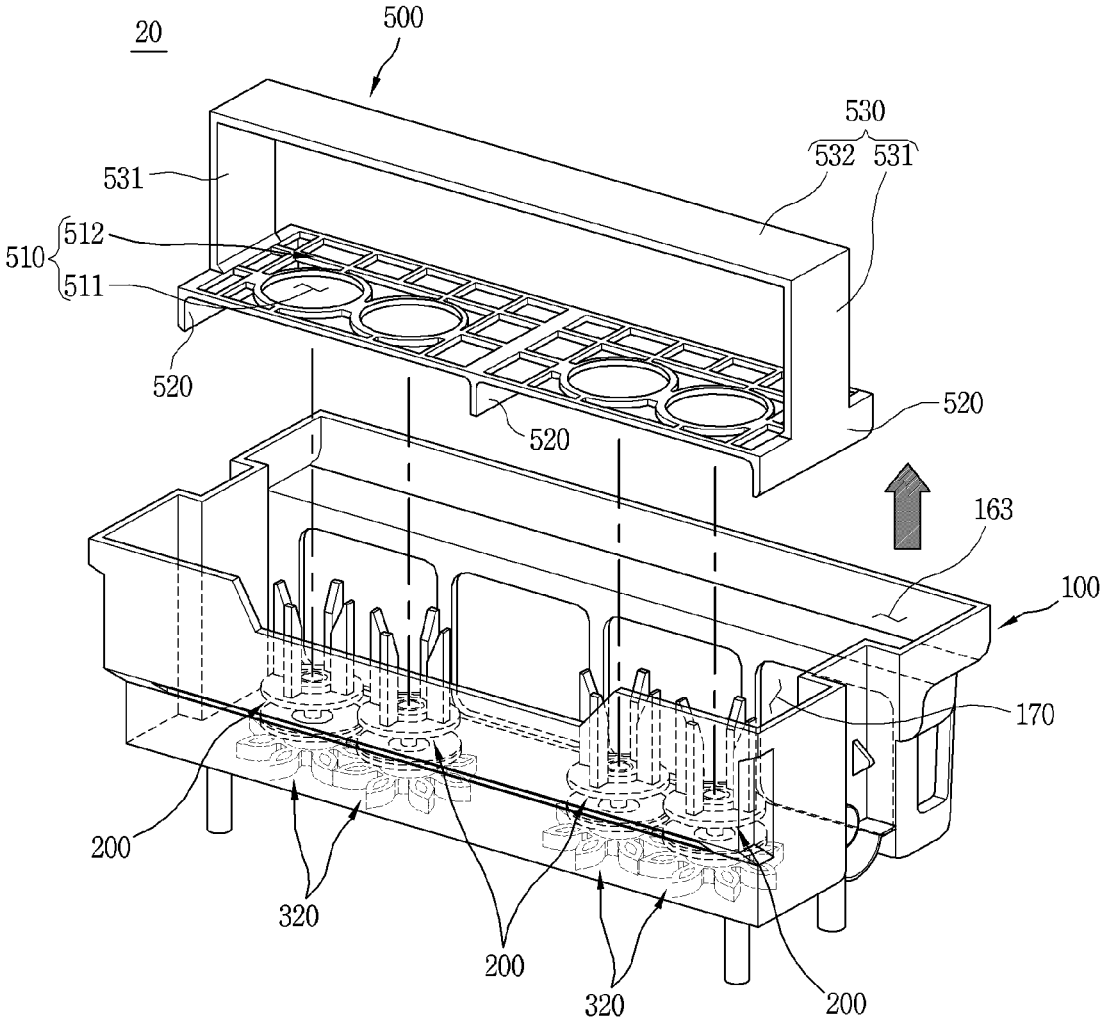

FIG. 30 is a perspective view illustrating a state in which a detachable frame according to another implementation of the present disclosure is detached from the dust storage container of FIG. 25.

Figure 31:
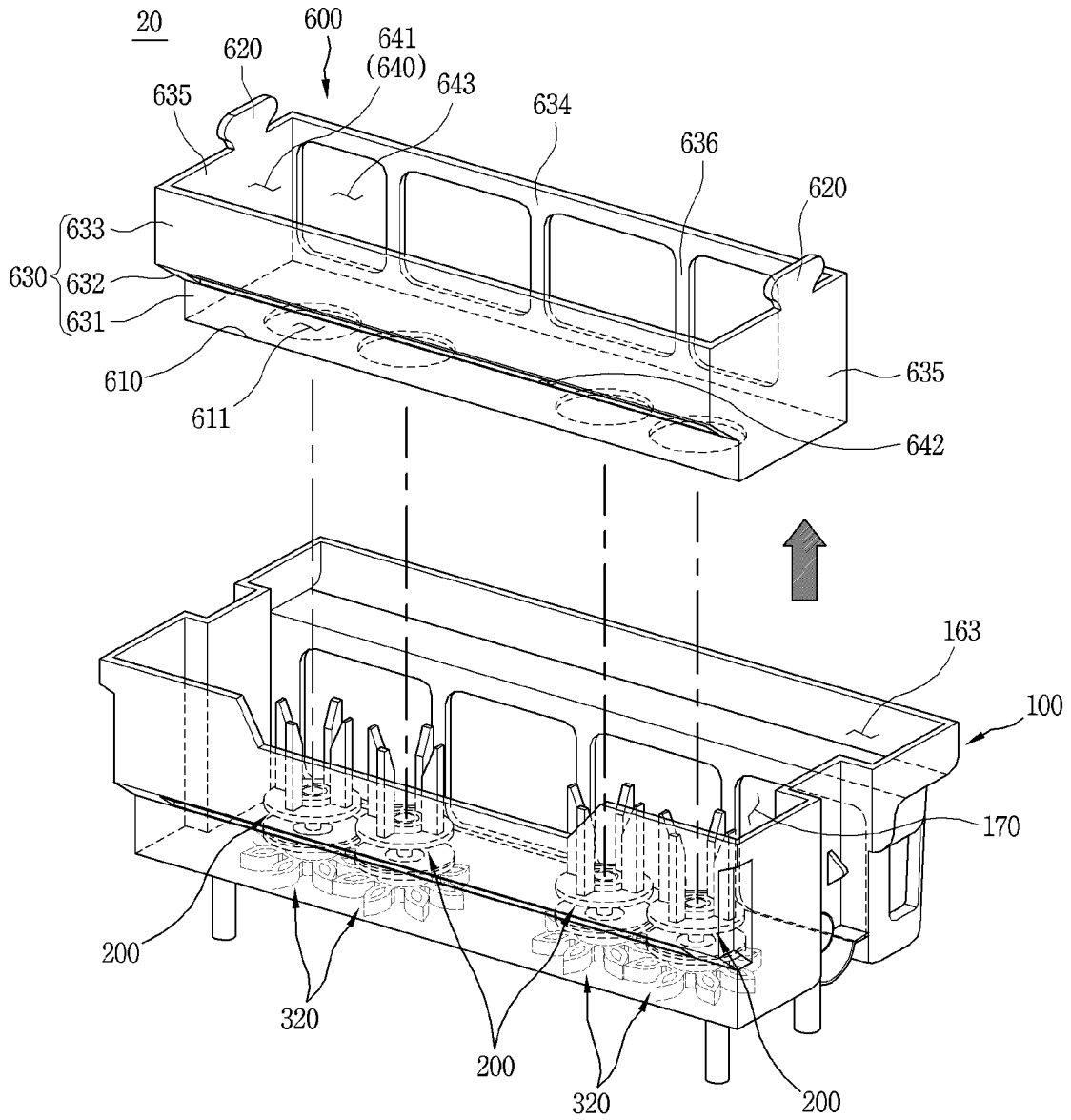

FIG. 31 is a perspective view illustrating a state in which a detachable frame according to still another implementation of the present disclosure is detached from the dust storage container of FIG. 25.

Figure 32:
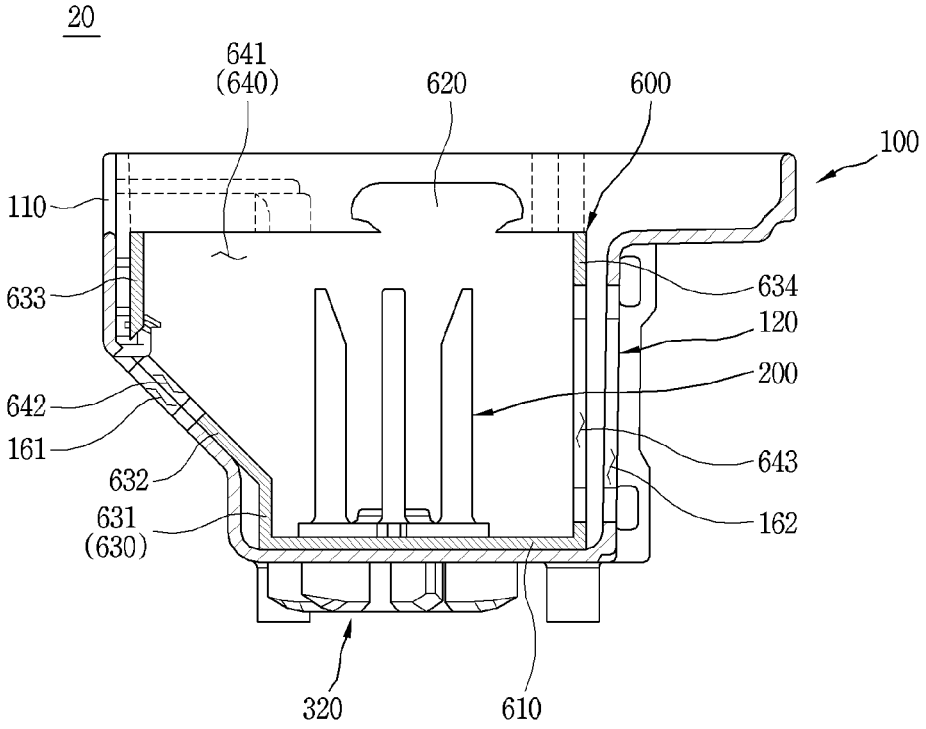

FIG. 32 is a lateral cross-sectional view illustrating the dust storage container to which the detachable frame of FIG. 31 is attached.

Figure 33:
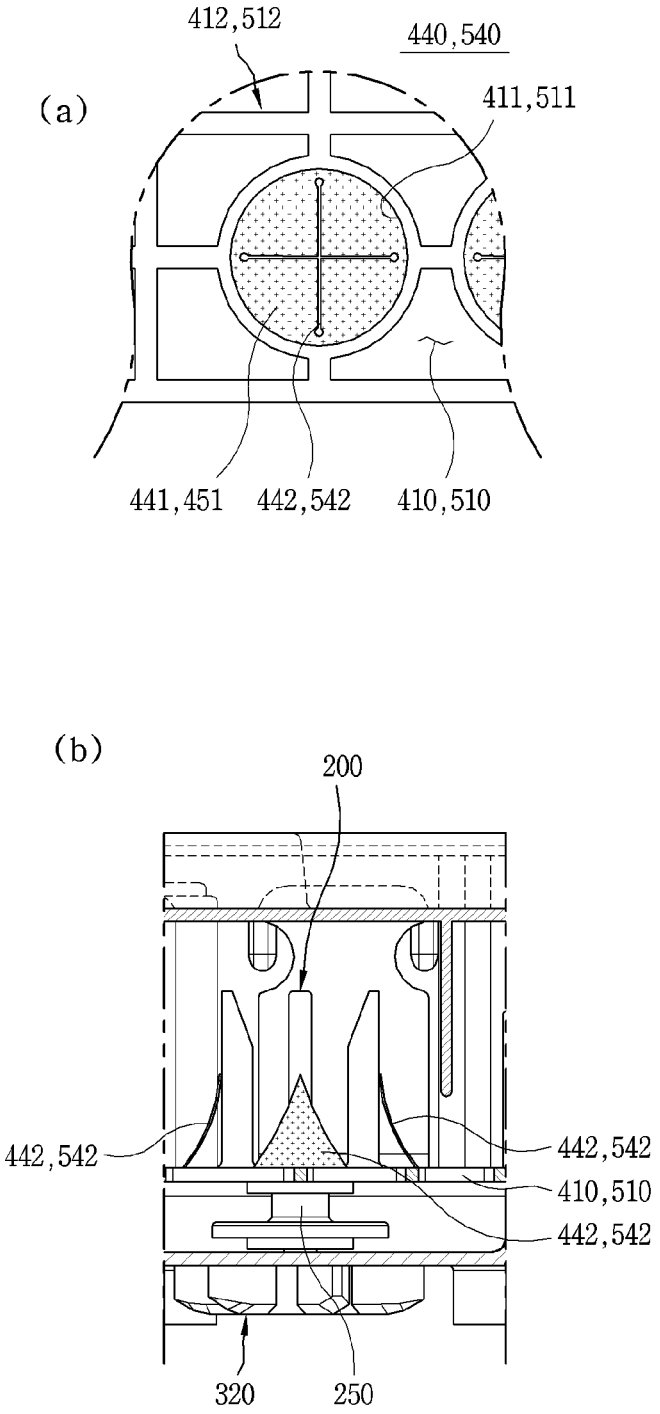

(a) and (b) of FIG. 33 are a planar view and a cross-sectional view, respectively, illustrating a wiper portion provided in the detachable frame according to the implementation of FIGS. 25 and 30.

Figure 34:
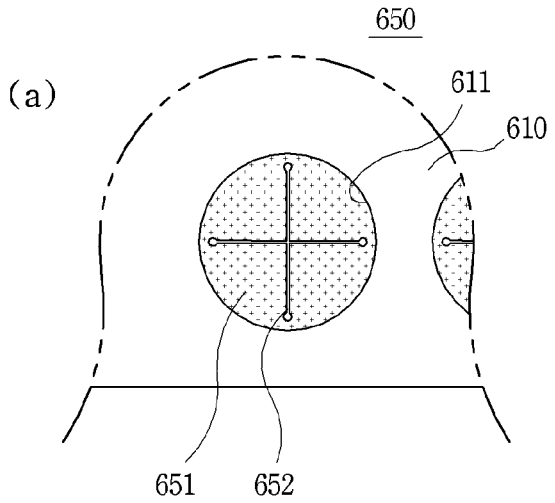
Figure 34:
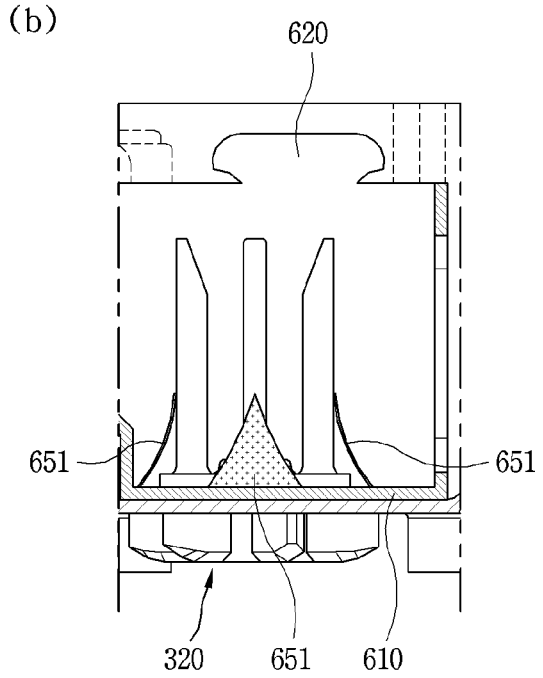

(a) and (b) of FIG. 34 are a planar view and a cross-sectional view, respectively, illustrating a wiper portion provided in the detachable frame according to the implementation of FIG. 31.

Figure 35:
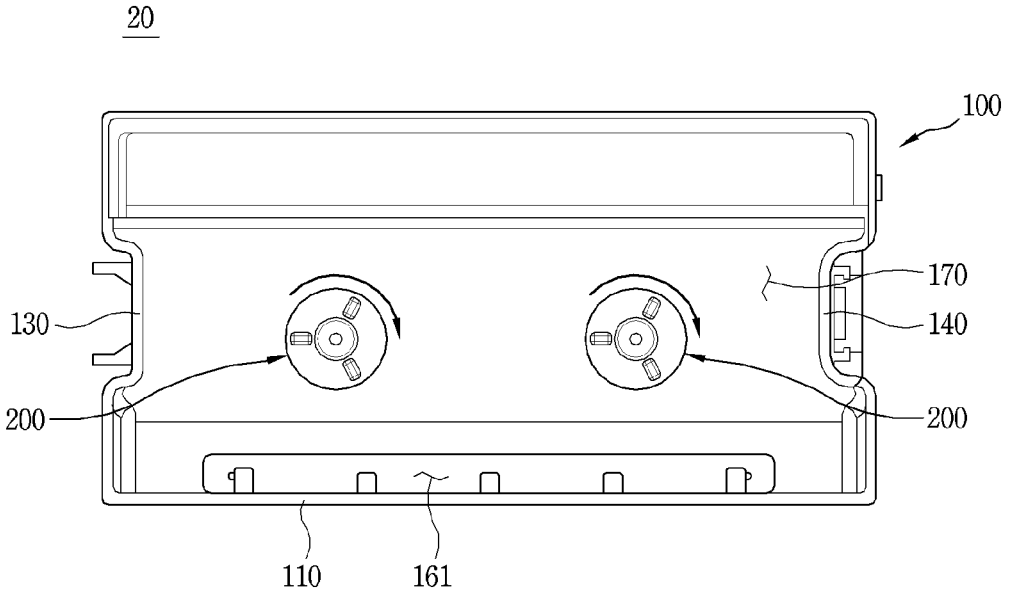

FIG. 35 is a planar view illustrating a state in which the winding members according to the implementation of the present disclosure are rotated inside the dust storage container.

Figure 36:
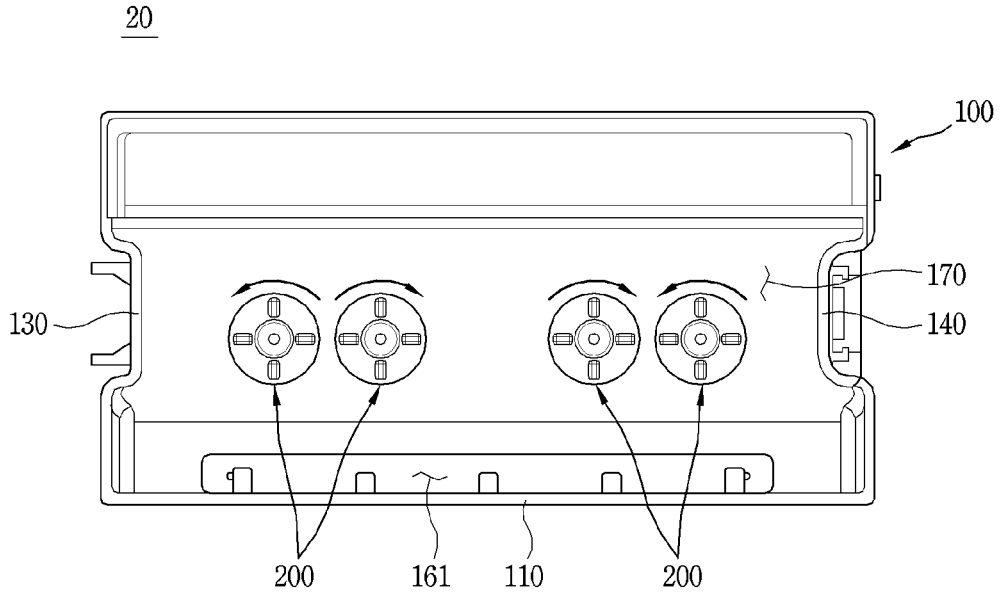

FIG. 36 is a planar view illustrating a state in which the winding members according to the implementation of the present disclosure is rotated inside the dust storage container.

Figure 37:
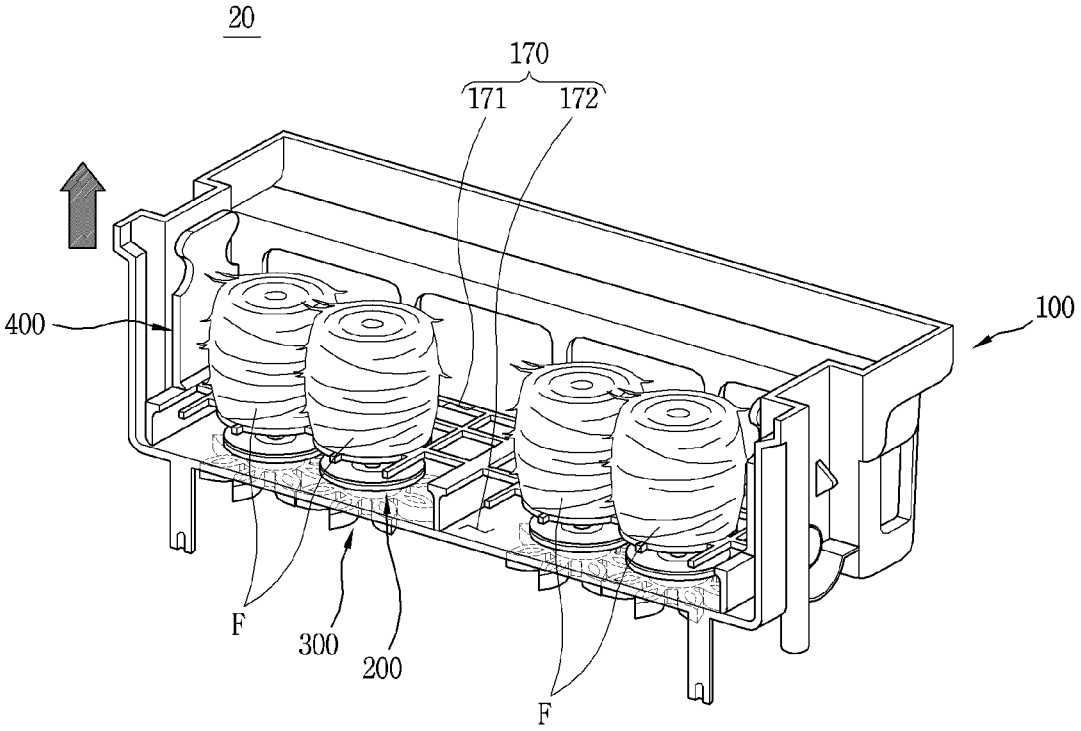

FIG. 37 is a conceptual diagram illustrating a state in which fur is wound around winding members of a dust storage container according to an implementation of the present disclosure.

Figure 38:
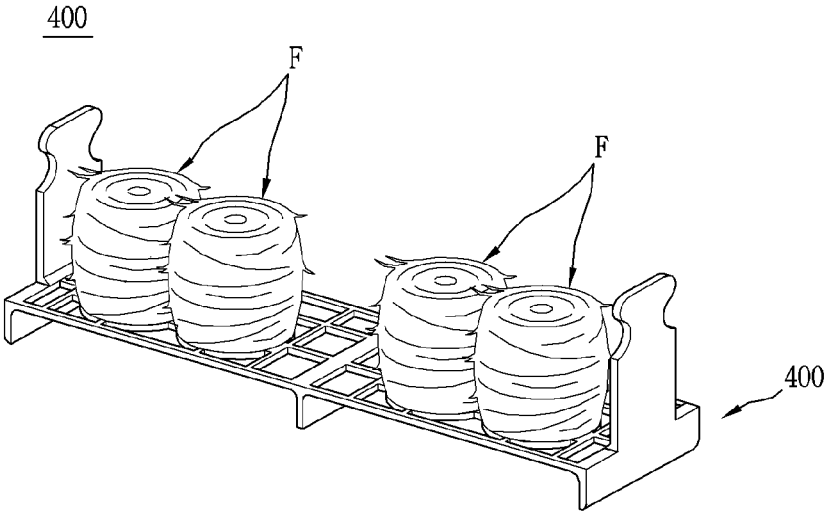

FIG. 38 is a conceptual view illustrating a state in which wound fur is separated from the dust storage container by a detachable frame in accordance with one implementation of the present disclosure.

Figure 39:
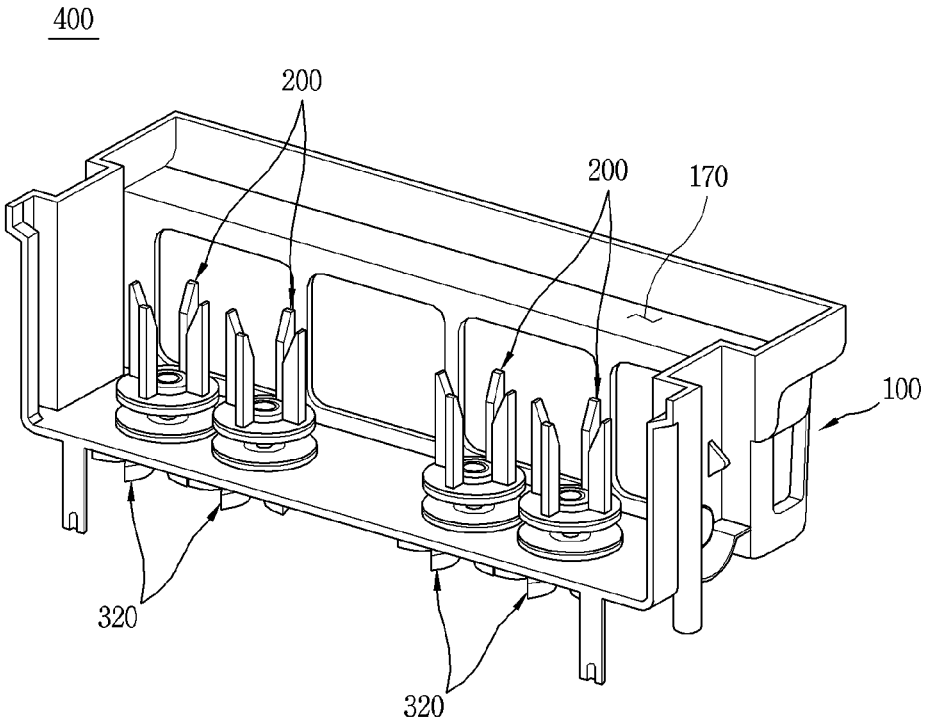

FIG. 39 is a conceptual diagram illustrating a state in which the detachable frame and the wound fur are separated from the dust storage container according to the implementation of the present disclosure.

MODE FOR THE INVENTION

Hereinafter, a dust storage container 20 and a cleaner 1 having the same according to an implementation of the present disclosure will be described in detail with reference to the accompanying drawings.

In the following description, description of some constituent elements will be omitted in order to clarify the features of the present disclosure.

1. Definition of Terms

It will be understood that when an element is referred to as being "connected with" another element, the element can be connected with the another element or intervening elements may also be present.

In contrast, when an element is referred to as being "directly connected with" another element, there are no intervening elements present.

A singular representation may include a plural representation unless it represents a definitely different meaning from the context.

The term "dust" used in the following description refers to fine-sized particles, dust, etc. that exist in an environment, such as an indoor place, in which a cleaner is operated.

The term "small litter" used in the following description refers to garbage in a size that is larger than dust but can be collected by a cleaner.

The term "fur" used in the following description refers to a matter in a shape of a thin thread which falls out from animals including human beings.

The term "fiber" used in the following description refers to an arbitrary material in a shape of a thin thread except for the fur. In one implementation, the fiber may be a material that falls out from clothing, bedding, furniture and miscellaneous goods.

In the following description, fur and fiber will be collectively referred to as "fur (F), and the like".

The term "cleaner" used in the following description refers to an apparatus capable of performing a cleaning operation, in response to a user's manual operation or by self-driving.

The cleaner may include a wired cleaner supplied with power through a wire, a wireless cleaner operated in a wireless manner by a battery, or the like. The cleaner may also include a robot cleaner that performs a cleaning operation in a preset manner during self-driving.

Figure 1:
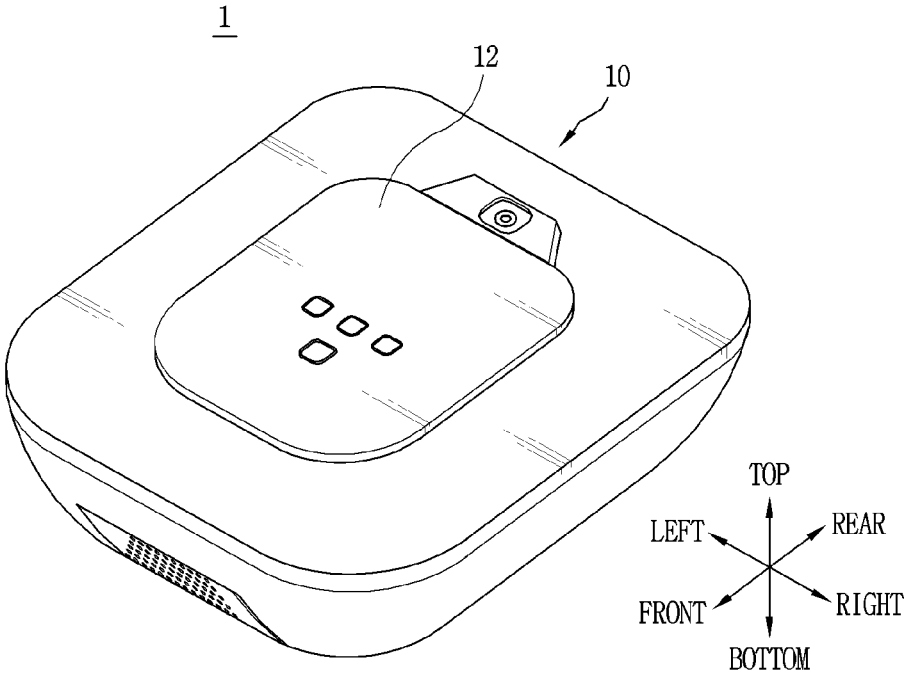
FIG. 1 is a perspective view of a cleaner in accordance with one implementation of the present disclosure.

The terms "front side", "rear side", "left side", "right side", "top or upper side", and "bottom or lower side" used in the following description will be understood with reference to the coordinate system shown in FIGS. 1 and 4.

Figure 2:
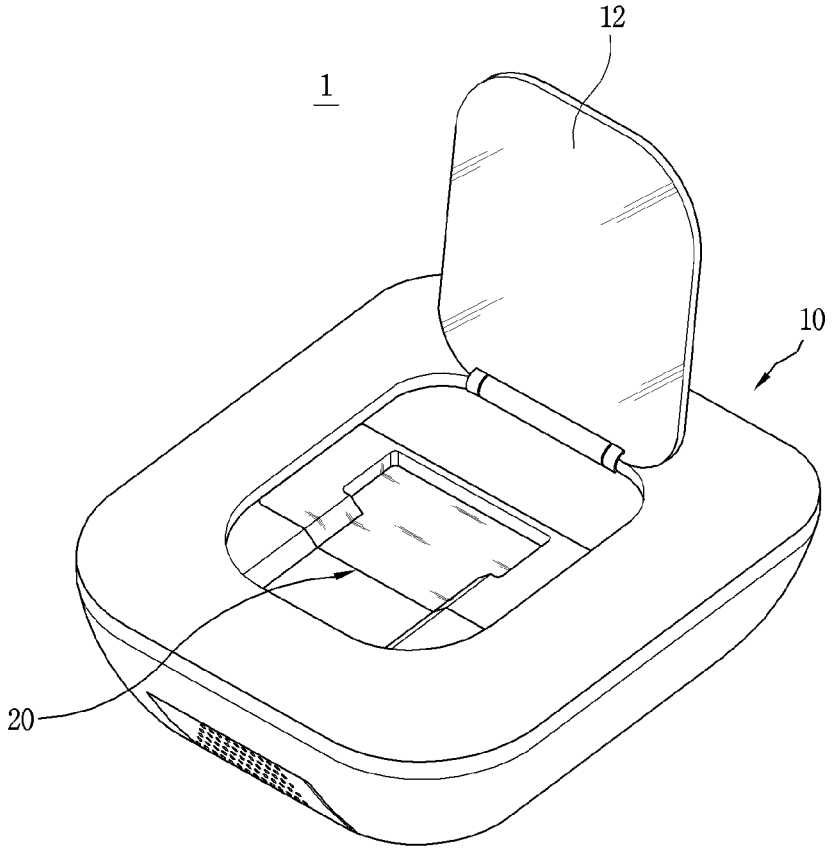
FIG. 2 is a perspective view illustrating an open state of a cover member of the cleaner of FIG. 1.
Figure 3:
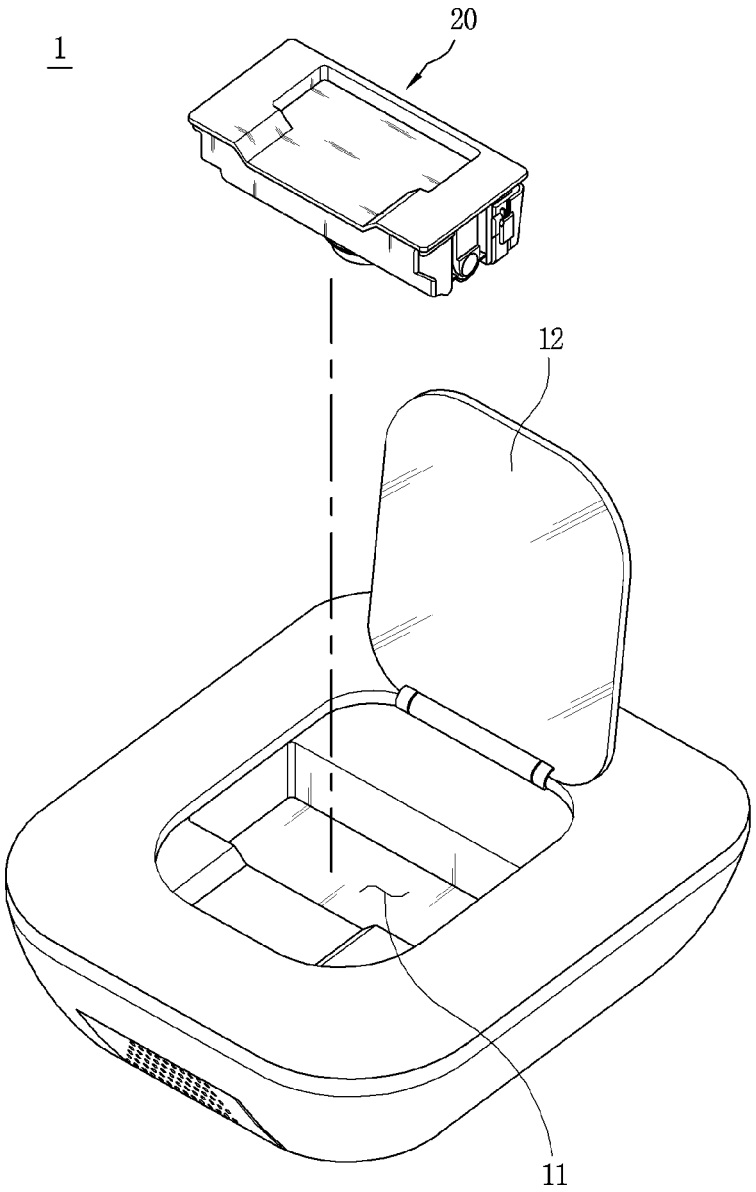
FIG. 3 is a perspective view illustrating a state in which a dust storage container is separated from the cleaner of FIG. 1.

2. Description of Configuration of Cleaner 1 According to One Implementation of the Present Disclosure As illustrated in FIGS. 1 to 3, a cleaner 1 according to one implementation of the present disclosure may include a main body 10 and a dust storage container 20.

(1) Description of Main Body 10

The main body 10 may define appearance of the cleaner 1. The main body 10 may accommodate components for the cleaner 1 to perform a cleaning operation in its inner space. For example, the dust storage container 20 may be detachably accommodated in the main body 10.

The main body 10 may collide with various obstacles located indoors. Therefore, the main body 10 may preferably formed of a material having high rigidity to prevent damage due to the collision.

The main body 10 may preferably be formed of a light material. This is to reduce power required for traveling the cleaner 1.

In one implementation, the main body 10 may be formed of synthetic resin such as reinforced plastic.

User interfaces may be provided on an outer side of the main body 10. The user can control the operation of the cleaner 1 by manipulating the user interfaces. In addition, the user interfaces may display information related to a state of the cleaner 1 and a state of an area in which the cleaner 1 travels.

The inner space of the main body 10 may communicate with the outside. Dust or small litter which is collected while the cleaner 1 travels may be introduced into the dust storage container 20 accommodated in the inner space of the main body 10. In addition, air introduced together with the dust or small litter may be discharged to the outside of the main body 10.

Although not shown, various sensors may be provided in the main body 10. For example, the main body 10 may include a gyro sensor for detecting an inclination of the ground, a camera sensor for identifying whether there is an obstacle in a traveling direction, an infrared sensor, an ultrasonic sensor, and the like.

In the illustrated implementation, the main body 10 may include a container accommodating portion 11 and a cover portion 12.

The container accommodating portion 11 may be a space for accommodating the dust storage container 20. The container accommodating portion 11 may be formed inside the main body 10.

In the illustrated implementation, the container accommodating portion 11 may have a shape of a polygonal column, which has an extension length in left and right directions longer than an extension length in front and rear directions and a predetermined height in up and down directions. The shape of the container accommodating portion 11 may change depending on the shape of the dust storage container 20.

The container accommodating portion 11 may be surrounded by components inside the main body 10. In the illustrated implementation, the container accommodating portion 11 may be surrounded by those components inside the main body 10 at its front, rear, left, right, and bottom sides.

An opening may be formed at an upper side of the container accommodating portion 11. The dust storage container 20 may be accommodated in the container accommodating portion 11 or may be separated from the container accommodating portion 11 through the opening.

The opening formed at the upper side of the container accommodating portion 11 may be covered by the cover portion 12. Accordingly, the container accommodating portion 11 and the dust storage container 20 may not be exposed to the outside.

The cover portion 12 may be rotatably provided on the main body 10 to open or close the container accommodating portion 11. In the illustrated implementation, the cover portion 12 may be rotatably coupled to the upper side of the main body 10. In one implementation, the cover portion 12 may be fitted to the upper side of the main body 10 by a hinge.

The cover portion 12 may be formed to be larger than the container accommodating portion 11. Specifically, each length in a horizontal direction of the cover portion 12, namely, in front, rear, left and right directions of the cover portion 12 may be longer than each length in a horizontal direction of the container accommodating portion 11, namely, in front, rear, left, and right directions of the container accommodating portion 11.

Accordingly, the dust storage container 20 may be easily attached into or detached from the container accommodating portion 11.

In the illustrated implementation, the cover portion 12 may have a rectangular plate shape in which each vertex is rounded. The cover portion 12 may be provided in any shape capable of closing or opening the container accommodating portion 11.

(2) Description of Dust Storage Container 20

Referring further to FIG. 4, the cleaner 1 according to the implementation of the present disclosure may include a dust storage container 20.

The dust storage container 20 may accommodate dust or small litter while the cleaner 1 travels. The dust storage container 20 may communicate with the outside of the cleaner 1, specifically, the ground in a region in which the cleaner 1 is traveling. The dust or small litter which is collected while a brush member (not shown) is turned may be stored in an inner space of the dust storage container 20.

The dust storage container 20 may be detachably accommodated in a space formed inside the main body 10. Specifically, the dust storage container 20 may be retractably accommodated in the container accommodating portion 11 formed in the main body 10.

The dust or small litter collected while the main body 10 travels may be stored in the dust storage container 20. The user may detach the dust storage container 20 from the main body 10 to discharge the dust or small litter stored in the dust storage container 20.

The dust storage container 20 may preferably be formed of a lightweight material. This is to reduce a total weight of the cleaner 1 in which the dust storage container 20 is provided.

The dust storage container 20 may preferably be formed of a material having high rigidity. This is to prevent the dust storage container 20 from being damaged during introduction and discharge of the dust or small litter.

In one implementation, the dust storage container 20 may be formed of a synthetic resin material such as reinforced plastic.

The inner space of the dust storage container 20 may communicate with the outside. The collected dust or small litter may be introduced into the inner space of the dust storage container 20. In addition, air introduced into the inner space of the dust storage container 20 together with the dust or small litter may be discharged to the outside again.

In the implementation illustrated in FIG. 4, the dust storage container 20 may include a housing 100, a winding member 200, and a gear unit 300.

In addition, in the implementation illustrated in FIGS. 25 to 34, the dust storage container 20 may further include a detachable frame 400, 500, 600.

Hereinafter, the configuration of the dust storage container 20 according to the implementation of the present disclosure will be described with reference to the accompanying drawings, but the winding member 200, the gear unit 300, and the detachable frame 400, 500, 600 will be described in separate clauses.

The housing 100 may define appearance of the dust storage container 20. The housing 100 may be a portion where the dust storage container 20 is exposed to the outside.

The housing 100 may have an inner space. Collected dust or small litter may be accommodated in the space.

The inner space of the housing 100 may communicate with the outside. The external dust or small litter may be introduced into the inner space of the dust storage container 100. Air introduced together with the external dust or small litter may be discharged to the outside of the housing 100.

In the illustrated implementation, the housing 100 may have a shape of a polygonal column, which has a length in the left and right direction longer than a length in the front and rear direction and a predetermined height in the up and down direction. The housing 100 may be formed to correspond to the shape of the container accommodating portion 11.

In the illustrated implementation, the housing 100 may include a first wall 110, a second wall 120, a third wall 130, a fourth wall 140, a fifth wall 150, an opening 160, a collection space 170, and a cover 180.

The first wall 110 may form one side wall of the housing 100. In the illustrated implementation, the first wall 110 may form a front wall of the housing 100.

The first wall 110 may extend in one direction and another direction. In the illustrated implementation, the first wall 110 may extend in the left and right directions.

The first wall 110 may be disposed to face the second wall 120. Specifically, the first wall 110 may be disposed to face the second wall 120 with the collection space 170 interposed therebetween.

Both end portions of the first wall 110 in the directions that the first wall 110 extends, namely, left and right end portions in the illustrated implementation may be connected to the third wall 130 and the fourth wall 140, respectively.

Another end portion of the first wall 110 facing the main body 10, namely, a lower end portion in the illustrated implementation may be connected to the fifth wall 150.

A suction portion 161 of the opening 160 may be formed through the first wall 110. Dust or small litter collected while the cleaner 1 travels may be introduced into the inner space of the housing 100 through the suction portion 161.

The second wall 120 may form an inner wall of another side of the housing 100. In the illustrated implementation, the second wall 120 may form a rear inner wall of the housing 100.

The second wall 120 may extend in one direction and another direction. In the illustrated implementation, the second wall 120 may extend in the left and right directions.

The second wall 120 may disposed to face the first wall 110. Specifically, the second wall 120 may be disposed to face the first wall 110 with the collection space 170 interposed therebetween.

Both end portions of the second wall 120 in the directions that the second wall 120 extends, namely, left and right end portions in the illustrated implementation may be connected to the third wall 130 and the fourth wall 140, respectively.

That is, it can be said that the third wall 130 and the fourth wall 140 extend between each end of the first wall 110 and each end of the second wall 120, respectively.

Another end portion of the second wall 120 facing the main body 10, namely, a lower end portion in the illustrated implementation may be connected to the fifth wall 150.

An exhaust portion 162 of the opening 160 may be formed through the second wall 120. Air introduced into the inner space of the housing 100 together with dust or small litter may be exhausted to the outside of the housing 100 through the exhaust portion 162.

A filter accommodating portion (not shown) in which a filter 162*a* is accommodated may be provided in one side of the second wall 120 opposite to the first wall 110, namely, in a rear side of the second wall 120 in the illustrated implementation. The filter accommodating portion (not shown) may be defined as a space in the rear side of the second wall 120 to accommodate the filter 162*a*. The filter 162*a* accommodated in the filter accommodating portion (not shown) may be partially exposed toward the collection space 170.

The second wall 120 may include reinforcing ribs 121.

The reinforcing ribs 121 may extend in directions different from the directions in which the second wall 120 extends, namely, in the up and down directions in the illustrated implementation. The reinforcing ribs 121 may divide the exhaust portion 162 into a plurality of portions. That is, the reinforcing ribs 121 may divide a single opening formed through the second wall 120 into the plurality of exhaust portions 162.

The reinforcing ribs 121 may be located between the exhaust portions 162 adjacent to each other, respectively. In the illustrated implementation, three reinforcing ribs 121 may be provided to be located between the exhaust portions 162 adjacent to each other. The number of the reinforcing ribs 121 and the number of the exhaust portions 162 may vary.

Even if the exhaust portions 162 extend in the extending directions of the second wall 120 (i.e., in the left and right directions in the illustrated implementation), the rigidity of the second wall 120 can be reinforced by the reinforcing ribs 121.

The third wall 130 may form another side wall of the housing 100. In the illustrated implementation, the third wall 130 may form a left wall of the housing 100.

The third wall 130 may extend in another direction and still another direction. In the illustrated implementation, the third wall 130 may extend in the front and rear directions.

The third wall 130 may be disposed to face the fourth wall 140. Specifically, the third wall 130 may be disposed to face the fourth wall 140 with the collection space 170 interposed therebetween.

Both end portions of the third wall 130 in the directions that the third wall 130 extends, namely, front and rear end portions in the illustrated implementation may be connected to the first wall 110 and the second wall 120, respectively.

Another end portion of the third wall 130 facing the main body 10, namely, a lower end portion in the illustrated implementation may be connected to the fifth wall 150.

The fourth wall 140 may form still another side wall of the housing 100. In the illustrated implementation, the fourth wall 140 may form a right wall of the housing 100.

The fourth wall 140 may extend in another direction and still another direction. In the illustrated implementation, the fourth wall 140 may extend in the front and rear directions.

The fourth wall 140 may be disposed to face the third wall 130. Specifically, the fourth wall 140 may be disposed to face the third wall 130 with the collection space 170 interposed therebetween.

Both end portions of the fourth wall 140 in the directions that the fourth wall 120 extends, namely, front and rear end portions in the illustrated implementation may be connected to the first wall 110 and the second wall 120, respectively.

That is, it can be said that the first wall 110 and the second wall 120 extend between each end of the third wall 130 and each end of the fourth wall 140.

The cover 180 may be detachably coupled to each end portion of the first to fourth walls 110, 120, 130, and 140 opposite to the main body 10, namely, to each upper end portion in the illustrated implementation.

In addition, the first to fourth walls 110, 120, 130, and 140 may surround the collection space 170, which is the inner space of the housing 100, at the front side, the rear side, the left side, and the right side, respectively.

The fifth wall 150 may form still another side surface of the housing 100 facing the main body 10. In the illustrated implementation, the fifth wall 150 may form a bottom surface of the housing 100.

The fifth wall 150 may be connected to the first to fourth walls 110, 120, 130, and 140. Specifically, the fifth wall 150 may be connected to end portions of the first to fourth walls 110, 120, 130, and 140 facing the main body 10, namely, lower end portions in the illustrated implementation, respectively.

The fifth wall 150 may surround the collection space 170, which is the inner space of the housing 100, at the lower side. In other words, the fifth wall 150 may be disposed to face a discharge portion 163 with the collection space 170 interposed therebetween.

A winding member 200 may be coupled to the fifth wall 150. Specifically, the winding member 200 may be rotatably coupled to an upper surface of the fifth wall 150.

The gear unit 300 may be coupled to the fifth wall 150. Specifically, a transfer gear 310 and a rotation gear 320 may be rotatably coupled to the lower surface of the fifth wall 150. The coupling may be achieved by coupling a shaft member 340 of the gear unit 300 to the fifth wall 150.

In one implementation, a motor 330 may be coupled to the lower surface of the fifth wall 150. Support members 331 for supporting the motor 330 may be fixedly coupled to the lower surface of the fifth wall 150.

The fifth wall 150 may include a through hole 151.

The through hole 151 may be formed through the fifth wall 150 in directions toward and away from the main body 10, namely, in the up and down directions in the illustrated implementation. The shaft member 340 of the gear unit 300 may be coupled through the through hole 151.

The through hole 151 may be provided in plurality. The plurality of through holes 151 may be disposed to be spaced apart from one another in the extending directions of the fifth wall 150, namely, in the left and right directions in the illustrated implementation. The shaft members 340 for rotatably supporting the winding members 200 may be coupled through the through holes 151, respectively.

In the implementation illustrated in FIG. 4, two through holes 151 may be formed and spaced apart from each other in the left and right directions. In addition, in the implementation illustrated in FIG. 13, three through holes 151 may be formed and spaced apart from one another in the left and right directions. Furthermore, in the implementation illustrated in FIG. 14, four through holes 151 may be formed and spaced apart from one another in the left and right directions.

That is, the location and number of the through holes 151 may vary depending on the number of the winding members 200 to be described later and the size and arrangement method of each winding member 200.

Figure 6:
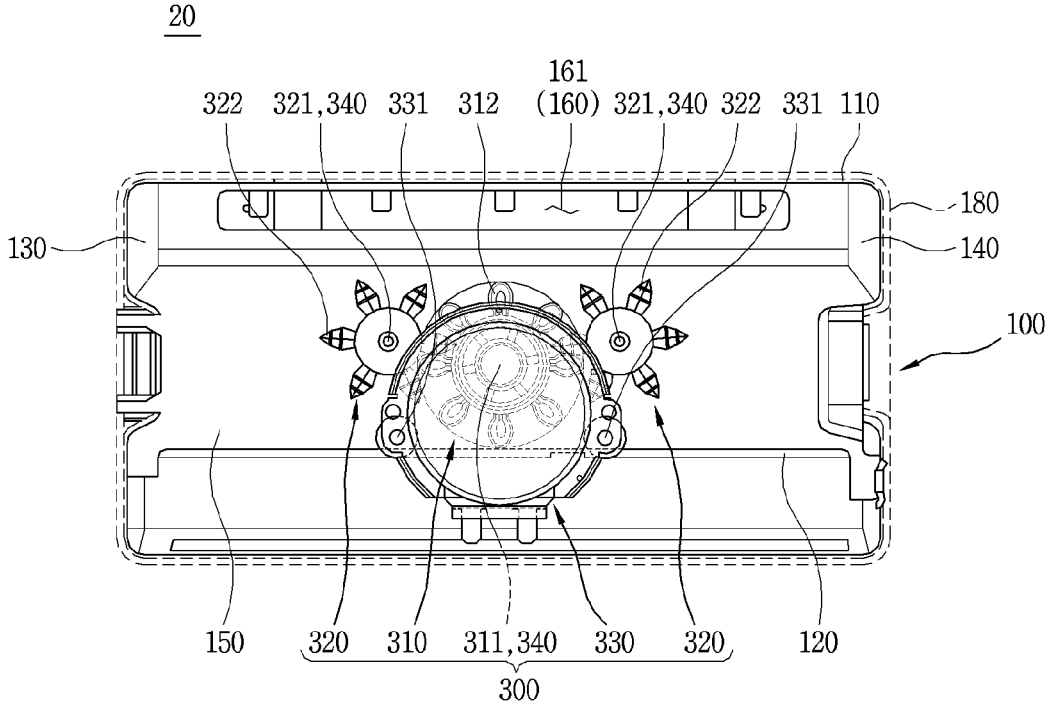
FIG. 6 is a rear view of the dust storage container of FIG. 4.
Figure 7:
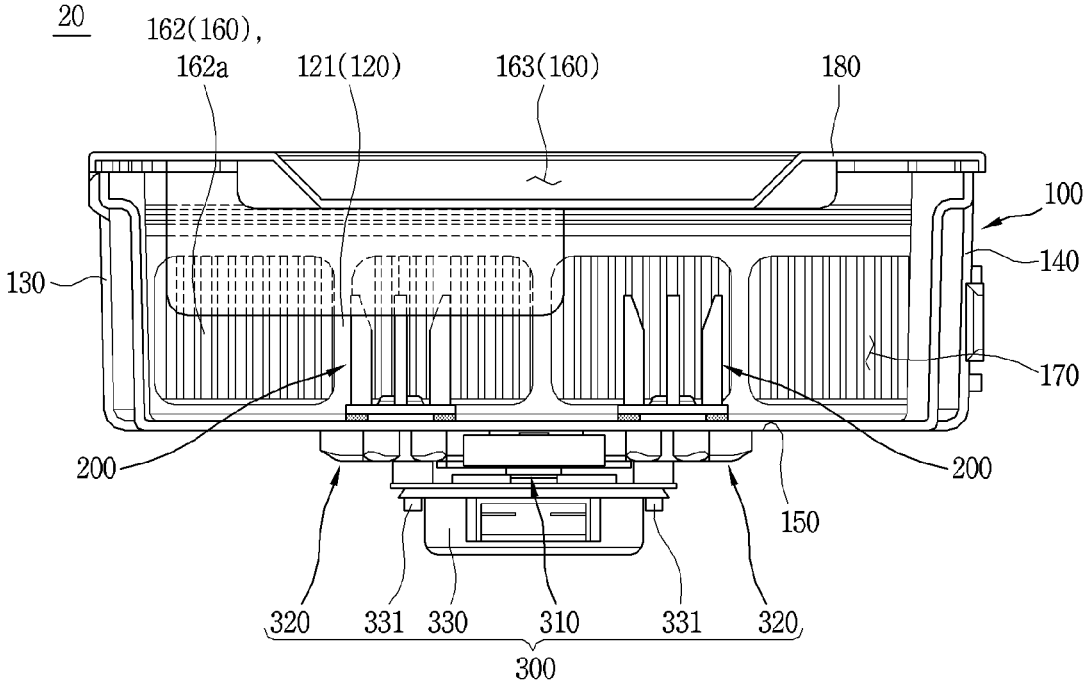
FIG. 7 is a front cross-sectional view of the dust storage container of FIG. 4.
Figure 8:
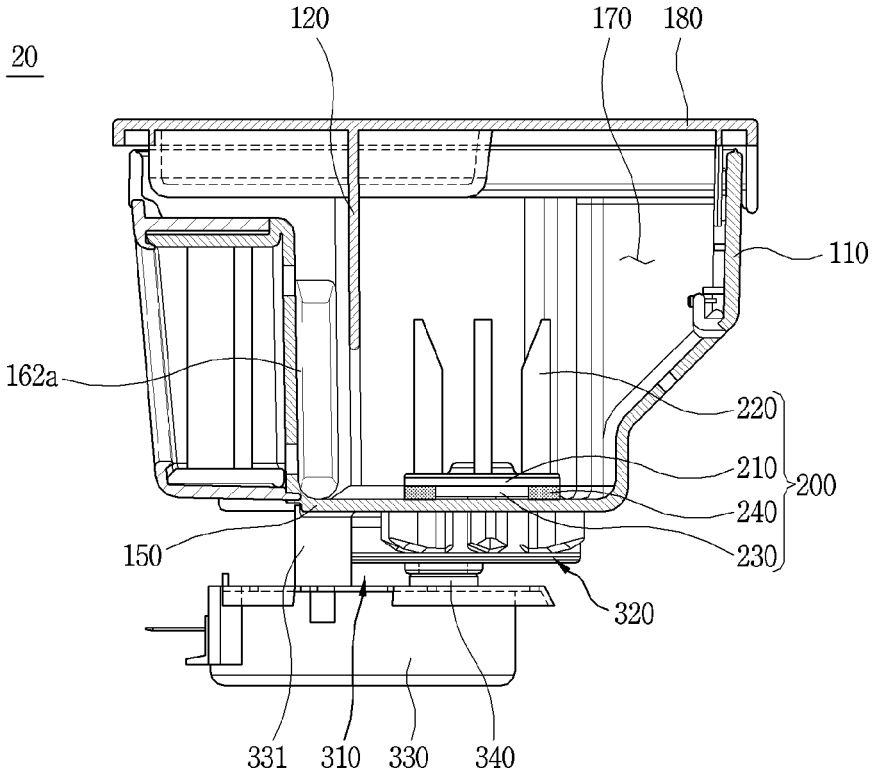
FIG. 8 is a lateral cross-sectional view of the dust storage container of FIG. 4.
Figure 9:
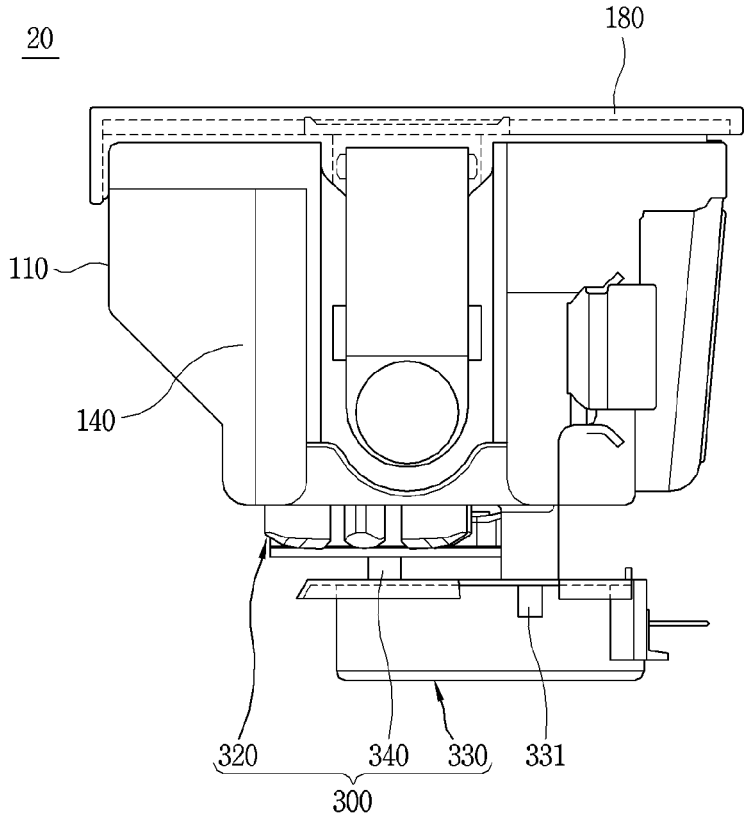
FIG. 9 is a lateral view of the dust storage container of FIG. 4.

A shaft support portion may be recessed between the through holes 151 (see FIG. 6). That is, in one implementation, the gear unit 300 may include a transfer gear 310 directly connected to the motor 330 to receive rotation of the motor 330, and a rotation gear 320 coupled to the transfer gear 310 to receive rotation of the transfer gear 310.

The shaft member 340 rotatably supporting the transfer gear 310 may be rotatably inserted into the shaft support portion.

The collection space 170 formed inside the housing 100 and the outside may communicate with each other through the opening 160. The opening 160 may be formed through each of the walls 110, 120, 130, and 140 of the housing 100, or may directly communicate with the collection space 170.

In the illustrated implementation, the opening 160 may include a suction portion 161, an exhaust portion 162 and a discharge portion 163.

The suction portion 161 may be a passage through which dust or small litter outside the cleaner 1 is introduced. The suction portion 161 may allow the collection space 170 to communicate with the outside of the cleaner 1.

Dust or small litter existing in a region in which the cleaner 1 travels may be introduced into the main body 10 by a brush member (not shown) or the like. The introduced dust or small litter may be introduced into the collection space 170 through the suction portion 161.

To this end, the cleaner 1 may separately be provided with a fan member (not shown) and a motor member (not shown) for operating the fan member (not shown). The fan member (not shown) may generate a transfer (transmission, conveying) force for transferring dust or small litter to the inside of the cleaner 1 and to the collection space 170.

The suction portion 161 may be formed through any one of the walls 110, 120, 130, and 140 surrounding the collection space 170.

The suction portion 161 may be formed in a shape in which its cross-sectional area can increase. That is, the suction portion 161 may preferably be formed to correspond to the shape of the one wall, through which the suction portion 161 is formed.

In the illustrated implementation, the suction portion 161 may be formed through the first wall 110 located at the front side. In addition, the suction portion 161 may be formed to extend long in the directions in which the first wall 110 extends, that is, in the left and right directions, and may be formed to have a predetermined height in the up and down directions.

The exhaust portion 162 may be a passage through which air introduced into the cleaner 1 flows out of the cleaner 1. The exhaust portion 162 may allow the collection space 170 to communicate with the outside of the cleaner 1.

When dust or small litter is introduced into the collection space 170, external air may also flow into the collection space 170. In this case, when an excessive amount of air remains in the collection space 170, it may be difficult for the dust or small litter to be smoothly introduced into the collection space 170.

Accordingly, the exhaust portion 162 may allow the collection space 170 to communicate with the outside of the cleaner 1, so as to function as a passage through which the introduced air is discharged again.

At this time, the air may contain fine dust or the like. Accordingly, the filter **162*a* may be installed in the exhaust portion 162. The filter 162*a* may be coupled through the exhaust portion 162 to filter dust or the like existing in air passing through the exhaust portion 162**.

The exhaust portion 162 may be formed through another one of the walls 110, 120, 130, and 140 surrounding the collection space 170.

The exhaust portion 162 may be formed in a shape in which its cross-sectional area can increase. That is, the exhaust portion 162 may preferably be formed to correspond to the shape of the another wall, through which the exhaust portion 162 is formed.

In the illustrated implementation, the exhaust portion 162 may be formed through the first wall 120 located at the rear side. In addition, the exhaust portion 162 may be formed to extend long in the directions in which the second wall 120 extends, that is, in the left and right directions, and may be formed to have a predetermined height in the up and down directions.

The exhaust hole 162 may be provided in plurality. In the illustrated implementation, a total of four exhaust portions 162 may be provided to be spaced apart from one another in the extending directions, that is, in the left and right directions. The reinforcing ribs 121 may be located between the plurality of exhaust portions 162 adjacent to each other.

Accordingly, it may be said that the exhaust portion 162 is divided into a plurality of regions by the reinforcing ribs 121.

The filter 162*a* may be located in each of the plurality of exhaust portions 162. Air introduced into the collection space 170 may pass through the exhaust portions 162 and the filters 162*a* provided in the exhaust portions 162, and then be discharged to the outside of the cleaner 1 through filter accommodating portions (not shown).

Accordingly, air discharged from the collection space 170 to the outside of the cleaner 1 may be discharged by being filtered even if it passes through any exhaust portion 162 among the plurality of exhaust portions 162.

The discharge portion 163 may be a passage through which dust or small litter collected in the collection space 170 is discharged to the outside of the collection space 170. The discharge portion 163 may allow the collection space 170 to communicate with the outside of the cleaner 1.

The discharge portion 163 may be formed at a portion where the collection space 170 communicates with the outside. In the illustrated implementation, the discharge portion 163 may be formed on one side of the collection space 170 opposite to the fifth wall 150, that is, on an upper side of the collection space 170. In other words, the discharge portion 163 may be disposed to face the fifth wall 150 with the collection space 170 interposed therebetween.

The discharge portion 163 may be opened or closed by the cover 180. Specifically, the cover 180 may be detachably coupled to the upper end portions of the respective walls 110, 120, 130, and 140. In this case, the cover 180 may be coupled to the upper end portions of the respective walls 110, 120, 130, and 140 while covering the discharge portion 163.

When the collection space 170 does not need to be opened, the discharge portion 163 may be closed by the cover 180. This may prevent the communication between the collection space 170 and the outside of the cleaner 1 through the discharge portion 163, so that collected dust or small litter cannot be arbitrarily discharged.

When the collection space 170 is to be opened, for example, when an excessive amount of dust or small litter is collected in the collection space 170, the discharge portion 163 may be opened by detaching the cover 180. Accordingly, the collected dust or small litter can be discharged out of the collection space 170.

The discharge portion 163 may be formed in a shape corresponding to the collection space 170. This is because the discharge portion 163 is defined by the upper end portions of the walls 110, 120, 130, and 140 surrounding the collection space 170. In the illustrated implementation, the discharge portion 163 may have a rectangular cross section that an extension length in the left and right directions is longer than an extension length in the front and rear directions.

The shape of the discharge portion 163 may change depending on an arrangement method of each of the walls 110, 120, 130, and 140 and the shape of the collection space 170.

The collection space 170 may be a space in which dust or small litter collected while the cleaner 1 travels is collected. The dust or small litter collected by the brush member (not shown) may be introduced into the collection space 170 through the suction portion 161.

The collection space 170 may be defined as a space surrounded by the respective walls 110, 120, 130, and 140 and the fifth wall 150. That is, the respective walls 110, 120, 130, and 140 may surround the collection space 170 at the front side, rear side, and left and right sides of the collection space 170. In addition, the fifth wall 150 may surround the collection space 170 at the lower side of the collection space 170.

In the illustrated implementation, the collection space 170 may be formed in a shape that has an extension length in the left and right directions longer than an extension length in the front and rear directions and also has a predetermined height. The shape of the collection space 170 may change depending on the shape and arrangement method of each of the walls 110, 120, 130, and 140 and the fifth wall 150.

As will be described later, the winding members 200 may be rotatably provided inside the collection space 170. In the cleaner 1 according to the implementation of the present disclosure, the winding members 200 can be operated to effectively collect small litter, especially, fur F and the like accommodated in the collection space 170. This will be described in detail later.

The collection space 170 may communicate with the outside.

Specifically, the collection space 170 may communicate with the outside of the cleaner 1 through the suction portion 161. External dust or small litter may be introduced into the collection space 170 through the suction portion 161.

The collection space 170 may communicate with the outside of the cleaner 1 through the exhaust portion 162. Air introduced into the collection space 170 together with the dust or litter may be discharged to the outside of the cleaner 1 through the exhaust portion 162.

The collection space 170 may communicate with the outside of the cleaner 1 through the discharge portion 163. The dust or small litter collected in the collection space 170 may be discharged to the outside of the cleaner 1 through the discharge portion 163.

The collection space 170 may be opened or closed. This process may be accomplished by the cover 180 that is detachably coupled to each of the walls 110, 120, 130, and 140.

The cover 180 may open or close the collection space 170 and the discharge portion 163 communicating with the collection space 170. The cover 180 may be detachably coupled to each of the walls 110, 120, 130, and 140.

When maintenance or washing of the dust storage container 20 or removal of dust or small litter collected in the collection space 170 is required, the cover 180 may be detached from each wall 110, 120, 130, and 140. Accordingly, the collection space 170 and the discharge portion 163 may be opened so that the collected dust or small litter can be discharged from the collection space 170.

When the cleaner 1 is in operation or when maintenance or the like is not required, the cover 180 may be coupled to each of the walls 110, 120, 130, and 140. Accordingly, the collection space 170 and the discharge portion 163 may be closed, so that the collected dust or small litter cannot be randomly discharged from the collection space 170.

Further referring to FIGS. 26 and 27, the collection space 170 may be divided into a plurality of spaces. That is, in the implementation in which the detachable frame 400, 500 is provided, the collection space 170 may be divided into a first collection space 171 located at an upper side and a second collection space 172 located at a lower side, by a coupling plate 410, 510.

In the implementation, relatively light dust or litter (garbage, trash) among the introduced dust or litter may be collected in the first collection space 171. The dust or litter collected in the first collection space 171 may be discharged together with small litter in the form of fur F wound around the winding member 200, in response to detachment of the detachable frame 400, 500.

In addition, relatively heavy dust or litter (or garbage) among the introduced dust or litter (or garbage) may be collected in the second collection space 172. The dust or litter collected in the second collection space 172 may be discharged when the user detaches the dust storage container 20 from the main body 10.

The first collection space 171 and the second collection space 172 may communicate with each other. The communication may be achieved by openings formed through a grid 412, 512 provided in the detachable frame 400, 500.

The cover 180 may be formed in a shape corresponding to the shape of the collection space 170 and the discharge portion 163. In the illustrated implementation, the cover 180 may have a rectangular plate shape which has a length in the left and right directions longer than that in the front and rear directions and also has a predetermined thickness.

The cover 180 may be detachably coupled to each of the walls 110, 120, 130, and 140. Specifically, the cover 180 may be detachably coupled to the upper end portions of the walls 110, 120, 130, and 140, respectively. To this end, a length of each side of the cover 180 may be formed to be longer than a length by which each of the walls 110, 120, 130, and 140 extends.

The cover 180 may be made of a transparent material. This is to enable the user to easily recognize an amount of dust or small litter collected in the collection space 170 without detaching the cover 180.

3. Description of Winding Member 200 According to Implementation of the Present Disclosure As illustrated in FIGS. 4 to 23, the dust storage container 20 according to the implementation of the present disclosure may include a winding member 200.

The winding member 200 may be provided such that a small litter in the form of fur F existing in a region where the cleaner 1 travels is wound around it. Accordingly, a space occupied by the small litter such as the fur F in the collection space 170 can be reduced, compared to a case where the small litter like the fur F is randomly accommodated in the collection space 170.

In addition, as the small litter such as the fur F is wound around the winding member 200, entanglement or interference of the small litter such as the fur F can be minimized. Furthermore, the collected small litter in the form of fur F can be easily discharged out of the collection space 170.

That is, the winding member 200 may function as a bobbin.

The winding member 200 may be rotatably accommodated in the collection space 170, which is the inner space of the housing 100. The winding member 200 may be rotated inside the collection space 170 by the gear unit 300.

Specifically, when the motor 330 of the gear unit 300 is rotated, the transfer gear 310 directly connected to the motor 330 and the rotation gear 320 which is gear-coupled (engaged) with the transfer gear 310 may be rotated. At this time, the winding member 200 which is coupled to the rotation gear 320 by a shaft may be rotated together with the rotation gear 320.

A direction in which the winding member 200 is rotated may be configured in various ways. For example, the winding member 200 may be continuously rotated in any one of a clockwise direction and a counterclockwise direction.

As another example, the rotating direction of the winding member 200 may change depending on a preset method. For example, the winding member 200 may be rotated by a predetermined angle in one of a clockwise direction and a counterclockwise direction and then rotated in another direction of the clockwise direction and the counterclockwise direction, in an alternating manner.

In this case, the predetermined angle may be determined in a unit of a rotation angle or a number of turns (rotations). In one implementation, the predetermined angle may be determined as three turns.

The winding member 200 may be rotatably coupled to the fifth wall 150 of the housing 100. The winding member 200 may be rotatably supported by the shaft member 340 coupled through the fifth wall 150.

The winding member 200 may be provided in plurality. In the implementation illustrated in FIGS. 4 and 12, two winding members 200 may be provided and disposed to be spaced apart from each other in the extending directions of the first wall 110 and the second wall 120, that is, in the left and right directions.

In addition, in an implementation illustrated in FIG. 13, three winding members 200 may be provided. At this time, a single winding member of the three winding members 200 may be located to be biased to one of the third wall 130 and the fourth wall 140. In addition, a plurality of (the other) winding members 200 of the three winding members 200 may be located to be biased to the other of the third wall 130 and the fourth wall 140.

Furthermore, in an implementation illustrated in FIG. 14, four winding members 200 may be provided. In this case, a plurality of winding members 200 may be located adjacent to each other and biased to the third wall 130 and the fourth wall 140, respectively.

The number and arrangement method of the winding members 200 may change depending on the number and arrangement method of the gear unit 300.

At this time, the winding member 200 may preferably be located to be biased toward the second wall 120 rather than the first wall 110.

In detail, the first wall 110 may be provided with the suction portion 161 through which various types of garbage or litter are introduced together with small litter in the form of fur F from the outside. Therefore, when the winding member 200 is biased to the first wall 110, there may be a risk that the suction portion 161 is clogged by wound small litter in the form of fur F.

Therefore, the winding member 200 may preferably be located to be close to the second wall 120 between the first wall 110 and the second wall 120. This is because the exhaust portion 162 formed through the second wall 120 is a passage through which the air introduced into the collection space 170 is discharged and is relatively less likely to be clogged.

Furthermore, the winding member 200 may preferably be disposed so as not to obscure the exhaust portion 162. That is, it may be preferable to minimize a region where the winding member 200 overlaps the exhaust portion 162 in a widthwise direction of the housing 100, namely, in the front and rear directions in the illustrated implementation.

This is because the filter 162*a* located in the exhaust portion 162 is likely to be clogged by the small litter in the form of fur F wound around the winding member 200.

In addition, the winding member 200 may preferably be provided by at least two in number in order for the small litter in the form of fur F to be effectively wound. In addition, the at least two winding members 200 may preferably be spaced apart from each other in the extending directions of the collection space 170, namely, in the left and right directions in the illustrated implementation.

The winding member 200 may be made of a lightweight material. This may prevent an excessive increase in power or force required for the winding member 200 to be rotated even when the small litter like the fur F is wound.

The winding member 200 may be made of a material having high rigidity. This may prevent the winding member 200 from being damaged due to pressure applied as the small litter like the fur F is wound.

In one implementation, the winding member 200 may be formed of a synthetic resin material such as reinforced plastic.

In the illustrated implementation, the winding member 200 may include a base 210, a winding rib 220, a stepped portion 230, a sealing member 240, a height adjustment member 250, a winding column portion 260, and a winding blade 270.

The base 210 may define the body of the winding member 200. The base 210 may be coupled to the winding rib 220 and the stepped portion 230.

The base 210 may be rotatably coupled to the housing 100. In detail, the base 210 may be rotatably coupled to the fifth wall 150 of the housing 100 by the shaft member 340 of the gear unit 300.

In order to stably maintain the coupling, a separate coupling member (not shown) may be provided. The coupling member (not shown) may couple the base 210 and the shaft member 340 to each other.

In the illustrated implementation, the base 210 may be formed in a shape of a circular plate having a predetermined diameter D1, D2 (see FIGS. 16 and 17). The base 210 may be formed in an arbitrary shape which is rotatably coupled to the housing 100 so as to be rotatable by the gear unit 300.

However, considering that the small litter in the form of fur F is easily entangled around corners or vertices, the base 210 may preferably be formed to have an arcuate outer circumference so that there are no angular corners.

The base 210 may be formed to have diameters of various lengths. In the implementation illustrated in FIGS. 16 and 17, the base 210 may have a relatively small first diameter D1 or a relatively large second diameter D2. In the implementation, the first diameter D1 may be 25 mm. In addition, the second diameter D2 may be 36 mm.

It will be understood that the first diameter D1 and the second diameter D2 may change depending on the sizes of the housing 100 and the collection space 170.

At this time, as the diameter of the base 210 increases, a speed at which the fur F and the like are initially wound around the winding ribs 220 may decrease.

This may result from that a length by which the fur F and the like have to advance to be wound increases due to an increase in a distance between the winding ribs 220 located adjacent to an outer circumference of the base 210, which is caused by the increase in the diameter of the base 210.

However, once the fur F and the like are wound around the winding rib 220, a surface area of the fur F and the like wound around the winding rib 220 may increase as the diameter of the base 210 increases. Therefore, the subsequent winding process may proceed more effectively when the base 210 has a larger diameter.

As will be described later, the initial winding speed of the fur F and the like may also depend on the extension length of the winding rib 220. Accordingly, the diameter of the base 210 may preferably be determined in consideration of the extension length of the winding rib 220.

In addition, when the diameter of the base 210 increases, the distance between the winding ribs 220 may increase, and thereby the distance by which the fur F and the like have to advance to be wound may increase. Therefore, the number of the winding ribs 220 to be coupled to the base 210 may preferably increase as the diameter of the base 210 increases.

The winding rib 220 may be located on one side of the base 210 opposite to the fifth wall 150, namely, on an upper side of the base in the illustrated implementation. In detail, the winding rib 220 may extend from an upper surface of the base 210 in a direction opposite to the base 210.

The stepped portion 230 may be located on another side of the base 210 facing the fifth wall 150, namely, on a lower side of the base 210 in the illustrated implementation. In detail, the stepped portion 230 may be coupled to a lower surface of the base 210.

Accordingly, a predetermined space may be formed between the base 210 and the fifth wall 150. Small litter in the form of the fur F may be introduced into the predetermined space. In this case, the small litter in the form of the fur F may be wound on the base 210 and the shaft member 340 to which the base 210 is coupled, which may interfere with the rotation of the winding member 200.

To prevent this, the sealing member 240 may be disposed on the another side of the base 210, namely, on the lower side in the illustrated implementation. Specifically, the sealing member 240 may be disposed to surround a radially outer side of the stepped portion 230 on the lower surface of the base 210.

Accordingly, the small litter in the form of the fur F may not be introduced into a space, which is formed between the base 210 and the fifth wall 150 and located at the radially outer side of the stepped portion 230.

In addition, in one example including a detachable frame 400, 500 according to an implementation to be described later, a height adjustment member 250 (see FIG. 26) may be located on the another side of the base 210, namely, on the lower side in the illustrated implementation. Specifically, the height adjustment member 250 may be located between the base 210 and the stepped portion 230 (see FIG. 20).

In the illustrated implementation, the base 210 may include a coupling member insertion portion 211 and a hollow portion 212.

The coupling member insertion portion 211 may be a space in which a coupling member (not shown) for coupling the shaft member 340 and the base 210 to each other is inserted. The coupling member insertion portion 211 may be recessed into the base 210, namely, into the upper surface of the base 210.

Specifically, the coupling member insertion portion 211 may be surrounded by a partition wall portion, which has a cross section in a cylindrical shape and protrudes upward from a radially outer side of the center of the base 210. Accordingly, even if the base 210 is formed in the plate shape, the coupling member insertion portion 211 may be formed sufficiently deep.

The coupling member insertion portion 211 may be disposed to have the same central axis as the center of the base 210. In the illustrated implementation, the coupling member insertion portion 211 may be formed to have a hexagonal cross section. This may result from that the coupling member (not shown) is a hexagonal nut (not shown). The shape of the coupling member insertion portion 211 may change depending on the shape of the coupling member (not shown).

The hollow portion 212 may be formed at a radially inner side of the coupling member insertion portion 211.

The hollow portion 212 may be a space through which the shaft member 340 is coupled. The hollow portion 212 may be formed through the base 210 in the up and down directions. The hollow portion 212 may extend to the inside of the stepped portion 230. In the implementation including the height adjustment member 250 as described above, the hollow portion 212 may extend up to the inside of the height adjustment member 250.

In the illustrated implementation, the hollow portion 212 may have a circular cross section, and may be formed through the base 210 and the stepped portion 230 in the up and down directions. In the implementation illustrated in FIG. 20, the hollow portion 212 may be formed through the height adjustment member 250 in the up and down directions.

The hollow portion 212 may be aligned with the through hole 151 formed through the fifth wall 150. In other words, the hollow portion 212 may be formed to have the same central axis as the through hole 151. In one implementation, the hollow portion 212 may be formed to have the same cross section as the through hole 151.

When the shaft member 340 is coupled through the hollow portion 212 and then reaches the coupling member insertion portion 211, an upper end portion of the shaft member 340 may be coupled by the coupling member (not shown). Accordingly, when the gear unit 300 is operated, the winding member 200 may be rotated.

As illustrated in FIGS. 4 to 17, the winding member 200 according to the illustrated implementation may include the winding rib 220.

Small litter in the form of fur F may be wound around the winding rib 220. The small litter in the form of fur F introduced into the collection space 170 through the suction portion 161 may be wound on the winding rib 220 and then compressed.

Specifically, the winding rib 220 may be connected to the base 210 to rotate together with the base 210. Accordingly, the small litter in the form of fur F introduced into the collection space 170 may be rotated while being wound around the winding rib 220, and thereby its radius may gradually increase.

Therefore, the small litter in the form of fur F may not spread out inside the collection space 170, which may minimize twisting and entanglement of the small litter in the form of fur F. As the small litter in the form of fur F is wound on the winding rib 220, its volume may decrease, so that an amount of small litter in the form of fur F accommodated in the collection space 170 can increase.

Further, in the implementation including the detachable frame 400, 500, 600 to be described later, the wound small litter in the form of fur F can be discharged merely by detaching the detachable frame 400, 500, 600 from the housing 100.

This may result in improving user convenience and increasing the amount of small litter in the form of fur F to be collected by the cleaner 1.

The winding rib 220 may be continuous with (extend from) the base 210. Specifically, the winding rib 220 may extend from the one side of the base 210 opposite to the fifth wall 150, namely, the upper surface in the illustrated implementation, in a direction opposite to (away from) the base 210, namely, upward in the illustrated implementation.

A lower end portion of the winding rib 220 may be coupled to the base 210. An upper end portion of the winding rib 220 may be located at an arbitrary height inside the collection space 170. In one implementation, the winding rib 220 may have an upper end portion located above the suction portion 161.

In the implementation, the small litter in the form of fur F introduced into the collection space 170 through the suction portion 161 may be effectively wound on the winding rib 220.

The winding rib 220 may be provided in plurality.

Figure 5:
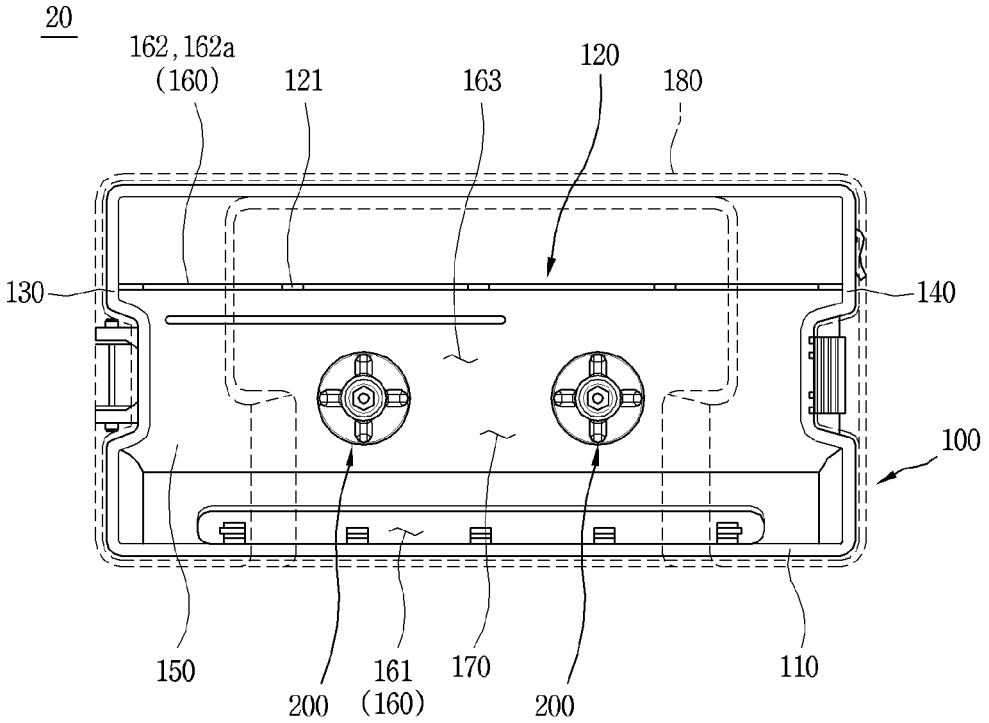
FIG. 5 is a planar view of the dust storage container of FIG. 4.

In the implementation illustrated in FIGS. 4 and 5, four winding ribs 220 may be provided. The four winding ribs 220 may be disposed on a radially outer side of the center of the base 210 in a manner of forming a predetermined angle with respect to the center of the base 210.

In the illustrated implementation, the four winding ribs 220 may be disposed to form 90° with respect to the center of the base 210. In other words, a virtual straight line connecting each pair of winding ribs 220 facing each other may pass through the center of the base 210.

In this case, distances between the center of the base 210 and the four winding ribs 220 may be the same. The implementation can achieve the highest winding efficiency of small litter such as the fur F.

In the implementation illustrated in FIG. 10, two winding ribs 220 may be provided. The two winding ribs 220 may be disposed on the radially outer side of the center of the base 210 in a manner of forming a predetermined angle with respect to the center of the base 210.

In the illustrated implementation, the two winding ribs 220 may be disposed to form 90° with respect to the center of the base 210. In other words, a virtual straight line connecting the two winding ribs 220 may pass through the center of the base 210.

In this case, distances between the center of the base 210 and the two winding ribs 220 may be the same.

In the implementation illustrated in FIGS. 12 and 13, three winding ribs 220 may be provided. The three winding ribs 220 may be disposed on the radially outer side of the center of the base 210 in a manner of forming a predetermined angle with respect to the center of the base 210.

In the illustrated implementation, the three winding ribs 220 may be disposed to form 120° with respect to the center of the base 210. In other words, three lines connecting the winding ribs 220 adjacent to one another may form an equilateral triangle.

In this case, distances between the center of the base 210 and the three winding ribs 220 may be the same.

In addition to those implementations, the winding ribs 220 may be provided as a group of inner winding ribs 220 disposed adjacent to the center of the base 210 and a group of outer winding ribs 220 located adjacent to an outer circumference of the base 210 (see FIGS. 16 and 17). In the implementation, a total of eight winding ribs 220 may be provided.

The number of the winding ribs 220 may not be limited to those implementations, but the winding rib 220 may be provided in various numbers.

The winding rib 220 may be divided into a plurality of portions. In the illustrated implementation, the winding rib 220 may include an extension part 221 extending upwardly.

In addition, the extension part 221 may include a first inclined portion 221*a*, a second inclined portion 221*b*, and a third inclined portion 221*c*.

The first inclined portion 221*a* may be connected to the base 210. Specifically, the first inclined portion 221*a* may extend from the one side of the base 210 opposite to the fifth wall 150, namely, the upper surface in the illustrated implementation, in the direction opposite to (away from) the base 210, namely, upward in the illustrated implementation.

The first inclined portion 221*a* may extend at a predetermined angle with the upper surface of the base 210. In one implementation, the first inclined portion 221*a* may extend perpendicular to the upper surface of the base 210.

The first inclined portion 221*a* may extend long compared to the second inclined portion 221*b* and the third inclined portion 221*c*. This may result from the fact that the first inclined portion 221*a* is a portion where the fur F and the like are mainly wound.

Specifically, as the fur F and the like are wound around the winding rib 220, a thickness by which the fur F and the like are wound may be increased. Accordingly, the weight of the fur F and the like may be increased and the fur F and the like may fall downward.

Accordingly, the first inclined portion 221*a* may extend longer than the second inclined portion 221*b* and the third inclined portion 221*c*, so as to function as a path along which the fur F and the like in the wound state fall.

The first inclined portion 221*a* may extend in various lengths. Accordingly, the winding rib 220 may also extend in various lengths L1 and L2.

In the implementation illustrated in FIG. 17, the winding rib 220 may have a relatively short first length L1 and a relatively long second length L2. In the implementation, the first length L1 may be 25 mm. In addition, the second length L2 may be 40 mm.

It will be understood that the first length L1 and the second length L2 may change depending on the sizes of the housing 100 and the collection space 170.

At this time, when the winding rib 220 is longer in length, the fur F and the like may be more easily wound at the beginning. That is, when the winding rib 220 is formed longer, the skein of the fur F and the like may be more easily formed.

In addition, when the winding rib 220 is shorter in length, a frictional force with the skein of the fur F wound around the winding rib 220 may decrease more. Therefore, the skein can be easily separated from the winding rib 220.

However, considering the shapes of the housing 100 and the collection space 170, when the winding rib 220 infinitely extends long, it may rather interfere with the rotation of the winding member 200. Accordingly, the winding rib 220 may preferably be formed to be long, assuming that smooth rotation of the winding member 200 is ensured.

In addition, as described above, an initial winding speed and a subsequent winding speed of the fur F and the like may depend on the diameter of the base 210. Therefore, the extension length of the winding rib 220 may preferably be determined in consideration of the diameter of the base 210.

The first inclined portion 221*a* may be continuous with the second inclined portion 221*b*. Specifically, one end of the first inclined portion 221*a* opposite to the base 210, namely, an upper end in the illustrated implementation may be continuous with the second inclined portion 221*b*.

The second inclined portion 221*b* may be continuous with the first inclined portion 221*a*. The second inclined portion 221*b* may extend from the upper end of the first inclined portion 221*a* in a direction opposite to the first inclined portion 221*a*, namely, upward in the illustrated implementation.

The second inclined portion 221*b* may extend at a predetermined angle with the first inclined portion 221*a*. In the illustrated implementation, one surface of the second inclined portion 221*b* facing the center of the base 210, that is, a radially inner surface of the second inclined portion 221*b* may extend at an obtuse angle with a radially inner surface of the first inclined portion 221*a*.

In other words, the second inclined portion 221*b* may extend in a manner that its radially inner surface is inclined upward to a radially outer side.

Accordingly, compared to a case where the second inclined portion 221*b* extends in parallel with the first inclined portion 221*a*, the fur F and the like can be more effectively wound around the winding rib 220. In addition, the wound fur F and the like can be easily separated from the winding rib 220 in a perpendicular direction.

In this case, the radially outer surface of the second inclined portion 221*b* may be located on the same surface as the radially outer surface of the first inclined portion 221*a*.

The second inclined portion 221*b* may be continuous with the third inclined portion 221*c*. Specifically, one end portion of the second inclined portion 221*b* opposite to the first inclined portion 221*a*, namely, an upper end portion in the illustrated implementation may be continuous with the third inclined portion 221*c*.

The third inclined portion 221*c* may be continuous with the second inclined portion 221*b*. The third inclined portion 221*c* may extend from the upper end portion of the second inclined portion 221*b* in a direction toward a radially outer side.

The third inclined portion 221*c* may extend at a predetermined angle with the second inclined portion 221*b*. In the illustrated implementation, the third inclined portion 221*c* may be continuous with the second inclined portion 221*b* at an obtuse angle.

In one implementation, the third inclined portion 221*c* may extend perpendicularly with respect to the first inclined portion 221*a*. In other words, the third inclined portion 221*c* may extend in parallel to the upper surface of the base 210.

Accordingly, the second inclined portion 221*b* and the third inclined portion 221*c* may be formed to be relatively inclined with respect to the first inclined portion 221*a*. Accordingly, the fur F and the like wound around the winding rib 220 can be easily separated from the winding rib 220.

That is, it may be understood that the second inclined portion 221*b* and the third inclined portion 221*c* are formed to facilitate the separation of the wound fur F and the like.

Although not shown, the second inclined portion 221*b* may be formed at a radially outer side of the winding rib 220. That is, the winding rib 220 may extend to be inclined from a radially outer side to a radially inner side along a direction opposite to the base 210.

In the case, the fur F and the like wound around the winding rib 220 may be collected to be adjacent to an end portion of the winding rib 220 opposite to the base 210, namely, to the upper end portion in the illustrated implementation.

The stepped portion 230 may be located between the base 210 and the fifth wall 150 such that the base 210 and the fifth wall 150 are spaced apart from each other. In addition, the stepped portion 230 may be located to be spaced apart from the fifth wall 150. Accordingly, the winding rib 220 can be rotated smoothly.

The stepped portion 230 may be coupled to the one side of the base 210 facing the fifth wall 150, namely, to the lower side in the illustrated implementation. In one implementation, the stepped portion 230 may be integrally formed with the base 210

The stepped portion 230 may be formed in a shape corresponding to the base 210. In the illustrated implementation, the stepped portion 230 may be formed in a shape of a circular plate.

In the implementation, the stepped portion 230 may be formed to have the same center as the base 210, and may have a diameter smaller than the diameter of the base 210.

Accordingly, even when the stepped portion 230 is in contact with the fifth wall 150 in an unexpected situation, a contact area between the fifth wall 150 and the winding member 200 can be minimized. This may result in minimizing an affection of such situation to the rotation of the winding member 200.

The sealing member 240 may be located at a radially outer side of the stepped portion 230.

The sealing member 240 may close a space between the base 210 and the fifth wall 150 formed due to the stepped portion 230.

As described above, the stepped portion 230 may be formed to have a smaller diameter than the base 210. In addition, the stepped portion 230 may be located between the fifth wall 150 and the base 210.

Accordingly, a space which is partially surrounded by the fifth wall 150, the base 210, and the stepped portion 230 and communicates with the collection space 170 may be formed at the radially outer side of the stepped portion 230.

As the introduction and winding of the fur F and the like proceeds, the fur F and the like may partially be introduced into the space. Other dust or small litter introduced together with the fur F and the like may also be introduced into the space.

In this case, the introduced dust or litter may be introduced into a portion where the winding member 200 and the gear unit 300 are connected, which may be likely to interfere with (cause reduction of) the rotation of the winding member 200.

Accordingly, the sealing member 240 may close the space to prevent the dust or litter from interfering with the rotation of the winding member 200.

The sealing member 240 may be formed in a ring shape having a predetermined thickness. The stepped portion 230 may be inserted into a hollow portion formed inside the sealing member 240. In one implementation, an inner diameter of the sealing member 240 may be formed smaller than or equal to an outer diameter of the stepped portion 230. In the implementation, the stepped portion 230 may be fitted into the sealing member 240.

An outer diameter of the sealing member 240 may be formed to be smaller than or equal to an outer diameter of the base 210. Accordingly, the sealing member 240 may not protrude to the radially outer side of the base 210.

The sealing member 240 may be formed to have a predetermined height. In one implementation, the height of the sealing member 240 may be formed to be greater than or equal to a distance between the base 210 and the fifth wall 150. In the implementation, the height of the sealing member 240 may be formed to be greater than or equal to the distance between the base 210 and the fifth wall 150. In the implementation, the sealing member 240 may be fitted into the space.

The sealing member 240 may preferably be formed of a material having a predetermined elasticity. The sealing member 240 which is coupled in the fitted manner may be provided to stably seal the space. In one implementation, the sealing member 240 may be formed of a material such as felt or rubber.

The height adjustment member 250 may be located between the stepped portion 230 and the fifth wall 150 to adjust the heights of the stepped portion 230 and the base 210, namely, a relative distance to the fifth wall 150.

That is, as illustrated in FIGS. 25 to 30, the dust storage container 20 according to the implementation of the present disclosure may include a detachable frame 400, 500. At this time, the collection space 170 may be divided into a first collection space 171 and a second collection space 172 by a coupling plate 410, 510 of the detachable frame 400, 500.

The height adjustment member 250 may increase the distance between the base 210 and the fifth wall 150. Accordingly, the base 210 may be accommodated in a winding member coupling portion 411, 511 formed on the coupling plate 410, 510.

Accordingly, the introduced fur F and the like may be wound around the winding rib 220, without flowing into the second collection space 172 located at a lower side of the coupling plate 410, 510. Accordingly, the user can easily discharge the collected fur F and the like by simply detaching the detachable frame 400, 500.

In the illustrated implementation, the height adjustment member 250 may be divided in a direction from top to bottom into a first part having the relatively smallest diameter, a second part having the largest diameter, and a third part having a middle diameter.

In addition, each of the parts of the height adjustment member 250 may have a circular cross section and a predetermined height. The height adjustment member 250 may be formed in any shape capable of adjusting the heights of the base 210 and the stepped portion 230.

However, in an implementation in which the winding member 200 is provided in plurality, the height adjustment member 250 may also preferably have a circular cross section so as not to interfere with the rotation between the winding members 200.

As illustrated in FIGS. 18 to 23, the winding member 200 according to the illustrated implementation may include a winding column portion 260 and a winding blade 270.

The winding column portion 260 and the winding blade 270 may perform the function of the winding rib 220 according to the foregoing implementation.

That is, small litter in the form of fur F may be wound around the winding column portion 260 and the winding blade 270. The small litter in the form of fur F introduced into the collection space 170 through the suction portion 161 may be wound on the winding column portion 270 and the winding blade 270 and then compressed.

The winding column portion 260 or the winding blade 270 may be provided instead of the winding rib 220. That is, in the illustrated implementation, the winding member 200 may not include the winding rib 220, but include the winding column portion 260 or the winding blade 270.

The winding column portion 260 or the winding blade 270 may rotate in response to the rotation of the base 210. The introduced small litter in the form of the fur F may be wound on the winding column portion 260 or the winding blade 270.

Hereinafter, the winding column portion 260 provided in the winding member 200 according to the illustrated implementation will be described in detail with reference to FIGS. 18 to 23.

The winding column portion 260 may be located on one side of the base 210 facing the collection space 170, namely, on the upper side of the base 210 in the illustrated implementation. In other words, the winding column portion 260 may be supported by the base 210.

The winding column portion 260 may be continuous with the base 210. In one implementation, the winding column portion 260 may be manufactured separately from the base 210 and coupled to the base 210 later. In the implementation, a coupling member (not shown) for coupling the winding column portion 260 and the base 210 to each other may be provided. In another implementation, the winding column portion 260 may be manufactured integrally with the base 210.

The winding column portion 260 may extend by a predetermined length. An extension length of the winding column portion 260 may preferably be shorter than a distance between the base 210 and the cover 180. That is, an end of the winding column portion 260 in an extending direction of the winding column portion 260, in other words, an end (i.e., an upper end) in a direction opposite to the base 210 may be spaced apart from the cover 180.

Therefore, even if the winding column portion 260 rotates together with the base 210, its rotation may not be disturbed by the cover 180 or the like.

In one implementation, the extension length of the winding column portion 260 may be determined between the first length L1 and the second length L2, which are the lengths by which the winding rib 220 according to the foregoing implementation extends.

The winding column portion 260 may have a predetermined cross section. As described above, the winding column portion 260 may extend upward by a predetermined length. Therefore, the winding column portion 260 may be formed in a column shape as the name suggests.

In the implementation illustrated in FIG. 18, the winding column portion 260 may have a circular cross section and have a cylindrical shape extending in a direction opposite to the base 210.

In addition, in the implementation illustrated in FIG. 19, the winding column portion 260 may have an elliptical cross section and have an elliptical column shape extending in a direction opposite to the base 210.

Alternatively, the winding column portion 260 may be formed to have a polygonal cross section. In the implementation, the winding column portion 260 may be formed in a polygonal column shape.

In each implementation, the winding column portion 260 may be formed so that a center of its cross section has the same central axis as a center of a cross section of the base 210.

In addition, in the implementation illustrated in FIG. 18, the winding column portion 260 may be formed such that a diameter of its cross section is smaller than a diameter of the base 210. In addition, in the implementation illustrated in FIG. 19, the winding column portion 260 may be formed such that a length of its major axis is smaller than the diameter of the base 210.

Therefore, interference between the winding members 200 adjacent to each other may not occur when the winding members 200 rotate.

The winding column portion 260 may have any shape capable of allowing small litter such as fur F introduced into the collection space 170 to be wound around it.

In the illustrated implementation, the winding column portion 260 may be formed to have a filled inside. Alternatively, the winding column portion 260 may be provided in the form of an annular column in which a hollow portion extends in its lengthwise direction.

In the illustrated implementation, the winding column portion 260 may include an outer circumferential surface 261, a wing portion 262, a groove 263, and a friction member 264.

The outer circumferential surface 261 may form a part of an outer surface of the winding column portion 260. Specifically, as described above, the winding column portion 260 may be formed in the column shape. In this case, the outer circumferential surface 261 may be defined as a side surface of the winding column portion 260.

Small litter in the form of fur F may be wound on the outer circumferential surface 261. Specifically, in the implementation illustrated in FIGS. 18 and 19, the small litter in the form of fur F may be directly wound on the outer circumferential surface 261.

The outer circumferential surface 261 may be formed of a material having a predetermined roughness. This is to prevent loosening or dropping of the small litter in the form of fur F.

As will be described below, the outer circumferential surface 261 may have a structure or member for effectively winding the small litter in the form of fur F.

That is, in the implementation illustrated in FIGS. 20 and 21, the winding member 200 may include the wing portion 262 provided on the outer circumferential surface 261.

The wing portion 262 may be provided on the outer circumferential surface 261. The wing portion 262 may be continuous with the outer circumferential surface 261. The wing portion 262 may rotate together with the winding column portion 260 and the base 210. Small litter in the form of fur F may be wound around the wing portion 262.

The wing portion 262 may extend radially outward from the outer circumferential surface 261. That is, a distance between a rotation axis (i.e., a center of a cross section) of the winding column portion 260 and an end of the wind portion 262 may be longer than a distance between the rotation axis of the winding column portion 260 and the outer circumferential surface 261.

At this time, the extension length of the wing portion 262 may preferably be formed such that the sum of the extension length of the wing portion 262 and a radius of the winding column portion 260 is smaller than a radius of the base 210. In other words, a distance between the end of the wing portion 262 and the rotation axis may be shorter than the radius of the base 210. Accordingly, the end of the wing portion 262 may not protrude to the outside of the base 210.

Accordingly, interference between the wing portions 262 provided in the winding members 200 located adjacent to each other can be eliminated, thereby improving rotational reliability of the winding members 200.

In addition, it will be understood that the diameter of the cross section of the winding column portion 260 according to the implementation illustrated in FIGS. 20 and 21 is smaller than the diameter of the cross section of the winding column portion 260 according to the implementation illustrated in FIGS. 18, 19 and 22 to 24.

That is, it may be preferable that the winding column portion 260 according to the implementation illustrated in FIGS. 20 and 21 includes the wind portion 262 provided on the outer circumferential surface 261 and does not protrude to the outside of the base 210. Therefore, in the implementation, the winding column portion 260 may preferably be formed such that the diameter of the cross section is reduced by the extension length of the wing portion 262.

The wing portion 262 may be formed in any shape that extends outward from the outer circumferential surface 261, specifically, radially outward. In the illustrated implementation, the wing portion 262 may be divided into a first wing portion 262*a* and a second wing portion 262*b* according to its shape.

In the implementation illustrated in FIG. 20, the wing portion 262 may be provided as a first wing portion 262*a* having a rectangular plate shape. The first wing portion 262*a* may extend to a radially outside of the outer circumferential surface 261. As described above, an outer end part of the first wing portion 262*a*, that is, an end part toward the outer circumference of the base 210 may be located at a radially inner side, compared to the outer circumference of the base 210.

In the implementation, the first wing portion 262*a* may extend in a radially outward direction of the winding column portion 260 and in a direction in which the winding column portion 260 extends (that is, in the up and down direction), and have a thickness along the outer circumferential direction of the winding column portion 260. That is, in the implementation, the first wing portion 262*a* may have a rectangular plate shape.

In the implementation illustrated in FIG. 21, the wing portion 262 may be provided as a second wing portion 262*b* having a rectangular plate shape. The second wing portion 262*b* may extend to a radially outside of the outer circumferential surface 261. Even in the implementation, an outer end part of the second wing portion 262*b*, namely, an end part toward the outer circumference of the base 210 may be located at a radially inner side, compared to the outer circumference of the base 210.

In the implementation, the second wing portion 262*b* may extend from the outer circumferential surface 261 to be curved radially outward, and have a thickness along the outer circumferential direction of the winding column portion 260. In addition, the second wing portion 262*b* may extend in a direction (i.e., the up and down direction) in which the winding column portion 260 extends.

In the illustrated implementation, the thickness of the second wing portion 262*b* may decrease in a direction opposite to the outer circumferential surface 261. Alternatively, the second wing portion 262*b* may be formed to have a thickness, which is constant in a direction opposite to the outer circumferential surface 261, but may be more curved than that in the illustrated implementation.

The winding portion 262 may be provided in plurality. In the implementation, the wing portions 262 may be disposed along the outer circumferential surface 261 to be spaced apart from one another by the same angle based on the axis (the center of the cross section) of the winding column portion 260.

In the implementation illustrated in FIGS. 20 and 21, four wing portions 262 may be provided. The four wing portions 262 may be disposed along the outer circumferential surface 261 to be perpendicularly spaced apart from one another based on the axis of the winding column portion 260. That is, in the illustrated implementation, the wing portions 262 may be disposed to form 90° with one another.

The number and arrangement of the wing portions 262 may change.

In addition, in the implementation illustrated in FIGS. 22 and 23, the winding member 200 may include a groove 263 formed in the winding column portion 260 and a friction member 264 inserted into the groove 263.

The groove 263 may be recessed in the outer circumferential surface 261 of the winding column portion 260. Specifically, the groove 263 may be recessed in a direction from the outer circumferential surface 261 toward a radially inner side of the winding column portion 260, that is, toward the center of the winding column portion 260.

The groove 263 may extend in a direction in which the winding column portion 260 extends, namely, in the up and down direction in the illustrated implementation. Both end portions of the groove 263 in its extending directions may extend to the base 210 and to an upper end of the winding column portion 260. In other words, the groove 263 may extend from an upper surface to a lower end of the winding column portion 260.

The groove 263 may be formed in various shapes. In the illustrated implementation, the groove 263 may be formed by being surrounded by two surfaces facing each other and another surface which is continuous with the two surfaces. In the implementation, the radially outward direction of the groove 263 may be opened to communicate with the collection space 170.

An area of the radially outer side of the groove 263, that is, an area of a portion communicating with the collection space 170 may be formed to be smaller than an area of a portion of the outer circumferential surface 261 where the groove 263 is not formed. Accordingly, small litter such as fur F can be effectively wound along the outer circumferential surface 261.

A friction member 264 may be inserted into the groove 263. The friction member 264 may apply a friction force to prevent the small litter such as the fur F wound on the winding column portion 260 from being randomly unwound or dropped.

The friction member 264 may be formed of a material having a predetermined roughness. In particular, the friction member 264 may be formed of a material having a roughness greater than that of the outer circumferential surface 261. Therefore, the friction member 264 may allow the small litter such as the fur F to be effectively caught. In one implementation, the friction member 264 may be formed of a rubber material.

The friction member 264 may be formed to correspond to the shape of the groove 263. In the illustrated implementation, the friction member 264 may be formed so that its radially outer surface is rounded outward and have three surfaces to correspond to the surfaces surrounding the groove 263.

In one implementation, the radially outer surface of the friction member 264 may have the same curvature as the outer circumferential surface 261 and may be located on the same curved surface.

Further, the friction member 264 may extend in a direction in which the winding column portion 260 and the groove 263 extend, namely, in the up and down direction in the illustrated implementation. In the implementation, an upper end portion of the friction member 264 may be located on the same plane as the upper end portion of the winding column portion 260. Likewise, a lower end portion of the friction member 264 may come in contact with the base 210.

The groove 263 may be provided in plurality. In the implementation, the grooves 263 may be disposed along the outer circumferential surface 261 to be spaced apart from one another by the same angle based on the axis (the center of the cross section) of the winding column portion 260.

In the implementation illustrated in FIGS. 22 and 23, four grooves 263 may be provided. The four grooves 263 may be disposed along the outer circumferential surface 261 to be perpendicularly spaced apart from one another based on the axis of the winding column portion 260. That is, in the illustrated implementation, the grooves 263 may be disposed to form 90° with one another.

The number and arrangement of the grooves 263 may change.

The friction member 264 may be provided in plurality. In the implementation, the friction members 264 may be disposed along the outer circumferential surface 261 to be spaced apart from one another by the same angle based on the axis (the center of the cross section) of the winding column portion 260.

In the implementation illustrated in FIG. 23, four friction members 264 may be provided. The four friction members 264 may be disposed along the outer circumferential surface 261 to be perpendicularly spaced apart from one another based on the axis of the winding column portion 260. That is, in the illustrated implementation, the friction members 264 may be disposed to form 90° with one another.

The number and arrangement of the friction members 264 may change depending on the number and arrangement of the grooves 263.

On the other hand, in the implementation illustrated in FIG. 24, the winding member 200 may include a winding column portion 260 and a winding blade 270.

The winding column portion 270 may be located on one side of the base 210 facing the collection space 170, namely, on an upper side of the base 210 in the illustrated implementation. In other words, the winding blade 270 may be supported by the base 210.

The winding blade 270 may be continuous with the base 210. In one implementation, the winding blade 270 may be manufactured separately from the base 210 and coupled to the base 210 later. In the implementation, a coupling member (not shown) for coupling the winding blade 270 and the base 210 to each other may be provided. In another implementation, the winding blade 270 may be manufactured integrally with the base 210.

The winding blade 270 may extend by a predetermined length in a direction opposite to the base 210, that is, in an upward direction in the illustrated implementation. An extension length of the winding blade 270 may preferably be shorter than a distance between the base 210 and the cover 180.

In other words, an end of the winding blade 270 in an extending direction of the winding blade 270, in other words, an end (i.e., an upper end) in a direction opposite to the base 210 may be spaced apart from the cover 180.

Therefore, even if the winding blade 270 rotates together with the base 210, its rotation may not be disturbed by the cover 180 or the like.

In one implementation, the extension length of the winding blade 270 may be determined between the first length L1 and the second length L2, which are the lengths by which the winding rib 220 according to the foregoing implementation extends.

The winding blade 270 may cross the cross section of the base 210. That is, in the illustrated implementation, the winding blade 270 may be formed to pass through the center of the cross section of the base 210.

In the illustrated implementation, the winding blade 270 may include a blade portion 271.

The blade portion 271 may rotate together with the base 210 to wind up small litter such as fur F that is introduced into the collection space 170. The blade portion 271 may be coupled to the base 210.

The blade portion 271 may extend in a direction opposite to the base 210, namely, in the up and down direction in the illustrated implementation. As described above, the extension length of the blade portion 271 may be determined according to the position of the cover 180.

The blade portion 271 may extend on the cross section of the base 210. In one implementation, the blade portion 271 may be formed to cross the cross section of the base 210. In the illustrated implementation, the blade portion 271 may extend to overlap the diameter of the cross section of the base 210.

The blade portion 271 may extend by a predetermined length on the cross section of the base 210. The extension length of the blade portion 271 may be shorter than the diameter of the cross section of the base 210. That is, end portions of the blade portion 271 in each extending direction may be located at a radially inner side of the outer circumference of the base 210.

Therefore, the blade portion 271 may not protrude to the outside of the base 210. Accordingly, when the winding members 200 adjacent to each other rotate, each blade portion 271 may not interfere with another blade portion 271.

The blade portion 271 may be provided in plurality. The plurality of blade portions 271 may be disposed to intersect with each other at a predetermined angle. In the illustrated implementation, two blade portions 271 may be provided to be orthogonal to each other. That is, in the implementation, the angle formed by the blade portions 271 may be 90°.

The number and arrangement of the blade portions 271 may change.

4. Description of Gear Unit 300 According to Implementation of the Present Disclosure Referring back to FIGS. 4 to 15, the dust storage container 20 according to the implementation of the present disclosure may include the gear unit 300.

The gear unit 300 may be coupled with the winding member 200 to rotate the winding member 200. The gear unit 300 may include a motor 330 to generate power for rotating the winding member 200, and a transfer gear 310 and a rotation gear 320 both connected to the motor 330 to transfer the generated power to the winding member 200.

The gear unit 300 may be electrically connected to an external power source (not shown). Power for operating the motor 330 of the gear unit 300 may be supplied from the power source (not shown).

The gear unit 300 may be rotatably coupled to the housing 100. Specifically, the gear unit 300 may be rotatably coupled to the fifth wall 150 so as to face the winding member 200 with the fifth wall 150 interposed therebetween.

In the illustrated implementation, the gear unit 300 may include the transfer gear 310, the rotation gear 320, the motor 330, and the shaft member 340.

The transfer gear 310 may receive a rotational force of the motor 330. Also, the transfer gear 310 may transfer the received rotational force to the rotation gear 320 directly coupled with the winding member 200.

The transfer gear 310 may be connected to the motor 330. The connection may be achieved by means of the shaft member 340. When the motor 330 is rotated, the transfer gear 310 may be rotated in a clockwise or counterclockwise direction.

The transfer gear 310 may be located at a central portion in a direction in which the fifth wall 150 extends, namely, at a central portion in the left and right directions in the illustrated implementation. This is for the transfer gear 310 to effectively transfer the rotational force to each rotation gear 320 in an implementation in which the winding member 200 and the rotation gear 320 coupled to the winding member 200 are provided in plurality.

The transfer gear 310 may be gear-coupled (engaged) with the rotation gear 320. When the transfer gear 310 is rotated, the rotation gear 320 gear-coupled with the transfer gear 310 may be rotated in a direction opposite to the transfer gear 310.

Accordingly, each rotation gear 320 adjacent to the transfer gear 310 may be rotated in the same direction.

In the illustrated implementation, the transfer gear 310 may include a shaft coupling portion 311 and a tooth portion 312.

The shaft member 340 may be coupled to the shaft coupling portion 311. The transfer gear 310 may be rotated by the shaft member 340 which is rotated by the motor 330.

The shaft coupling portion 311 may be formed inside the transfer gear 310 in the up and down directions. In one implementation, the shaft coupling portion 311 may be located on the central axis of the transfer gear 310.

The tooth portion 312 may be formed on an outer circumferential surface of the transfer gear 310 in a radially outward direction of the shaft coupling portion 311.

The tooth portion 312 may be a portion where the transfer gear 310 is gear-coupled with the rotation gear 320. The tooth portion 312 may include a plurality of concave portions and convex portions. The concave portions may be recessed in a radially inward direction of the transfer gear 310. The convex portions may protrude in a radially outward direction of the transfer gear 310.

The tooth portion 312 of the transfer gear 310 may be disposed to be engaged with a tooth portion 322 of the rotation gear 320. Accordingly, the rotation of the motor 330 and the transfer gear 310 may be transferred to the rotation gear 320.

The rotation gear 320 may be coupled to the transfer gear 310 to receive the rotational force of the motor 330.

The rotation gear 320 may be gear-coupled with the transfer gear 310. The coupling may be achieved by engaging the tooth portion 322 of the rotation gear 320 and the tooth portion 312 of the transfer gear 310 with each other.

The rotation gear 320 may rotate in a direction opposite to the transfer gear 310. Specifically, the rotation gear 320 that is directly gear-coupled with the transfer gear 310 may rotate in a direction opposite to the rotating direction of the transfer gear 310.

In an implementation in which the rotation gear 320 is provided in plurality, the rotation gears 320 which are adjacent to each other and gear-coupled with each other may rotate in different directions.

The rotation gear 320 may be rotatably coupled to the fifth wall 150. The coupling may be achieved as the shaft member 340 inserted through the rotation gear 320 is coupled through the through hole 151 of the fifth wall 150.

The rotation gear 320 may be directly connected to the winding member 200. When the rotation gear 320 rotates, the winding member 200 may also rotate together.

The connection may be made in a manner that the shaft member 340 inserted through the rotation gear 320 is coupled through the hollow portion 212 of the base 210 via the through hole 151, the stepped portion 230, and the hollow portion formed in the height adjustment member 250.

The rotation gear 320 may be provided in plurality. The plurality of rotation gears 320 may be gear-coupled with at least one of another rotation gear 320 and the transfer gear 310.

In the implementation illustrated in FIG. 12, two rotation gears 320 may be provided. The two rotation gears 320 may be spaced apart from each other in a direction in which the collection space 170 extends, namely, in the left and right directions in the illustrated implementation.

In the implementation, each rotation gear 320 may be directly gear-coupled with the transfer gear 310. Accordingly, when the transfer gear 310 rotates, each rotation gear 320 may rotate in a direction opposite to the transfer gear 310.

It will be understood that the above implementation is an implementation including two winding members 200.

In the implementation illustrated in FIG. 13, three rotation gears 320 may be provided. Two of the three rotation gears 320 may be located adjacent to each other. In addition, the other rotation gear 320 may be directly gear-coupled with the transfer gear 310.

The two rotation gears 320 may be gear-coupled with each other, and any one of the two rotation gears 320 may also be gear-coupled with the transfer gear 310. That is, one of the two rotation gears 320 may be disposed to face the transfer gear 310 with the other rotation gear 320 interposed therebetween.

In this case, the two rotation gears 320 may be located to be biased to one of the third wall 130 and the fourth wall 140. In addition, the one rotation gear 320 may be located to be biased toward the other of the third wall 130 and the fourth wall 140.

That is, the two rotation gears 320 and the one rotation gear 320 may be disposed to face each other with the transfer gear 310 interposed therebetween.

In the illustrated implementation, the two rotation gears 320 may be located adjacent to the fourth wall 140. In addition, the one rotation gear 320 may be located adjacent to the third wall 130.

It will be understood that the above implementation is an implementation including three winding members 200.

In the implementation illustrated in FIG. 14, four rotation gears 320 may be provided. Two of the four rotation gears 320 may be located adjacent to each other. In addition, the remaining two rotation gears 320 may also be located adjacent to each other.

The two rotation gears 320 may be gear-coupled with each other, and any one of the two rotation gears 320 may also be gear-coupled with the transfer gear 310. That is, one of the two rotation gears 320 may be disposed to face the transfer gear 310 with the other rotation gear 320 interposed therebetween.

The remaining two rotation gears 320 may also be coupled with each other, and any one of the two rotation gears 320 may also be gear-coupled with the transfer gear 310. That is, one of the remaining two rotation gears 320 may be disposed to face the transfer gear 310 with the other rotation gear 320 interposed therebetween.

In this case, the two rotation gears 320 may be located to be biased to one of the third wall 130 and the fourth wall 140. Also, the remaining two rotation gears 320 may be located to be biased to the other of the third wall 130 and the fourth wall 140.

That is, the two rotation gears 320 and the remaining two rotation gears 320 may be disposed to face each other with the transfer gear 310 interposed therebetween.

In the illustrated implementation, the two rotation gears 320 may be located adjacent to the fourth wall 140. In addition, the remaining two rotation gears 320 may be located adjacent to the third wall 130.

The number and arrangement of the rotation gears 320 may change depending on the number and arrangement method of the winding members 200.

In the illustrated implementation, the rotation gear 320 may include a shaft coupling portion 321 and a tooth portion 322.

The shaft member 340 may be coupled to the shaft coupling portion 321. The rotation gear 320 may be rotatably coupled to the fifth wall 150. Also, the rotation gear 320 may be coupled to the winding member 200 so as to rotate together with the winding member 200. The coupling may be made by the shaft member 340.

The shaft coupling portion 321 may be formed inside the rotation gear 320 in the up and down directions. In one implementation, the shaft coupling portion 321 may be located on the central axis of the rotation gear 320.

The tooth portion 322 may be formed on an outer circumferential surface of the rotation gear 320 in a radially outward direction of the shaft coupling portion 321.

The tooth portion 322 may be a portion where the rotation gear 320 is gear-coupled with the transfer gear 310. Also, the tooth portion 322 may be a portion where any one rotation gear 320 is gear-coupled with another adjacent rotation gear 320.

The tooth portion 322 may include a plurality of concave portions and convex portions. The concave portions may be recessed in a radially inward direction of the rotation gear 320. The convex portions may protrude in a radially outward direction of the rotation gear 320.

The motor 330 may generate power (i.e., rotational force) for rotating the winding member 200. The power generated by the motor 330 may be transferred to the winding member 200 through the transfer gear 310, the rotation gear 320, and the shaft member 340.

The motor 330 may be electrically connected to an external power source (not shown). Power for operating the motor 330 may be supplied from the power source (not shown).

The motor 330 may be provided in any form capable of generating a rotational force in a clockwise or anticlockwise direction as power is applied.

The motor 330 may be coupled to the housing 100. Specifically, the motor 330 may be coupled to one side of the fifth wall 150 opposite to the collection space 170, namely, to a lower side of the fifth wall 150 in the illustrated implementation.

The motor 330 may be fixedly coupled to the housing 100. The coupling may be achieved by means of a support member 331. The support member 331 may be fixedly coupled to the motor 330 and the fifth wall 150 of the housing 100, respectively.

The position of the motor 330 may change depending on the number or position of the transfer gear 310 and the rotation gear 320. As described above, the number or position of the transfer gear 310 and the rotation gear 320 may depend on the number or position of the winding member 200.

Accordingly, it will be understood that the position of the motor 330 depends on the number or position of the winding member 200.

The motor 330 may be directly coupled to the transfer gear 310. The coupling may be achieved by means of the shaft member 340.

The shaft member 340 may be provided in plurality. The plurality of shaft members 340 may allow the transfer gear 310, the rotation gear 320, and the motor 330 to be coupled to the housing 100, respectively. In addition, the shaft member 340 may transfer the rotational force of the motor 330 to the transfer gear 310, the rotation gear 320, and the winding member 200.

Specifically, the shaft member 340 may allow the motor 330 and the transfer gear 310 to be coupled to each other. When the motor 330 rotates, the shaft member 340 and the transfer gear 310 coupled thereto may also rotate.

The shaft member 340 may allow the rotation gear 320 to be rotatably coupled to the fifth wall 150. At the same time, the shaft member 340 may directly couple the rotation gear 320 and the winding member 200 to each other. When the rotation gear 320 is rotated by the transfer gear 310, the shaft member 340 and the winding member 200 coupled to the shaft member 340 may also be rotated.

Accordingly, the fur F and the like introduced into the collection space 170 may be wound around the winding member 200.

5. Description of Detachable Frame 400, 500, 600 According to Implementation of the Present Disclosure As illustrated in FIGS. 25 to 34, the dust storage container 20 according to the implementation of the present disclosure may include a detachable frame 400, 500, 400.

The detachable frame 400, 500, 600 may facilitate fur F and the like collected in the collection space 170 to be discharged without separating the dust storage container 20 from the main body 10.

As described above, the fur F and the like may have a large volume and a light weight. Therefore, even after the fur F and the like are sufficiently wound around the winding member 200, a space occupied by the fur F and the like may not be large, and the weight of the wound fur F and the like may not be so heavy.

Even in this case, when the user needs to detach the dust storage container 20 from the main body 10 in order to remove the collected and wound fur F and the like, inconvenience may increase.

Accordingly, the dust storage container 20 according to the implementation of the present disclosure may include the detachable frame 400, 500, 400. Accordingly, the user can easily discharge the fur F and the like wound around the winding member 200 without detaching the dust storage container 20 from the main body 10.

As described above, in the implementation including the detachable frame 400, 500, the winding member 200 may be provided with a height adjustment member 250. The height adjustment member 250 may adjust the height of the base 210 so that the base 210 can be inserted into the winding member coupling portion 411, 511 of the detachable frame 400, 500. This will be described in detail later.

The detachable frame 400, 500, 600 may be accommodated in or drawn (pulled) out of the housing 100. Specifically, the detachable frame 400, 500, 600 may be accommodated in the collection space 170 or may be drawn out from the collection space 170.

The detachable frame 400, 500, 600 may be formed of a lightweight material. This is to prevent an excessive increase in weight of the dust storage container 20 and the cleaner 1 due to the detachable frame 400, 500, 600.

The detachable frame 400, 500, 600 may be formed of a material having a predetermined rigidity. This is to prevent the detachable frame 400, 500, 600 from being damaged by the fur F and the like during the process of being accommodated in and taken out of the housing 100.

In one implementation, the detachable frame 400, 500, 600 may be formed of a synthetic resin material.

(1) Description of Detachable Frame 400 According to Implementation of the Present Disclosure Hereinafter, a detachable frame 400 according to an implementation of the present disclosure will be described with reference to FIGS. 25 to 29 and 33.

In the illustrated implementation, the detachable frame 400 may include a coupling plate 410, a support portion 420, a grip portion 430, and a wiper portion 440.

The coupling plate 410 may define the body of the detachable frame 400. The coupling plate 410 may be a portion where the winding member 200 is coupled to the detachable frame 400. The coupling plate 410 may be formed in a plate shape.

In the illustrated implementation, the coupling plate 410 may extend such that its length in the left and right directions is longer than a length in the front and rear directions. The shape of the coupling plate 410 may change depending on the shape of the collection space 170.

The coupling plate 410 may be located to be spaced apart from the fifth wall 150 of the housing 100. That is, the coupling plate 410 may be located in the collection space 170 at a predetermined height. In this case, the height of the coupling plate 410 (i.e., a length spaced apart from the fifth wall 150) may be determined to be lower than the height of the suction portion 161.

Accordingly, as will be described later, various weights of litter (trash, garbage) introduced into the collection space through the suction portion 161 may be sorted according to the weights by a grid portion 412 formed in the coupling plate 410, so as to be introduced into a first collection space 171 and a second collection space 172, respectively.

In the illustrated implementation, the coupling plate 410 may include a winding member coupling portion 411 and a grid portion 412.

The winding member 200 may be coupled through the winding member coupling portion 411. The winding member coupling portion 411 may be formed through the coupling plate 410 in the up and down directions.

Specifically, the base 210 of the winding member 200 may be inserted into the winding member coupling portion 411. That is, the winding member coupling portion 411 may function as a passage through which the winding member 200 passes when the detachable frame 400 is accommodated in or detached from the collection space 170.

In addition, the grid portion 412 may formed at a radially outer side of the winding member coupling portion 411 to prevent the fur F and the like wound around the winding member 200 from dropping into the second collection space 172.

The winding member coupling portion 411 may have a similar diameter to the diameter of the base 210, but may alternatively have a larger diameter than that. That is, an outer circumference surrounding the winding member coupling portion 411 may be spaced apart from the base 210. Accordingly, the winding member 200 may be free from the interference of the coupling plate 410.

In addition, as the winding member coupling portion 411 is formed to have a similar size to that of the base 210, skein of the fur F and the like wound around the winding rib 220 may be separated from the winding rib 220 by the coupling plate 410.

The winding member coupling portion 411 may be provided in plurality. In the illustrated implementation, two pairs of winding member coupling portions 411 may be provided, namely, a total of four winding member coupling portions 411 may be provided. In addition, each pair of winding member coupling portions 411 may be located to be adjacent to any one of the third wall 130 and the fourth wall 140.

The number and arrangement of the winding member coupling portions 411 may change depending on the number and arrangement of the winding members 200.

As will be described later, the winding member coupling portion 411 may be provided with a wiper portion 440. The wiper portion 440 may open or close the winding member coupling portion 411 depending on whether the winding member 200 is inserted. This will be described in detail later.

The grid portion 412 may reinforce the rigidity of the coupling plate 410. In addition, the grid portion 412 may include a plurality of through holes so as to function as a passage through which heavy dust or litter is moved to the second collection space 172.

As can be seen from the name, the grid portion 412 may include a plurality of through holes and ribs formed between the plurality of through holes. The plurality of through holes may reduce the weight of the detachable frame 400. In addition, the plurality of through holes may function as a passage through which the first collection space 171 and the second collection space 172 communicate with each other.

The size of each of the plurality of through holes may preferably be formed to be smaller than the size of the base 210 of the winding member 200. Accordingly, the fur F and the like wound around the winding member 200 may not drop into the second collection space 172 through the plurality of through holes.

The ribs may be located among the plurality of through holes. The ribs may reinforce the rigidity of the coupling plate 410, which may be lowered as the plurality of through holes is formed. In addition, the ribs may prevent the fur F and the like wound around the winding member 200 from arbitrarily dropping into the second collection space 172.

The support portion 420 may be provided on a lower side of the coupling plate 410.

The support portion 420 may allow the coupling plate 410 to be spaced apart from the upper side of the fifth wall 150. By the support portion 420, the coupling plate 410 may be located at a predetermined height in the collection space 170. Accordingly, the collection space 170 may be divided into a first collection space 171 located above the coupling plate 410 and a second collection space 172 located below the coupling plate 410.

The support portion 420 may be connected to the coupling plate 410. Specifically, one end of the support portion 420 facing the coupling plate 410, namely, an upper end in the illustrated implementation may be connected to the coupling plate 410.

The support portion 420 may be in contact with the fifth wall 150. Specifically, another end of the support portion 420 facing the fifth wall 150, namely, a lower end in the illustrated implementation may be in contact with the fifth wall 150.

In the illustrated implementation, the support portion 420 may extend in the front and rear directions. The support portion 420 may be formed in an arbitrary shape, capable of supporting (lifting) the coupling plate 410.

The support portion 420 may be formed to have a predetermined height. The height may preferably be determined according to the height of the height adjustment member 250 provided on the winding member 200. That is, the height of the support portion 420 may preferably be formed long enough for the base 210 of the winding member 200 to be accommodated in or coupled to the winding member coupling portion 411.

The support portion 420 may be provided in plurality. The plurality of support portions 420 may be respectively disposed at any positions at which they can support the coupling plate 410.

In the illustrated implementation, three support portions 420 may be provided to be spaced apart from one another in the left and right directions. That is, in the illustrated implementation, the support portions 420 may be located on a left end portion, a right end portion, and a central portion of the coupling plate 410, respectively.

The grip portion 430 may be a portion at which the user grips the detachable frame 400. The user can easily attach or detach the detachable frame 400 into or from the collection space 170 by gripping the grip portion 430.

The grip portion 430 may be connected to the coupling plate 410. Specifically, one side of the grip portion 430 facing the coupling plate 410, namely, a lower end portion in the illustrated implementation may be connected to the coupling plate 410.

The grip portion 430 may extend toward the discharge portion 163. Specifically, the grip portion 430 may extend in a direction opposite to the coupling plate 410, namely, upward in the illustrated implementation.

The grip portion 430 may preferably be formed to be lower than or equal to the height of each wall 110, 120, 130, and 140 of the housing 100. Accordingly, when the cover 180 closes the collection space 170, interference may not be caused due to the grip portion 430.

In the illustrated implementation, the grip portion 430 may have a plate shape that an extension length in the up and down directions is longer than an extension length in the front and rear directions. In addition, the grip portion 430 may be provided with a concave portion adjacent to another side opposite to the coupling plate 410, namely, to an upper end portion in the illustrated implementation. The user can easily grip the grip portion 430 by inserting a finger into the concave portion.

The grip portion 430 may be formed in an arbitrary shape that the user can easily grip.

The grip portion 430 may be provided in plurality. The plurality of grip portions 430 may be spaced apart from each other, and located at positions where the detachable frame 400 can be effectively attached and detached. In the illustrated implementation, the grip portions 430 may be located on left and right end portions of the coupling plate 410, respectively.

The wiper portion 440 may open or close the winding member coupling portion 411 as the winding member 200 is coupled to or separated from the winding member coupling portion 411 (see FIG. 33). The wiper portion 440 may prevent small litter such as the fur F and the like wound around the winding member 200 from being arbitrarily escaped from the coupling plate 410.

In addition, when the detachable frame 400 is detached, the wiper portion 440 may partially wipe down the winding member 200, which may facilitate the skein of the small litter like the fur F and the like settled on the detachable frame 400 to be separated from the winding member 200.

The wiper portion 440 may be located adjacent to the winding member coupling portion 411. Specifically, the wiper portion 440 may be located on an inner surface or an inner circumference of the coupling plate 410 surrounding the winding member coupling portion 411.

The wiper portion 440 may be provided in plurality. The plurality of wiper portions 440 may be provided on the plurality of winding member coupling portions 411, respectively. In an implementation in which four winding member coupling portions 411 are provided, four wiper portions 440 may also be provided.

The wiper portion 440 may be in contact with or spaced apart from the winding member 200.

Specifically, when the detachable frame 400 is accommodated in the collection space 170, the winding member 200 may be brought into contact with the wiper portion 440 so as to press (push) the wiper portion 440 in a direction toward the cover 180, that is, upward.

Accordingly, the wiper portion 440 may be spread (opened) upward and brought into contact with the winding member 200. At this time, the small litter such as the fur F and the like may be wound around the winding member 200 at a radially outer side of the wiper portion 440.

In addition, when the detachable frame 400 is detached from the collection space 170, the pressed state of the wiper portion 440 by the winding member 200 may be released. Accordingly, the wiper portion 440 may be spread (closed) in a direction opposite to the cover 180, that is, downward, so as to be spaced apart from the winding member 200.

At this time, the wiper portion 440 may be spread (closed) downward while wiping a portion where it has been brought into contact with the winding member 200, that is, a lower portion of a side surface in the illustrated implementation. Accordingly, the small litter such as the fur F and the like that has been wound at the radially outer side of the wiper portion 440 can be easily separated from the winding member 200.

In the illustrated implementation, the wiper portion 440 may include a film member 441 and a score portion 442.

The film member 441 may open or close the winding member coupling portion 411. Specifically, when the film member 441 is brought into contact with the winding member 200, the film member 441 may open the winding member coupling portion 411. In addition, when the film member 441 is spaced apart from the winding member 200, the film member 441 may cover the winding member coupling portion 411.

The film member 441 may be formed of a flexible material. Accordingly, the film member 441 may be deformed when being brought into contact with or separated from the winding member 200. In one implementation, the film member 441 may be formed of a rubber or silicone material.

When the detachable frame 400 is accommodated in the collection space 170, the film member 441 may be spread (opened) toward the discharge portion 163, namely, upward in the illustrated implementation by the winding member 200. At this time, the spread (opened) film member 441 may be brought into contact with each side of the winding member 200. Accordingly, the small litter such as the fur F and the like may be wound at a radially outer side of the film member 441.

When the detachable frame 400 is detached from the collection space 170, the film member 441 may be deformed back into its original shape so as to be separated from the winding member 200. At this time, the film member 441 may close (cover) the winding member coupling portion 411.

Accordingly, the wound small litter such as the fur F and the like can be taken out of the collection space 170 together with the detachable frame 400 without remaining in the collection space 170.

In the illustrated implementation, the film member 441 may be provided in a circular plate shape. In the implementation, the film member 441 may have a diameter greater than or equal to the diameter of the winding member coupling portion 411. The shape of the film member 441 may change depending on the shape of the winding member coupling portion 411.

The score portion 442 may be provided inside the film member 441.

The score portion 442 may provide a space in which the film member 441 is to be deformed. Also, the score portion 442 may divide the film member 441 into a plurality of regions.

The score portion 442 may be formed through the inside of the film member 441. Specifically, the score portion 442 may be formed through the film member 441 in a height direction of the collection space 170, that is, in the up and down directions in the illustrated implementation.

In the illustrated implementation, the score portion 442 may be formed to cross the film member 441 provided in the circular plate shape. In the implementation, the score portion 442 may pass through the center of the film member 441.

The score portion 442 may extend inside the film member 441. At this time, an extension length of the score portion 442 may preferably be shorter than the diameter of the film member 441. In other words, end portions of the score portion 442 in directions in which the score portion 442 extends may be located inside the film member 441.

The score portion 442 may be provided in plurality. The plurality of score portions 442 may cross each other at a predetermined angle. In the illustrated implementation, two score portions 442 may cross each other to be orthogonal to each other. That is, in the implementation, the two score portions 442 may extend to form 90° with respect to each other.

Referring to FIGS. 28 and 29, a process in which the detachable frame 400 is taken out of the housing 100 is illustrated.

Referring to FIG. 28, a state in which the cover 180 covering the collection space 170 has first been removed is illustrated. Accordingly, the collection space 170 and the discharge portion 163 may communicate with the outside. Of course, it will be understood that a process of opening the cover portion 12 of the main body 10 must be carried out prior to the above process.

Referring to FIG. 29, a state in which the detachable frame 400 is drawn out of the housing 100 through the discharge portion 163 is illustrated. The user can grip the grip portion 430 to lift and detach the detachable frame 400.

At this time, the winding member coupling portion 411 may be formed to have a larger cross section than the winding member 200. Therefore, even if the detachable frame 400 is detached, the winding member 200 may not be affected.

On the other hand, as the winding of the fur F and the like around the winding rib 220 proceeds, the cross section of the fur F and the like may increase more than that of the winding member 200. As described above, since the cross section of the winding member coupling portion 411 is slightly larger than the cross section of the base 210 of the winding member 200, the wound fur F and the like may be discharged together by the coupling plate 410.

Therefore, in the implementation, such wound lightweight dust or litter such as the fur F and the like may be discharged merely by detaching (taking out) the detachable frame 400 without separating the entire dust storage container 20. This may result in improving user convenience.

(2) Description of Detachable Frame 500 According to Another Implementation of the Present Disclosure Hereinafter, a detachable frame 500 according to another implementation of the present disclosure will be described with reference to FIGS. 30 and 33.

In the illustrated implementation, the detachable frame 500 may include a coupling plate 510, a support portion 520, a grip portion 530, and a wiper portion 540.

The coupling plate 510, the support portion 520, and the wiper portion 540 of the detachable frame 500 according to the another implementation may have the same structures and functions as the coupling plate 410, the support portion 420, and the wiper portion 440 of the detachable frame 400 according to the foregoing implementation.

Accordingly, a description of the coupling plate 510, the support portion 520, and the wiper portion 540 will be replaced with the description of the coupling plate 410, the support portion 420, and the wiper portion 440 according to the foregoing implementation.

The grip portion 530 of the detachable frame 500 may be a portion gripped by the user. The user can easily insert or take out (attach or detach) the detachable frame 500 into or from the collection space 170 by gripping the grip portion 530.

In the illustrated implementation, the grip portion 530 may include a vertical portion 531 and a horizontal portion 532.

The vertical portion 531 may be connected to the coupling plate 510. Specifically, one side of the vertical portion 531 facing the coupling plate 510, namely, a lower end portion in the illustrated implementation may be connected to the coupling plate 510.

The vertical portion 531 may extend toward the discharge portion 163. Specifically, the vertical portion 531 may extend in a direction opposite to the coupling plate 510, namely, upward in the illustrated implementation.

The vertical portion 531 may preferably be formed to be lower than or equal to the height of each wall 110, 120, 130, and 140 of the housing 100. Accordingly, when the cover 180 closes the collection space 170, interference may not be caused due to the grip portion 530.

In the illustrated implementation, the vertical portion 531 may have a plate shape that an extension length in the up and down directions is longer than an extension length in the front and rear directions.

The vertical portion 531 may be provided in plurality. The plurality of vertical portions 531 may be spaced apart from each other, and located at positions where the detachable frame 500 can be effectively inserted and taken out. In the illustrated implementation, the vertical portions 531 may be located on left and right end portions of the coupling plate 510, respectively.

The horizontal portion 532 may extend between another end portions of the vertical portion 531 opposite to the coupling plate 510, namely, between upper end portions in the illustrated implementation.

The horizontal portion 532 of the detachable frame 500 may be a portion gripped by the user. The horizontal portion 532 may form a predetermined angle with the vertical portions 531 and extend between the plurality of vertical portions 531.

In the illustrated implementation, the horizontal portion 532 may extend to be perpendicular to the vertical portions 531 in the same direction as the extending directions of the coupling plate 510, namely, in the left and right directions. The horizontal portion 532 may be formed in an arbitrary shape that the user can easily grip.

In this implementation, the user can easily pull out the detachable frame 500 by gripping the horizontal portion 532 with one hand.

A state in which the detachable frame 500 is taken out of the housing 100 through the discharge portion 163 by performing the above process is illustrated in FIG. 30. The user can grip the grip portion 530, especially the horizontal portion 532, to lift and detach the detachable frame 500.

At this time, the winding member coupling portion 511 may be formed to have a larger cross section than the winding member 200. Therefore, even if the detachable frame 500 is taken out, the winding member 200 may not be affected.

On the other hand, as the winding of the fur F and the like around the winding rib 220 proceeds, the cross section of the fur F may increase more than that of the winding member 200. As described above, since the cross section of the winding member coupling portion 511 is slightly larger than the cross section of the base 210 of the winding member 200, the wound fur F and the like may be discharged together by the coupling plate 510.

Therefore, in the implementation, such wound lightweight dust or litter such as the fur F and the like may be discharged merely by detaching the detachable frame 500 without separating the entire dust storage container 20. This may result in improving user convenience.

(4) Description of Detachable Frame 600 According to Still Another Implementation of the Present Disclosure Hereinafter, a detachable frame 600 according to an implementation of the present disclosure will be described with reference to FIGS. 31, 32, and 34.

In the illustrated implementation, the detachable frame 600 may include a coupling plate 610, a grip portion 640, a plate member 630, a frame opening 640, and a wiper portion 650.

The wiper portion 650 of the detachable frame 600 according to the implementation may have the same structure and function as the wiper portions 440 and 540 of the detachable frames 400 and 500 according to the foregoing implementations.

Therefore, a description of the wiper portion 650 will be replaced with the description of the wiper portions 440 and 540 according to the foregoing implementations.

The coupling plate 610 may define a part of a body of the detachable frame 600. The coupling plate 610 may be a portion where the detachable frame 600 is in contact with the fifth wall 150. In the illustrated implementation, the coupling plate 610 may be formed in a plate shape.

In the illustrated implementation, the coupling plate 610 may extend such that its length in the left and right directions is longer than a length in the front and rear directions. The shape of the coupling plate 610 may change depending on the shape of the fifth wall 150 and the collection space 170.

In the illustrated implementation, the coupling plate 610 may include a winding member coupling portion 611.

The winding member 200 may be coupled through the winding member coupling portion 611. The winding member coupling portion 611 may be formed through the coupling plate 610 in the up and down directions.

Specifically, the base 210 of the winding member 200 may be inserted into the winding member coupling portion 611. That is, the winding member coupling portion 611 may function as a passage through which the winding member 200 passes when the detachable frame 600 is accommodated in (attached to) or detached from the collection space 170.

The winding member coupling portion 611 may have a similar diameter to the diameter of the base 210, but may alternatively have a larger diameter than that. That is, an outer circumference surrounding the winding member coupling portion 611 may be spaced apart from the base 210. Accordingly, the winding member 200 may be free from the interference due to the coupling plate 610.

In addition, as the winding member coupling portion 611 is formed to have a similar size to that of the base 210, the skein of the fur F and the like wound around the winding rib 220 may be separated from the winding rib 220 by the coupling plate 610.

The winding member coupling portion 611 may be provided in plurality. In the illustrated implementation, two pairs of winding member coupling portions 611 may be provided, namely, a total of four winding member coupling portions 611 may be formed. In addition, each pair of winding member coupling portions 611 may be located to be adjacent to any one of the third wall 130 and the fourth wall 140.

The number and arrangement of the winding member coupling portions 611 may change depending on the number and arrangement of the winding members 200.

In this implementation, as the coupling plate 610 is brought into contact with the fifth wall 150, the collection space 170 may not be partitioned in the up and down directions. Therefore, the height of the base 210 may not need to be excessively adjusted in order to prevent the fur F and the like wound around the winding member 200 from falling off.

The grip portion 620 of the detachable frame 600 may be a portion gripped by the user. The user can easily insert or take out (attach or detach) the detachable frame 400 into or from the collection space 170 by gripping the grip portion 620.

The grip portion 620 may be connected to a side plate 635 of the plate member 630. Specifically, one side of the grip portion 620 facing the side plate 635, namely, a lower end portion in the illustrated implementation, may be connected to the side plate 635.

The grip portion 620 may extend toward the discharge portion 163. Specifically, the grip portion 620 may extend in a direction opposite to the side plate 635, namely, upward in the illustrated implementation.

The grip portion 620 may preferably be formed to be lower than or equal to the height of each wall 110, 120, 130, and 140 of the housing 100. Accordingly, when the cover 180 closes the collection space 170, interference may not be caused due to the grip portion 620.

In the illustrated implementation, the grip portion 620 may be formed in a plate shape having an extension length in the front and rear directions longer than an extension length in the up and down directions. In addition, the grip portion 620 may be provided with a concave portion adjacent to another side opposite to the side plate 635, namely, an upper end portion in the illustrated implementation. The user can easily grip the grip portion 620 by inserting a finger into the concave portion.

The grip portion 620 may be formed in an arbitrary shape that the user can easily grip.

The grip portion 620 may be provided in plurality. The plurality of grip portions 620 may be spaced apart from each other, and located at positions where the detachable frame 400 can be effectively inserted and taken out (attached and detached). In the illustrated implementation, the grip portions 620 may be located on the plurality of side plates 635, respectively.

The plate member 630 may define the remaining part of the body of the detachable frame 600. The plate member 630 may be a portion located adjacent to each of the walls 110, 120, 130, and 140 of the housing 100.

In the illustrated implementation, the plate member 630 may include a plurality of plates 631, 632, 633, 634, and 635, and a frame rib 636. The plurality of plates 631, 632, 633, 634, and 635 may be disposed to surround a frame space portion 641 communicating with the collection space 170.

The first plate 631 may surround the frame space portion 641 at one side facing the first wall 110, namely, at the front side in the illustrated implementation. In the illustrated implementation, the first plate 631 may extend such that its length in the left and right directions is longer than a length in the up and down directions.

The first plate 631 may be located adjacent to a portion of the first wall 110. In the illustrated implementation, the first plate 631 may be located adjacent to a lower end portion of the first wall 110. In one implementation, the first plate 631 may come in contact the portion of the first wall 110.

The first plate 631 may be continuous with the coupling plate 610. In the illustrated implementation, the lower end portion of the first plate 631 may be continuous with a front end portion of the coupling plate 610.

The first plate 631 may extend at a predetermined angle with the coupling plate 610. In the illustrated implementation, the first plate 631 may extend upward to be perpendicular to the coupling plate 610.

The second plate 632 may surround the frame space portion 641 at the one side facing the first wall 110, namely, at the front side in the illustrated implementation. In the illustrated implementation, the second plate 632 may extend such that its length in the left and right directions is longer than a length in the up and down directions or the front and rear directions.

The second plate 632 may be located adjacent to another portion of the first wall 110. In the illustrated implementation, the second plate 632 may be located adjacent to a middle portion of the first wall 110. In one implementation, the second plate 632 may come in contact the another portion of the first wall 110.

The second plate 632 may be continuous with the first plate 631. In the illustrated implementation, the lower end portion of the second plate 632 may be continuous with an upper end portion of the first plate 631.

The second plate 632 may extend at a predetermined angle with the first plate 631. In the illustrated implementation, the second plate 632 may extend upward to be inclined forward with respect to the first plate 631. That is, the second plate 632 may be continuous with the first plate 631 at an obtuse angle.

A suction opening 642 of the frame opening 640 may be formed through an inside of the second plate 632. The suction opening 642 may extend long to correspond to the shape of the second plate 632, that is, in the left and right directions.

The third plate 633 may surround the frame space portion 641 at the one side facing the first wall 110, namely, at the front side in the illustrated implementation. In the illustrated implementation, the third plate 633 may extend such that its length in the left and right directions is longer than a length in the up and down directions.

The third plate 633 may be located adjacent to still another portion of the first wall 110. In the illustrated implementation, the third plate 633 may be located adjacent to an upper portion of the first wall 110. In one implementation, the third plate 633 may come in contact the still another portion of the first wall 110.

The third plate 633 may be continuous with the second plate 612. In the illustrated implementation, a lower end portion of the third plate 6330 may be continuous with an upper end portion of the second plate 632.

The third plate 633 may extend at a predetermined angle with the second plate 612. In the illustrated implementation, the third plate 633 may extend upward from the second plate 632 at an obtuse angle.

The first to third plates 631, 632, and 633 may be continuous with the side plates 635. The first to third plates 631, 632, and 633 may extend from the side plates 635 at predetermined angles. In the illustrated implementation, the first to third plates 631, 632, and 633 may be continuous to be perpendicular to front end portions of the plurality of side plates 635.

The first to third plates 631, 632, and 633 may be formed to surround the first wall 110 in the collection space 170.

The shapes and connection of the first to third plates 631, 632, and 633 may be determined according to the shape of the first wall 110.

The fourth plate 634 may surround the frame space portion 641 at one side facing the second wall 120, namely, at the rear side in the illustrated implementation. In the illustrated implementation, the fourth plate 634 may extend such that its length in the left and right directions is longer than a length in the up and down directions.

The fourth plate 634 may be located adjacent to the second wall 120. That is, the fourth plate 634 may be formed to surround the second wall 120 in the collection space 170. In one implementation, the fourth plate 634 may come in contact the second wall 120.

The fourth plate 634 may be continuous with the side plate 635. The fourth plate 634 may extend from the side plate 635 at a predetermined angle with the side plate 635. In the illustrated implementation, the fourth plate 634 may be continuous to be perpendicular to rear end portions of the plurality of side plates 635.

The shape of the fourth plate 634 may change depending on the shape of the second wall 120.

An exhaust opening 643 may be formed through the fourth plate 634. In addition, the exhaust opening 643 may be provided in plurality, which are located between adjacent frame ribs 636. Accordingly, the frame space portion 641 may communicate with the exhaust portions 162 through the exhaust openings 643 formed through the fourth plate 634.

The side plate 635 may be provided in plurality, to surround the frame space portion 641 at both sides facing the third wall 130 and the fourth wall 140, namely, at left and right sides in the illustrated implementation.

The side plate 635 may be located adjacent to the third wall 130 and the fourth wall 140. That is, the side plate 635 may surround the third wall 130 and the fourth wall 140 inwardly in the collection space 170. In one implementation, the side plates 635 may come in contact with the third wall 130 and the fourth wall 140, respectively.

The side plates 635 may extend between the first to third plates 631, 632, and 633 and the fourth plate 634. Specifically, the front end portions of the side plates 635 may be continuous with the first to third plates 631, 632, and 633 at a predetermined angle. In one implementation, the side plates 635 may extend to be perpendicular to the first to third plates 631, 632, and 633, respectively.

Also, the rear end portions of the side plates 635 may be continuous with the fourth plate 634 at a predetermined angle. In one implementation, the side plates 635 may extend to be perpendicular to the fourth plate 634.

The shape of the side plates 635 may be determined according to the shapes of the third wall 130 and the fourth wall 140.

The frame rib 636 may be located on the fourth plate 634. The frame rib 636 may be located between the plurality of exhaust openings 643 formed through the fourth plate 634.

In the illustrated implementation, the frame rib 636 may extend in the up and down directions. Accordingly, the rigidity of the fourth plate 634 can be reinforced.

The frame rib 636 may be provided in plurality. The plurality of frame ribs 636 may be located between adjacent exhaust openings 643 of the plurality of exhaust openings 643, respectively. In one implementation, the frame ribs 636 may be disposed to correspond to the positions of the reinforcing ribs 121.

That is, in the implementation, the frame ribs 636 and the reinforcing ribs 121 may overlap each other in the front and rear direction. Accordingly, the exhaust openings 643 and the exhaust portions 162 may smoothly communicate with each other, such that air introduced into the collection space 170 together with the fur F and the like can be easily discharged to the outside.

The first to fourth plates 631, 632, 633, and 634 and the side plates 635 may surround the frame space portion 641. In this case, a separate plate member may not be provided on the top of the frame space portion 641. That is, the top of the frame space portion 641 may be open. This is because the upper side of the collection space 170 in which the frame space portion 641 is accommodated may be covered by the cover 180.

The frame opening 640 may be a space where the detachable frame 600 communicates with the outside. The fur F and the like may be introduced into the housing 100 through the frame opening 640. In addition, air introduced together with the fur F and the collected and wound fur F and the like may be discharged to the outside of the housing 100 through the frame opening 640.

In the illustrated implementation, the frame opening 640 may include a frame space portion 641, a suction opening 642, and an exhaust opening 643.

The frame space portion 641 may be a space in which the fur F and the like introduced from the outside are collected. The frame space portion 641 may be surrounded by the first to fourth plates 631, 632, 633, and 634 and the side plates 635.

The frame space portion 641 may be another space located inside the collection space 170. That is, the frame space portion 641 may be defined as a partial space, which is surrounded by the first to fourth plates 631, 632, 633, and 634 and the side plates 635, of the collection space 170.

Accordingly, it may be said that the frame space portion 641 communicates with the collection space 170.

The top of the frame space portion 641 may be opened. Accordingly, the frame space portion 641 may communicate with the discharge portion 163. Therefore, the detachable frame 600 can be detached from the housing 100 through the discharge portion 163.

The frame space portion 641 may communicate with the suction opening 642. The fur F and the like passing through the suction opening 642 may be introduced into the frame space portion 641.

The frame space portion 641 may communicate with the exhaust openings 643. Air introduced together with the fur F and the like may flow to the exhaust openings 643.

The suction opening 642 may be formed through one side of the frame space portion 641, namely, the front side in the illustrated implementation.

The suction opening 642 may be a passage through which the external fur F and the like are introduced into the frame space portion 641. The suction opening 642 may communicate with the frame space portion 641.

The suction opening 642 may be formed through the inside of the second plate 632. The suction opening 642 may extend long in directions in which the second plate 632 extends, namely, in the left and right directions in the illustrated implementation.

The suction opening 642 may communicate with the suction portion 161. The external fur F and the like may be introduced into the frame space portion 641 sequentially through the suction portion 161 and the suction opening 642. In one implementation, the suction opening 642 may be formed in a shape and located at a position corresponding to those of the suction portion 161.

That is, the suction opening 642 may overlap the suction portion 161 in the front and rear directions and the up and down directions.

The exhaust opening 643 may be a passage through which air introduced together with the fur F and the like is discharged to the outside of the frame space portion 641. The exhaust opening 643 may communicate with the frame space portion 641.

The exhaust opening 643 may be formed through the fourth plate 634. The exhaust opening 643 may be provided in plurality, disposed to be spaced apart from one another. The frame ribs 636 may be disposed between the exhaust openings 643.

The exhaust openings 643 may communicate with the exhaust portions 162. Air introduced into the frame space portion 641 may be discharged to the outside sequentially through the exhaust openings 643 and the exhaust portions 162. In one implementation, the exhaust openings 643 may be formed in a shape and located in positions corresponding to those of the exhaust portions 162.

That is, the exhaust openings 643 may overlap the exhaust portions 162 in the front and rear directions. In addition, the frame ribs 636 may overlap the reinforcing ribs 121 in the front and rear directions.

Referring back to FIG. 31, the state in which the detachable frame 600 is drawn out of the housing 100 through the discharge portion 163 is illustrated. The user can grip the grip portion 620 to lift and detach the detachable frame 600.

At this time, the winding member coupling portion 611 may be formed to have a larger cross section than the winding member 200. Therefore, even if the detachable frame 600 is pulled out, the winding member 200 may not be affected.

On the other hand, as the winding of the fur F and the like around the winding rib 220 proceeds, the cross section of the fur F may increase more than that of the winding member 200. As described above, since the cross section of the winding member coupling portion 611 is slightly larger than the cross section of the base 210 of the winding member 200, the wound fur F and the like may be discharged together by the coupling plate 610.

Therefore, in the implementation, such lightweight dust or litter like the fur F and the like may be discharged merely by detaching the detachable frame 600 without separating the entire dust storage container 20. This may result in improving user convenience.

6. Description of Process in which Fur F and the Like are Wound on the Winding Member 200 According to Implementation of the Present Disclosure The dust storage container 20 according to the implementation of the present disclosure may include the winding member 200 rotatably provided therein. The winding member 200 may be rotated by the gear unit 300 to wind up the fur F and the like introduced into the collection space 170.

As the fur F and the like are wound, a space occupied by the fur F and the like in the collection space 170 may be reduced. Therefore, even when a large amount of fur F and the like is collected, the cleaner 1 can continue a cleaning operation.

In addition, when the user wants to remove the collected fur F and the like, the user can easily remove the collected and wound fur F from the winding member 200 and discharge it to the outside.

Hereinafter, a process in which the fur F and the like are wound around the winding member 200 according to the implementation of the present disclosure in response to the rotation of the winding member 200 will be described in detail with reference to FIGS. 35 and 36.

When the cleaner 1 is operated, the cleaner 1 may collect dust or litter while traveling in a region to be cleaned. Accordingly, the fur F and the like spread over the region may be collected. The collected fur F and the like may be introduced into the collection space 170 through the suction portion 161.

At this time, the winding member 200 may be located inside the collection space 170. The fur F and the like introduced into the collection space 170 may be wound by being rotated along with the winding ribs 220. As described above, the rotation of the winding member 200 may be achieved by the gear unit 300.

In the implementation illustrated in FIG. 35, two winding members 200 may be provided to be spaced apart from each other in the left and right directions. Accordingly, the fur F and the like introduced into the collection space 170 may be wound around each winding member 200.

In the implementation, the maximum diameter of the skein formed by the fur F and the like wound around the winding member 200 may be determined according to a distance between the first wall 110 and the second wall 120.

In the implementation illustrated in FIG. 36, four winding members 200 may be provided and located in pairs. The two pairs may be spaced apart from each other in the left and right directions. And the pair of winding members 200 may be located to be adjacent to each other.

In the implementation, the maximum diameter of the skein formed by the fur F and the like wound around each winding member 200 may be determined according to the distance between the first wall 110 and the second wall 200 and a shortest distance between the pair of winding members 200 located adjacent to each other.

Accordingly, in the dust storage container 20 according to the implementation of the present disclosure, the fur F and the like collected inside can be wound around the winding member 200 without spreading out. This may facilitate the collection of fur F and the like which are thin, wound well, and long.

7. Description of Process of Removing Fur F and the Like Wound Around Winding Member According to Implementation of the Present Disclosure A dust storage container 20 according to an implementation of the present disclosure may include a detachable frame 400, 500, 600 detachably provided therein. The detachable frame 400, 500, 600 may facilitate the user to remove the fur F and the like wound around the winding member 200.

In detail, the dust storage container 20 according to the implementation of the present disclosure may include the winding member 200 rotatably provided therein. The winding member 200 may be rotated by the gear unit 300 to wind up the fur F and the like introduced into the collection space 170.

The user can easily discharge the wound fur F from the winding member 200 by detaching the detachable frame 400, 500, 600 from the housing 100.

Hereinafter, the process of removing the fur F and the like wound around the winding member 200 according to the implementation of the present disclosure will be described in detail with reference to FIGS. 37 to 39.

FIGS. 37 to 39 illustrate the detachable frame 400 according to the one implementation of the present disclosure, but it will be understood that the same process may be performed by the detachable frames 500 and 600 according to the another implementation and the still another implementation.

In addition, in the illustrated implementation, the wiper portion 440, 540, 650 described above have been omitted. As described above, it will be understood that the wiper portion 440, 540, 640 brought into contact with the winding member 200 covers the winding member coupling portion 411, 511, 611 as the detachable frame 400, 500, 600 is detached.

Accordingly, in the following description, it will be collectively referred to as the detachable frame 400, 500, 600.

Referring to FIG. 37, a state in which the fur F and the like have been wound around each winding member 200 through the aforementioned process is illustrated.

In the illustrated implementation, four winding members 200 may be provided, and the skein of the fur F and the like may be formed on each of the four winding members 200. As described above, the number of the winding members 200 may change, and even at this time, the fur F and the like may be wound around each winding member 200.

On the other hand, a bottom of the skein of the fur F and the like may be limited from being dropped by the base 210. That is, the skein formed by the fur F and the like may be located on the upper side of the base 210.

At this time, the winding member coupling portion 411, 511, 611 of the detachable frame 400, 500, 600 may be coupled to the base 210. In addition, a portion of the coupling plate 410, 510, 610 surrounding the winding member coupling portion 411, 511, 611 may be located at a lower side of a radially outer end portion of the bottom of the skein formed by the wound fur F and the like.

That is, the bottom of the skein formed by the wound fur F and the like may be supported by the portion of the coupling plate 410, 510, 610.

Therefore, when the detachable frame 400, 500, 600 is pulled out from the collection space 170 by the user, namely, is moved upward in the illustrated implementation, the fur F and the like wound around the winding member 200 may be moved upward together with the detachable frame 400, 500, 600. That is, the wound fur F and the like may be drawn out of the collection space 170 together with the detachable frame 400, 500, 600.

Referring to FIG. 38, a state in which the detachable frame 400, 500, 600 and the skein formed by the fur F and the like have been pulled out from the collection space 170 is illustrated.

That is, as the detachable frame 400, 500, 600 is pulled out from the collection space 170 through the process, the skein formed by the fur F and the like supported by the coupling plate 410, 510, 610 may also be pulled out.

Therefore, the user can easily discharge the wound fur F and the like merely by detaching the detachable frame 400, 500, 600 from the collection space 170, without directly gripping the fur F and the like wound on the winding member 200 by hand.

In addition, in the state, the skein formed by the wound fur F and the like may be in a state settled on the coupling plate 410, 510, 610 of the detachable frame 400, 500, 600. Accordingly, the user can easily eliminate the wound fur F and the like by tilting the detachable frame 400, 500, 600.

Referring to FIG. 39, an inner state of the housing 100 after the skein of the fur F and the like and the detachable frame 400, 500, 600 have been separated is illustrated.

As described above, when the detachable frame 400, 500, 600 through which the winding member 200 has been coupled is detached, the skein of the fur F and the like may also be removed.

Accordingly, such collected fur F and the like may not exist in the housing 100.

After removing the skein of the fur F and the like, which has been pulled out together with the detachable frame 400, 500, 600, the user may insert the detachable frame 400, 500, 600 back into the collection space 170.

At this time, for easy insertion of the detachable frame 400, 500, 600, guides (not shown) may be provided on the third wall 130 and the fourth wall 140 supporting the detachable frame 400, 500, 600 on both sides in a lengthwise direction.

Accordingly, in the cleaner 1 according to the implementation of the present disclosure, the fur F and the like wound on the winding member 200 can be easily discharged by using the detachable frame 400, 500, 600. This may result in improving user convenience.

Although the present disclosure has been described with reference to the preferred implementations, it will be understood by those skilled in the art that the present disclosure can be variously modified and changed without departing from the scope of the present disclosure described in the appended claims.

INDUSTRIAL APPLICABILITY

The present disclosure may be applied to a cleaner having a structure that can effectively accommodate a bulky and compressible material such as fur or fibers

The invention claimed is:

1. A cleaner comprising:

a housing having a collection space formed therein to accommodate collected dust or litter; and a winding member disposed in the collection space, wherein the housing comprises:

a plurality of walls surrounding the collection space; and a suction portion formed through any one of the plurality of walls such that the collection space communicates with an outside, and wherein the winding member extends from any one of the plurality of walls toward the collection space, such that the litter introduced into the collection space through the suction portion is wound around the winding member, wherein the one wall with the suction portion is formed such that an extension length in one direction is longer than an extension length in another direction, and wherein the winding member is provided in plurality and disposed to be spaced apart from each other in the one direction, wherein a distance between one of the plurality of winding members and another winding member is different from a distance between the one winding member and still another winding member.

2. The cleaner of claim 1, wherein at least one of the plurality of winding members is rotatably coupled to the one of the plurality of walls.

3. The cleaner of claim 1, wherein the housing comprises:

an exhaust portion formed through another one of the plurality of walls, such that the collection space communicates with the outside, and wherein at least one of the plurality of winding members is located closer to the exhaust portion than to the suction portion.

4. The cleaner of claim 3, wherein the suction portion and the exhaust portion are disposed to face each other with the collection space interposed therebetween, and wherein at least one of the plurality of winding members is disposed between the suction portion and the exhaust portion.

5. The cleaner of claim 1, wherein the plurality of winding members are provided by four in number, and any one pair of winding members among the four winding members is arranged adjacent to each other with being biased to one side in the one direction, and wherein another pair of winding members among the four winding members is arranged adjacent to each other with being biased to another side in the one direction.

6. The cleaner of claim 1, further comprising a gear unit located outside the housing and coupled to the winding member, wherein the gear unit comprises:

a motor disposed at an outer side of the housing;

a transfer gear connected to the motor to be rotated together with the motor and rotatably coupled to the housing;

a rotation gear coupled to the transfer gear to be rotated together with the motor and the transfer gear, and rotatably coupled to the housing; and a shaft member coupled to the rotation gear and the winding member, respectively, and rotatably coupled through the housing, and wherein at least one of the plurality of winding members is rotated when the motor is operated.

7. A cleaner comprising:

a housing having a collection space formed therein to accommodate collected dust or litter; and a winding member disposed in the collection space, wherein the housing comprises:

a plurality of walls surrounding the collection space; and a suction portion formed through any one of the plurality of walls such that the collection space communicates with an outside, and wherein the winding member extends from any one of the plurality of walls toward the collection space, such that the litter introduced into the collection space through the suction portion is wound around the winding member, wherein the cleaner further comprises a gear unit located outside the housing and coupled to the winding member, wherein the gear unit comprises:

a motor disposed at an outer side of the housing;

a transfer gear connected to the motor to be rotated together with the motor and rotatably coupled to the housing;

a rotation gear coupled to the transfer gear to be rotated together with the motor and the transfer gear, and rotatably coupled to the housing; and a shaft member coupled to the rotation gear and the winding member, respectively, and rotatably coupled through the housing, wherein the winding member is rotated when the motor is operated, wherein the winding member is provided in plurality, disposed to be spaced apart from each other in the collection space, wherein each of the rotation gear and the shaft member is provided in plurality, wherein the plurality of shaft members is coupled to the plurality of winding members and the plurality of rotation gears, respectively, and wherein the plurality of rotation gears is gear-coupled with an adjacent transfer gear or an adjacent rotation gear, respectively.

8. The cleaner of claim 7, wherein the plurality of rotation gears is rotated in a direction opposite to the adjacent transfer gear or the adjacent rotation gear, and wherein each of the plurality of winding members is rotated in the same direction as each of the plurality of rotation gears coupled by the shaft members.

9. The cleaner of claim 7, wherein the transfer gear is disposed between the plurality of rotation gears connected to the plurality of winding members, respectively.

10. A cleaner comprising:

a main body provided with a container accommodating portion having an inner space; and a dust storage container inserted into or drawn out of the container accommodating portion to be attached to or detached from the main body, wherein the dust storage container comprises:

a housing having a collection space formed therein and communicating with an outside such that collected dust or litter is accommodated; and a winding member disposed in the collection space, wherein the housing comprises:

a plurality of walls surrounding the collection space; and a cover detachably coupled to the plurality of walls to open or close the collection space, wherein the winding member extends from any one of the plurality of walls in a direction in which the cover is detached from the plurality of walls, such that the litter introduced into the collection space is wound around the winding member, wherein the winding member is rotated by a predetermined angle in one of a clockwise direction and a counterclockwise direction and then rotated in another direction of the clockwise direction and the counterclockwise direction in a alternating manner.

11. The cleaner of claim 10, wherein the cover of the dust storage container opens or closes one side of the collection space, wherein the one wall on which the plurality of winding members is disposed is located opposite to the one side of the collection space, and wherein the winding member extends from the one wall to the one side of the collection space.

12. The cleaner of claim 10, wherein the housing of the dust storage container comprises:

an exhaust portion formed through still another one of the plurality of walls and allowing the collection space to communicate with the outside such that air introduced into the collection space is discharged, and wherein the plurality of winding member are disposed between the other wall through which the suction portion is formed and the still other wall of the plurality of walls through which the exhaust portion is formed.

13. The cleaner of claim 12, wherein the suction portion and the exhaust portion are disposed to face each other with the collection space interposed therebetween, and wherein at least one of the winding members is disposed between the suction portion and the exhaust portion and extends toward the cover.

* * * * *